US005753409A

United States Patent [19]

Takabayashi et al.

[11] Patent Number: 5,753,409

[45] Date of Patent: May 19, 1998

[54] SILVER HALIDE PHOTOGRAPHIC LIGHT SENSITIVE MATERIAL

[75] Inventors: Toshiyuki Takabayashi; Hirohide Ito, both of Hino, Japan

[73] Assignee: Konica Corporation, Japan

[21] Appl. No.: 728,777

[22] Filed: Oct. 11, 1996

[30] Foreign Application Priority Data

Oct. 16, 1995 [JP] Japan ..... 7-267085

[51] Int. Cl.[6] ..... G03C 1/295; G03C 1/46

[52] U.S. Cl. ..... 430/264; 430/502; 430/509

[58] Field of Search ..... 430/264, 502, 430/509

[56] References Cited

U.S. PATENT DOCUMENTS

| | | | |
|---|---|---|---|
| 4,920,034 | 4/1990 | Sasaoka et al. | 430/502 |
| 5,185,232 | 2/1993 | Sasaoka | 430/502 |
| 5,210,200 | 5/1993 | Shimada et al. | 548/303.1 |
| 5,273,859 | 12/1993 | Katoh et al. | 430/264 |
| 5,395,732 | 3/1995 | Katoh et al. | 430/502 |
| 5,512,415 | 4/1996 | Dale et al. | 430/502 |

FOREIGN PATENT DOCUMENTS

| | | |
|---|---|---|
| 0271063A2 | 6/1988 | European Pat. Off. . |
| 0512548A1 | 11/1992 | European Pat. Off. . |
| 0518238A1 | 12/1992 | European Pat. Off. . |
| 0616898A2 | 9/1994 | European Pat. Off. . |
| 2024184 | 10/1991 | Japan . |

*Primary Examiner*—Richard L. Schilling

*Attorney, Agent, or Firm*—Jordan B. Bierman; Bierman, Muserlian and Lucas

[57] ABSTRACT

A silver halide black-and-white photographic light sensitive material is disclosed, comprising a support provided on one side thereof photographic component layers comprising at least two, first and second silver halide emulsion layers and optionally a nonlight-sensitive hydrophilic colloidal layer, the first emulsion layer being provided closer to the support than the second emulsion layer, wherein two or more layers of the component layers, each contains a hydrazine compound; and a molar ratio of a total hydrazine content of all layer(s) closer to the support from the first emulsion layer which include the first emulsion layer to that of all layer(s) farther from the support than the first emulsion layer which include the second emulsion layer is 0.2 to 0.8.

5 Claims, No Drawings

SILVER HALIDE PHOTOGRAPHIC LIGHT SENSITIVE MATERIAL

FIELD OF THE INVENTION

The present invention relates to a silver halide photographic light-sensitive material and an image forming method, and more particularly, to a silver halide photographic light-sensitive material used for plate-making.

BACKGROUND OF THE INVENTION

In the case of a silver halide photographic light-sensitive material used for printing plate-making, photographic technologies which make it possible to reproduce ultra high contrast images have been known because halftone dot images are generally used. Among them, photographic light-sensitive materials containing hydrazine compound such as those disclosed in U.S. Pat. No. 4,269,929 have been known. Further, plate-making operations include a process for reproducing dot images on a high fidelity basis. For making excellent printed matters, not only high contrast but also highly faithful reproduction of aimed dots on a light-sensitive material for the plate-making are necessary. Recently, in the field of printing plate-making, an improvement of dot quality is demanded, and high definition printing of 600 lines/inch or higher and a method called an FM screening composed of a random pattern of uniform and minimum dots, for example, are required to reproduce a fine dot of not more than 25 μm. These technologies are required to reproduce faithfully the aimed fine dots basis when conducting exposure by means of an image-outputting apparatus equipped with a laser light source such as an Ar laser, a He—Ne laser or a semiconductor laser, what is called a plate-making scanner or when conducting contact printing wherein a transmission type halftone original is exposed to light by a printer. For an improvement of quality such as enlargement and reduction of a halftone photograph in a line image photographing process, or for an improvement of reproduction of chinese/gothic characters, it is necessary that the aimed fine dots are faithfully reproduced on a high fidelity basis.

As a means for improving a faithful reproducibility for an original, there has been known a technology wherein an antihalation layer is provided between an emulsion layer and a support by the use of a dispersion of a dye which is substantially water-soluble at pH of not less than 8 and is substantially water-insoluble at pH of not more than 6, such as those disclosed in Japanese Patent Publication Open to Public Inspection Nos. 92716/1977 and 277045/1990 (hereinafter referred to as Japanese Patent O.P.I Publication), for example, and they still are not sufficient. In addition, as other means, there are known methods wherein development of unexposed portions surrounded by large dot portions with dot percentage of 90% or more or black solid portions are selectively inhibited, such as, for example, the methods wherein DIR (Development Inhibitor Releasing) compounds release inhibitors imagewise disclosed in Japanese Patent O.P.I. Publication Nos. 296138/1986, 88451/1989 and 19647/1992. However, these are not sufficient either.

Heretofore, it has been necessary to process with a developing solution with a pH of not less than 11 for obtaining ultra high contrast images by the use of hydrazine compound. In this case, however, there has been a problem that the developing solution is easily oxidized and thereby photographic performances are varied greatly. In recent years, there has been known a method wherein it is possible to obtain ultra high contrast images by the use of hydrazine compound even with a stable developing solution with a pH of not more than 11. In this case, however, it has been difficult to reproduce faithfully fine dots as described in the foregoing.

SUMMARY OF THE INVENTION

In view of the problems mentioned above, an object of the invention is to provide a silver halide photographic light-sensitive material with ultra high contrast and capable of reproducing faithfully even a fine dot of not more than 25 μm.

Another object is to provide a silver halide photographic light-sensitive material wherein dot quality and dot reproducibility are less deteriorated in the case of reproducing a fine dot of not more than 25 μm even when using a stable developing solution with a pH of 9–11.

Aforesaid objects of the invention are attained by the following constitutions.

(1) A silver halide black-and-white photographic light sensitive material comprising a support provided on one side thereof photographic component layers comprising at least two, first and second silver halide emulsion layers and optionally a nonlight-sensitive hydrophilic colloidal layer, the first emulsion layer being provided closer to the support than the second emulsion layer, wherein two or more layers of the component layers each contain a hydrazine compound; and a molar ratio of a total hydrazine content of all layer(s) closer to the support from the first emulsion layer which include the first emulsion layer to that of all layer(s) farther from the support than the first emulsion layer which include the second emulsion layer but do not include the first emulsion layer is 0.2 to 0.8.

(2) A silver halide black-and-white photographic light sensitive material comprising a support provided on one side thereof photographic component layers comprising at least one nonlight-sensitive hydrophilic colloidal layer and at least two, first and second silver halide emulsion layers, the first emulsion layer being provided closer to the support than the second emulsion layer, wherein said first and second emulsion layers each contain a hydrazine compound and a molar ratio of the hydrazine content of said first emulsion layer to that of said second emulsion layer is 0.2 to 0.8.

(3) The silver halide photographic material as described in (1) or (2), wherein at least one of the component layers of the photographic material contains a redox compound capable of releasing a development inhibitor upon oxidation.

(4) The silver halide photographic material as described in (1), (2) or (3), wherein said redox compound is contained in a nonlight-sensitive hydrophilic colloidal layer closer to the support than the first emulsion layer.

(5) The silver halide photographic material as described in (1), (2), (3) or (4), wherein at least one of the component layers contains a dye in the form of a solid particle dispersion.

(6) The silver halide photographic material as described in (1), (2), (3), (4) or (5), wherein said dye is contained in said first emulsion layer or a nonlight-sensitive hydrophilic colloidal layer which is adjacent the first emulsion layer and provided closer to the support than the first emulsion layer.

(7) A method of forming an image having a gradient (γ) of 10 or more by developing the silver halide photographic material as described in (1) through (6), in a developer having a pH of not less than 9 and less than 10.

DETAILED DESCRIPTION OF THE INVENTION

A photographic component layer provided on one side of a support of a silver halide photographic light-sensitive material of the invention is composed of at least two silver halide emulsion layers and at least one non-light-sensitive hydrophilic colloidal layer.

In the invention, the photographic component layer is referred to as a hydrophilic colloidal layer that constitutes a silver halide photographic light-sensitive material.

A hydrazine compound used in the invention includes a compound represented by the following formula [H].

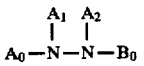

Formula [H]

The formula [H] will be explained in detail as follows.

In the formula, $A_0$ represents an aliphatic group, an aromatic group or a heterocyclic group. An aliphatic group represented by $A_0$ is preferably one having 1–30 carbon atoms, and it particularly is a straight-chained, branched or cyclic alkyl group having 1–20 carbon atoms. For example, a methyl group, an ethyl group, a t-butyl group, an octyl group, a cyclohexyl group and a benzyl group are given, and these groups may further be substituted with appropriate substituent (for example, an aryl group, an alkoxy group, an aryloxy group, an alkylthio group, an arylthio group, a sulfoxy group, a sulfonamide group, a sulfamoyl group, an acylamino group or an ureido group).

In the formula [H], an aromatic group represented by $A_0$ is preferably a monocyclic, or condensed ring aryl group, and a benzene ring or a naphthalene ring, for example, is cited.

In the formula [H], a heterocyclic group represented by $A_0$ is preferably a monocyclic, or condensed heterocyclic ring containing at least one hetero-atom selected from a group of nitrogen, sulfur and oxygen. For example, there are given a pyroridine ring, an imidazole ring, a tetrahydrofuran ring, a morpholine ring, a pyridine ring, a pyrimidine ring, a quinolin ring, a thiazole ring, a benzthiazole ring, a thiophene ring and a furan ring.

Those especially preferable as $A_0$ include an aryl group and a heterocyclic group. It is preferable that an aromatic group and a heterocyclic group represented by A. have a substituent. Preferable substituents, for example, include an alkyl group, an aralkyl group, an alkenyl group, an alkinyl group, an alkoxy group, a substituted amino group, an acylamino group, a sulfonylamino group, an ureido group, a urethane group, an aryloxy group, a sulfamoyl group, a carbamoyl group, an alkylthio group, an arylthio group, a sulfothio group, a sulfinyl group, a hydroxy group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxy group and a phosphonic acid amido group, and these groups may further be substituted. Among these substituents, those having an acid group with pKa of 7–11 are preferable when processing with a developing solution with pH of not more than 10.5 within a total processing time (Dry to Dry) of 60 seconds, and concrete examples thereof include a sulfonamido group, a hydroxy group and a mercapto group, wherein the sulfonamido group is especially preferable.

It is preferable that $A_0$ contains at least one diffusion-proof group or a group for promoting adsorption on silver halide. As nondiffusing group, a ballast group commonly used with an inactive photographic additive such as a coupler is preferable, and as a ballast group, there may be given groups having 8 or more carbon atoms and being relatively inert photographically such as, for example, an alkyl group, an alkenyl group, an alkinyl group, an alkoxy group, a phenoxy group and an alkylphenoxy group.

The adsorption-promoting group includes thiourea, a thiourethane group, a mercapto group, a thioether group, a thion group, a heterocyclic group, a thioamido heterocyclic group, a mercapto heterocyclic group or an adsorption group described in Japanese Patent O.P.I. Publication No. 90439/1989.

$B_0$ represents a blocking group, preferably $—G_0—D_0$ $G_0$ represents a —CO— group, a —COCO— group, a —CS— group, a $—C(=NG_1D_1)—$ group, a —SO— group, a $—SO_2—$ group or $—P(O)(G_1D_1)—$ group. $G_1$ represents a linkage, a —O— group, a —S— group or $—N(D_1)—$ group. $D_1$ represents an aliphatic group, an aromatic group, a heterocyclic group or a hydrogen atom, and when there exist plural $D_1$ in a molecule, they may be either the same or different.

$D_0$ represents an aliphatic group, an aromatic group, a heterocyclic group, an amino group, an alkoxy group and a mercapto group.

Preferable $G_0$ includes a —CO— group and a —COCO— group, and the —COCO— group is especially preferable.

Preferable $D_0$ includes a hydrogen atom, an alkoxy group and an amino group.

With regard to $A_1$ and $A_2$, either both of them represent hydrogen atoms, or one of them represents a hydrogen atom and the other represents an acyl group (acetyl, trifluoroacetyl, benzoyl etc.), a sulfonyl group (methanesulfonyl, toluenesulfonyl, etc.), or an oxalyl group (ethoxalyl, etc.)

Actual examples for a compound represented by Formula [H] are shown below, but the invention is not limited to them.

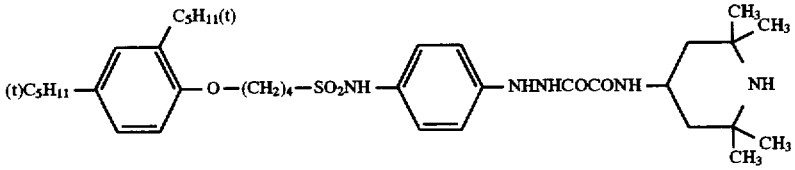

H-1

-continued
H-2
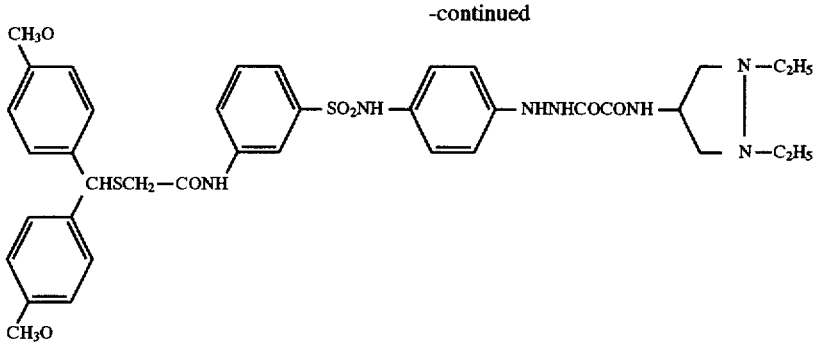
H-3
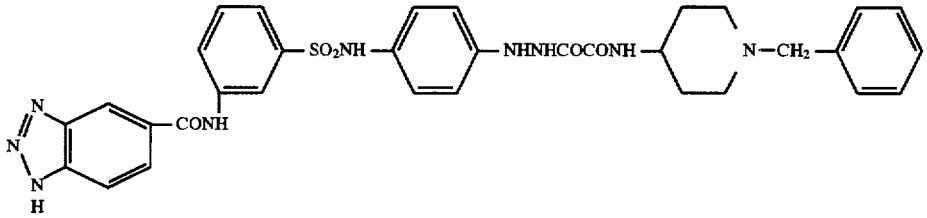
H-4
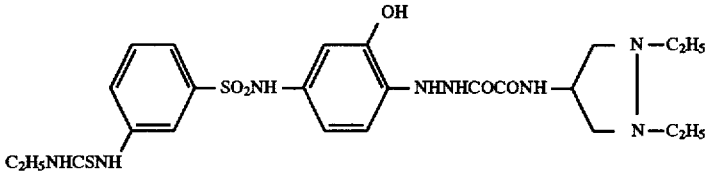
H-5
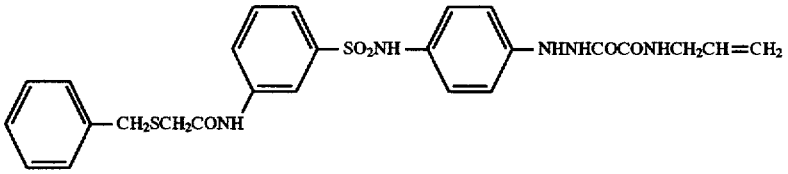
H-6
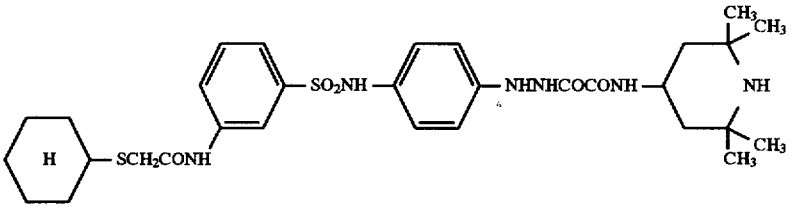
H-7
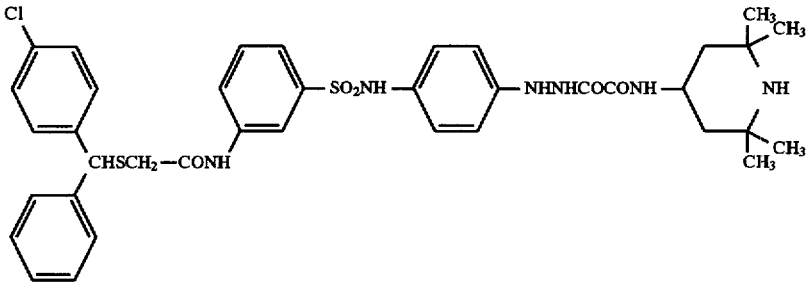
H-8
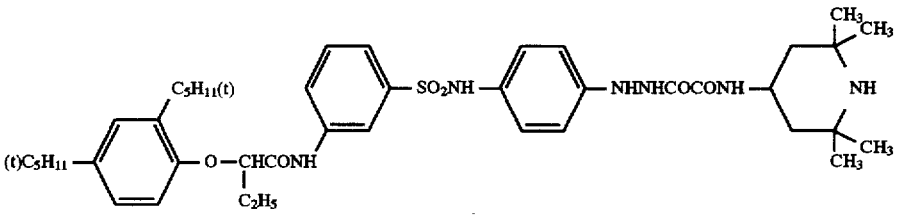

-continued

H-9

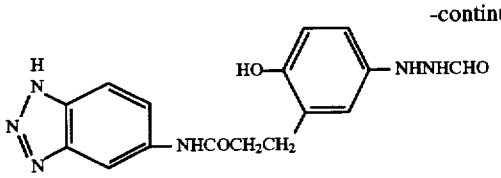

H-10

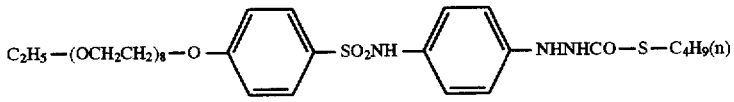

H-11

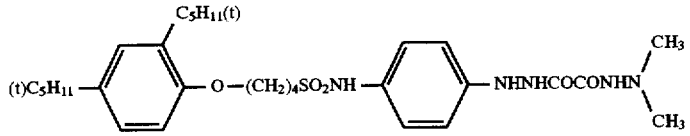

H-12

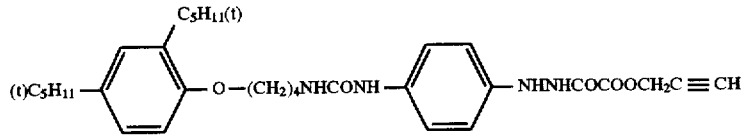

H-13

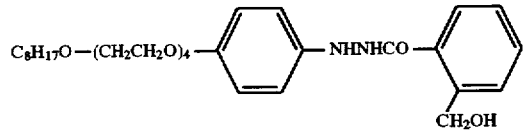

H-14

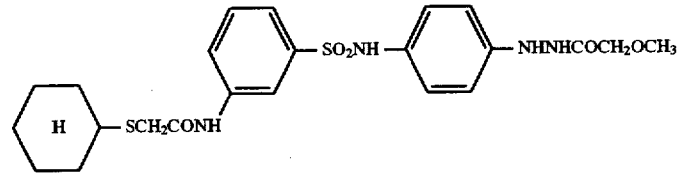

H-15

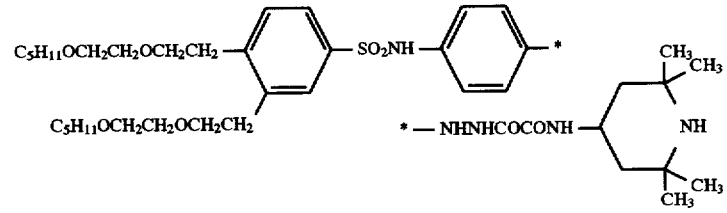

H-16

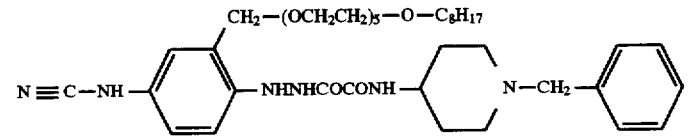

As exemplary examples of preferable hydrazine compounds other than the foregoing are cited compounds represented by (1)–(252) described in 4th–60th columns of U.S. Pat. No. 5,229,248.

The hydrazine compound related to the invention can be synthesized through a known method such as that described in 59th–80th columns of U.S. Pat. No. 5,229,248.

The silver halide photographic material according to the present invention comprises a support provided on one side thereof photographic component layers including at least one nonlight-sensitive hydrophilic colloidal layer and at least two silver halide emulsion layers, in which a first silver halide emulsion layer is provided closer to the support than a second silver halide emulsion layer. The hydrazine compound can be contained in any layer of the photographic component layers provided on the emulsion side of the photographic material, and the hydrazine compound is contained in at least two photographic component layers of the photographic material and preferably, in one or more silver halide emulsion layers and/or a hydrophilic colloidal layer adjacent to the silver halide emulsion layer.

With regard to the content of the hydrazine compound, an optimum amount varies depending on the silver halide grain size, halide composition, level of chemical sensitization and kind of an inhibiting agent. In cases where the hydrazine compound is contained in a silver halide emulsion layer, an amount ranging from $10^{-6}$ to $10^{-1}$ mol per mol of silver halide is generally preferable, and a range of $10^{-5}$–$10^{-2}$ mol is especially preferable. In cases where the hydrazine compound is contained in a nonlight-sensitive hydrophilic colloidal layer, it is contained preferably in an amount of $10^{-6}$ to $10^{-1}$, more preferably, $10^{-5}$ to $10^{-2}$ mol per mol of silver halide contained in a silver halide emulsion layer which is provided closest to the nonlight-sensitive hydrophilic collidal layer. According to the invention, a molar ratio of the total amount of the hydrazine compound contained in the first silver halide emulsion layer and/or hydrophilic colloidal layer(s) closer to the support than the first emulsion layer to that contained in the second silver halide emulsion layer and/or hydrophilic colloidal layer(s) farther from the support than the first emulsion layer is 0.2–0.8, preferably, 0.4 to 0.6.

Hydrazine compound used in the invention can be used either individually or in combination in terms of kind.

For the purpose of accelerating the high contrast by means of hydrazine compound effectively, it is preferable to use a nucleation accelerating agent represented by the following Formula [Na] or [Nb].

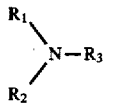

Formula [Na]

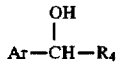

Formula [Nb]

In Formula [Na], $R_1$, $R_2$ and $R_3$ represent a hydrogen atom, an alkyl group, a substituted alkyl group, an alkenyl group, a substituted alkenyl group, an alkinyl group, an aryl group and a substituted aryl group. $R_1$, $R_2$ and $R_3$ may form a ring. Especially preferable one is an aliphatic tertiary amine compound. The compound having a nondiffusing group or an adsorption group onto silver halide in a molecule are preferable. In order to have a nondiffusing property, a compound having molecular weight of not less than 100 is preferable, and one having molecular weight of not less than 300 is more preferable. As a preferable adsorption-promoting group, there are given a heterocyclic ring, a mercapto group, a thioether group, a thion group and a thiourea group. An especially preferable one as Formula [Na] is a compound having at least one thioether group in a molecule as a adsorption-promoting group onto silver halide.

Exemplary examples of these nucleation accelerating agent [Na] will be given as follows.

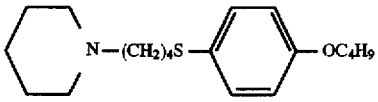

Na-1

$[(C_3H_7)_2N(CH_2)_3OCH_2CH_2]_2S$ Na-2

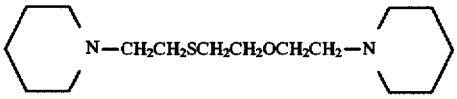

Na-3

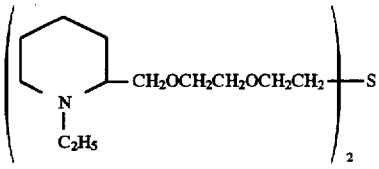

Na-4

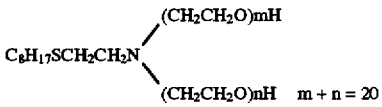

Na-5

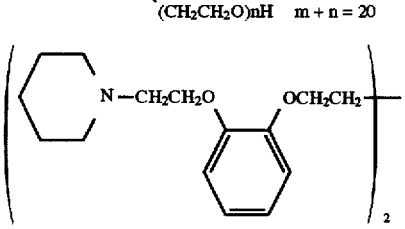

Na-6

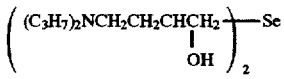

Na-7

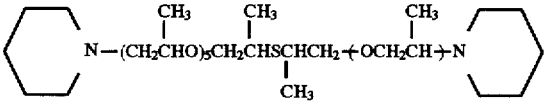

Na-8

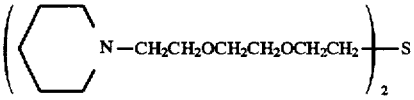

Na-9

-continued

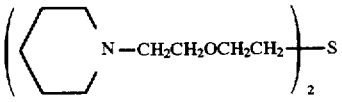

Na-10

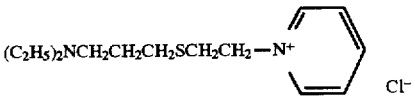

Na-11

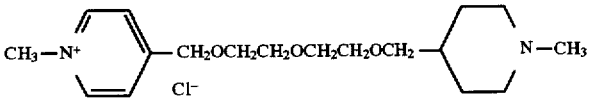

Na-12

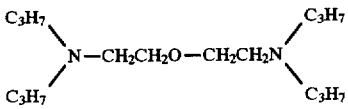

Na-13

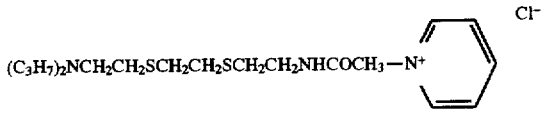

Na-14

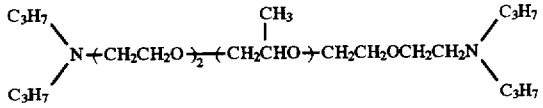

Na-15

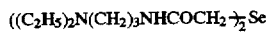

Na-16

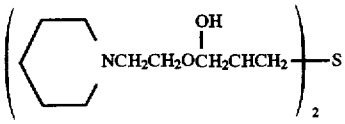

Na-17

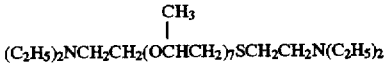

Na-18

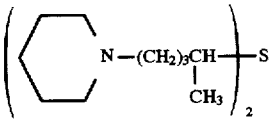

Na-19

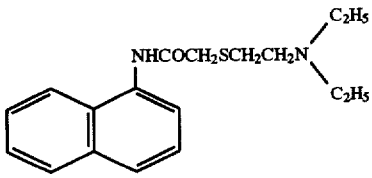

Na-20

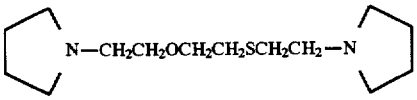

Na-21

In Formula [Nb], Ar represents a substituted or unsubstituted aromatic group or heterocyclic group. $R_4$ represents a hydrogen atom, an alkyl group, an alkinyl group or an aryl group, and Ar and $R_4$ may be coupled with a coupling group to form a ring. These compounds are preferable when they contain a nondiffusing group or a silver halide adsorption group in a molecule. A preferable molecular weight to cause a preferable nondiffusing property to the contained is 120 or more, and 300 or more is especially preferable.

Exemplary compounds represented by Formula [Nb] are shown below.

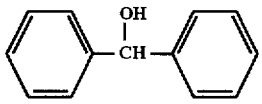

Nb-1

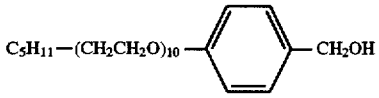

Nb-2

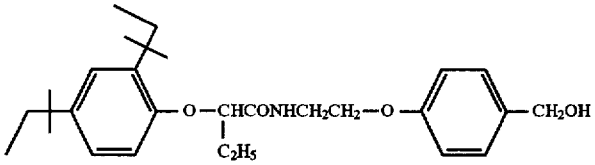

Nb-3

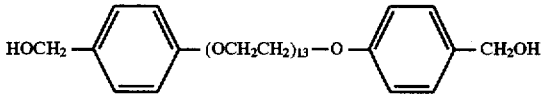

Nb-4

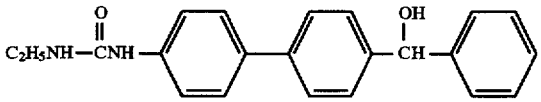

Nb-5

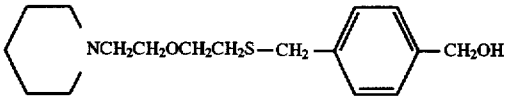

Nb-6

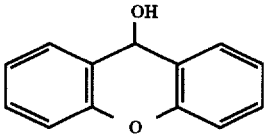

Nb-7

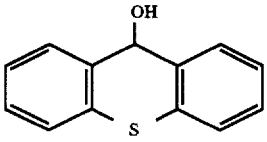

Nb-8

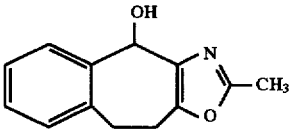

Nb-9

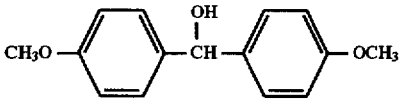

Nb-10

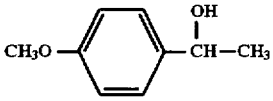

Nb-11

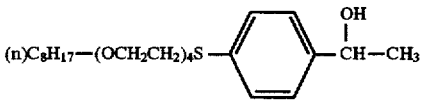

Nb-12

Exemplary examples of other preferable nucleation accelerating compound are those of (2-1)–(2-20) described in page 13–15 of Japanese Patent O.P.I. Publication No. 258751/1994, and those of (3-1)–(3-6) described in page 15–16 of Japanese Patent O.P.I. Publication No. 258751/1994.

A nucleation accelerating agent used in the invention can be used for any layer provided that the layer is a photographic component layer provided on the silver halide emulsion layer side, and it is preferable to use it for a silver halide emulsion layer or for a layer adjoining the silver halide emulsion layer. With regard to an added amount, though an optimum amount varies depending on a grain size of a silver halide grain, halogen composition, a degree of chemical sensitization and a kind of an inhibiting agent, an amount ranging from $10^{-6}$ to $10^{-1}$ mol per mol of silver halide is generally preferable, and a range of $10^{-5}$ to $10^{-2}$ mol is especially preferable.

Dye in the form of a solid particle dispersion usable in the invention will be explained. A preferable dye is represented by the following Formulas (1)–(6).

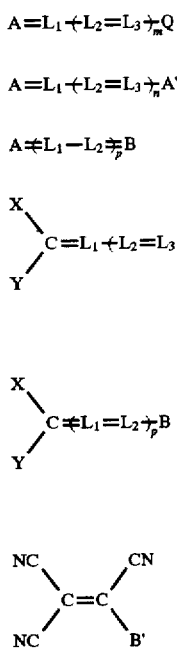

Formula (1)

Formula (2)

Formula (3)

Formula (4)

Formula (5)

Formula (6)

In the formulas, A and A' may be either the same with or different from each other, and each of them represents an acidic nucleus, Q represents an aryl group or a heterocyclic group, B represents a basic nucleus, B' represents a heterocyclic group, X and Y may be either the same with or different from each other and each of them represents an electron attractive group, and each of $L_1$, $L_2$ and $L_3$ represents a methine group. The symbol m represents 0 or 1, and n represents 0, 1 or 2. However, each of dyes represented by Formulas (1)–(6) contains in a molecule at least one group selected from the group of a carboxy group, a sulfonamide group and a sulfamoyl group.

As an aryl group represented by Q in the above-mentioned Formulas (1)–(4), there may be given a phenyl group and a naphthyl group or the like, for example. As a heterocyclic group represented by Q, there may be given pyridine, quinoline, isoquinoline, pyrole, pyrazole, imidazole and indole residues.

Aforesaid aryl group and heterocyclic group include those having substituents which are represented by, for example, an alkyl group, a cycloalkyl group, an aryl group, a halogen atom, an alkoxycarbonyl group, an aryloxycarbonyl group, a carboxy group, a cyano group, a hydroxy group, a mercapto group, an amino group, an alkoxy group, an aryloxy group, an acyl group, a carbamoyl group, an acylamino group, an ureido group, a sulfamoyl group and a sulfonamide group, and two or more kinds of these substituents may be combined. Preferable one include an alkyl group having 1–6 carbon atoms (e.g., a methyl group, an ethyl group, a butyl group, a 2-hydroxyethyl group, etc.), a hydroxyl group, a halogen atom (e.g., a fluorine atom, a chlorine atom, etc.), an alkoxy group (e.g., a methoxy group, an ethoxy group, a methylenedioxy group, a 2-hydroxyethoxy group, an n-buthoxy group, etc.), a substituted amino group (e.g., a dimethylamino group, a diethylamino group, a di(n-butyl) amino group, an N-ethyl-N-hydroxyethylamino group, an N-ethyl-N-methanesulfonamido-ethylamino group, a morpholino group, a piperidino group, pyrolidino group, etc.), a carboxy group, a sulfonamido group (e.g., a methanesulfonamido group, a benzensulfonamido group, etc.), a sulfamoyl group (e.g., a sulfamoyl group, a methylsulfamoyl group, a phenylsulfamoyl group, etc.), and these substituents may be combined.

Electron-attractive groups represented by X and Y in Formulas (4) and (5) may be either the same with or different from each other, and groups having the σp value of substituent constant Hammett (described on pages 96–103 of Fujita, Kagakuno Ryoiki, Supplement No. 122 (1979) "Structural Activity Relations of Chemicals") of not less than 0.3 are preferable. For example, the preferable groups include a cyano group, an alkoxycarbonyl group (e.g., a methoxy-carboxyl group, an ethoxycarbonyl group, a butoxycarbonyl group, an octyloxycarbonyl group, etc.), an aryloxycarbonyl group (e.g., a phenoxycarbonyl group, a 4-hydroxyphenoxycarbonyl group), a carbamoyl group (e.g., a carbamoyl group, a dimethylcarbamoyl group, a phenylcarbamoyl group, a 4-carboxyphenylcarbamoyl group, etc.), an acyl group (e.g., a methylcarbonyl group, an ethylcarbonyl group, a butylcarbonyl group, a phenylcarbonyl group, a 4-ethylsulfonamidocarbonyl group, etc.), an alkylsulfonyl group (e.g., a methylsulfonyl group, an octylsulfonyl group, etc.), and an arylsulfonyl group (e.g., a phenylsulfonyl group, a 4-chlorosulfonyl group, etc.).

Basic nucleuses represented by B in Formulas (3) and (5) preferably include pyridine, quinolin, oxazole, benzoxazole, naphthoxazole, thiazole, benzthiazole, naphthothiazole, indolenin, pyrole and indole.

Heterocyclic rings represented by B' in Formula (6) include, for example, pyridine, pyridazine, quinolin, pyrole, pyrazole, imidazole and indole.

Methine groups represented by $L_1$, $L_2$ and $L_3$ in Formulas (1)–(5) include those having a substituent, and the substituent includes, for example, an alkyl group having 1–6 carbon atoms (e.g., methyl, ethyl, propyl, isobutyl, etc.), an aryl group (e.g., phenyl, p-tolyl, p-chlorophenyl, etc.), an alkoxy group having 1–4 carbon atoms (e.g., a methoxy group, an ethoxy group, etc.), an aryloxy group (e.g., a phenyl group, etc.), an aralkyl group (e.g., a benzyl group, a phenetil group, etc.), a heterocyclic group (e.g., pyridyl, furyl, thienyl, etc.), a substituted amino group (e.g., dimethylamino, tetramethylene-amino, anilino, etc.), and an alkylthio group (e.g., a metylthio group, etc.).

In the invention, among the dyes represented by Formulas (1)–(6), those having at least one carboxyl group in a molecule are preferably used, and dyes represented by Formula (1) are more preferable, in which the dyes represented by Formula (1) wherein Q is a furyl group are especially preferable.

Exemplary examples of dyes used in the invention will be shown below.

1-1
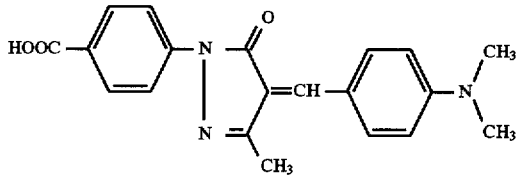
1-2
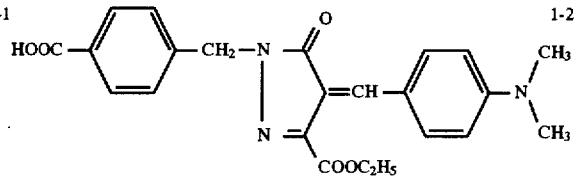
1-3
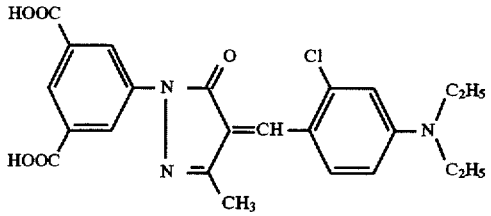
1-4
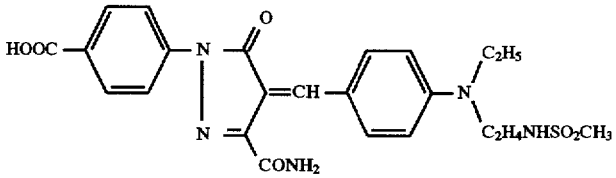
1-5
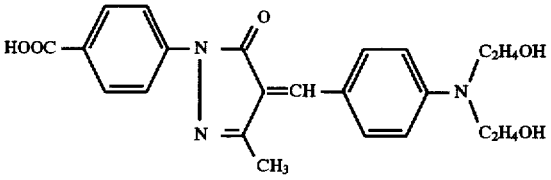
1-6
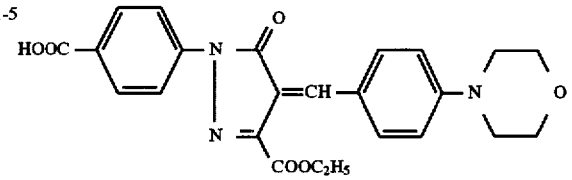
1-7
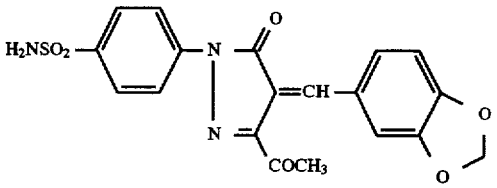
1-8
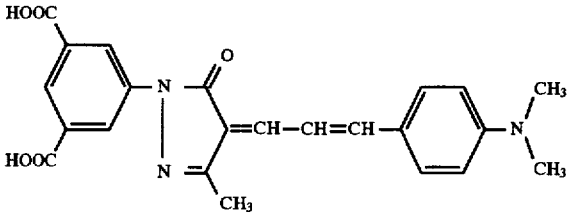
1-9
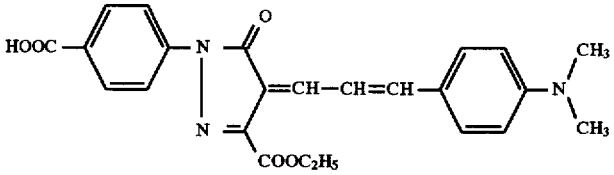
1-10
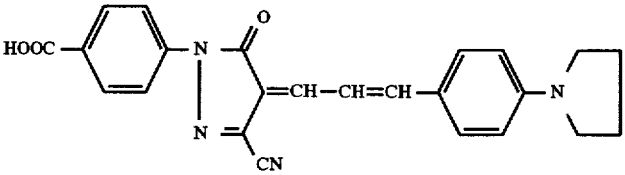
1-11
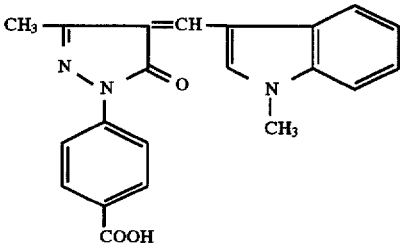
1-12
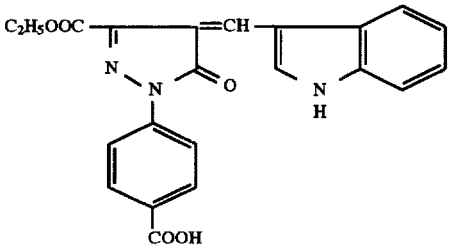

-continued
1-13
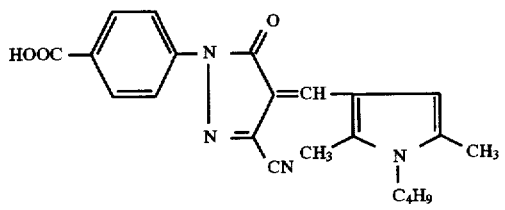
1-14
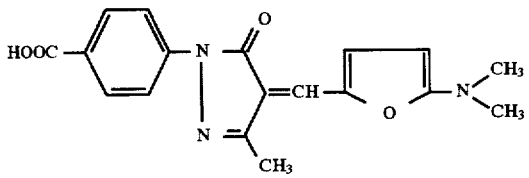
1-15
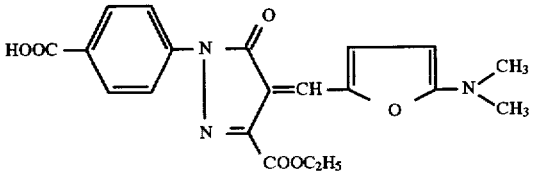
1-16
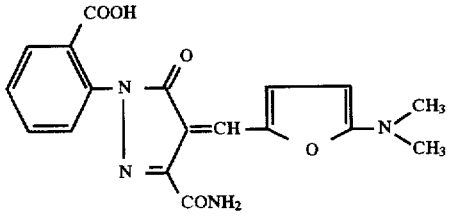
1-17
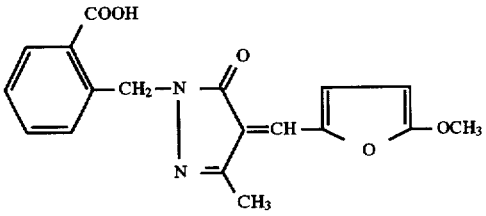
1-18
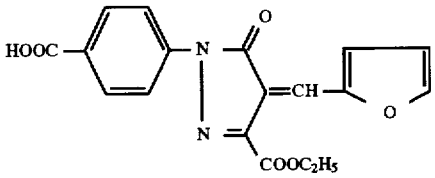
1-19
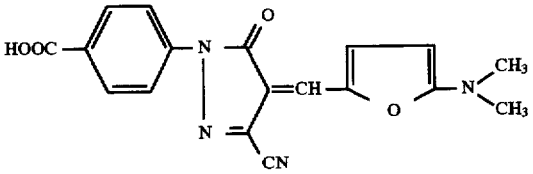
1-20
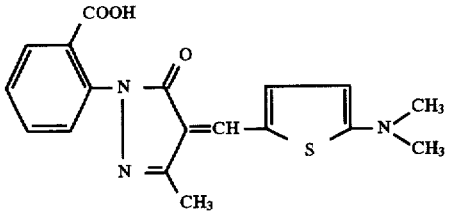
1-21
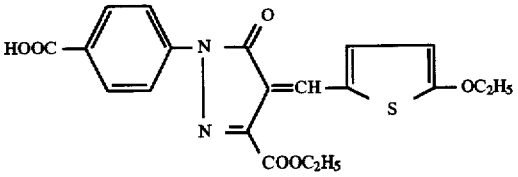
1-22
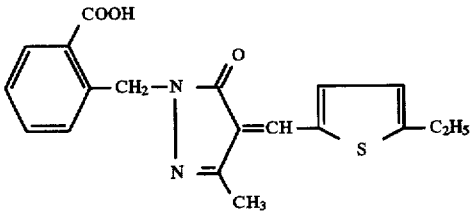
1-23
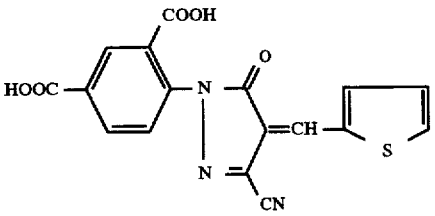
1-24
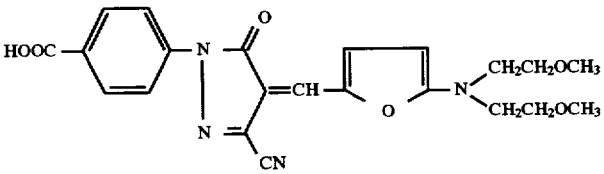

-continued
1-25
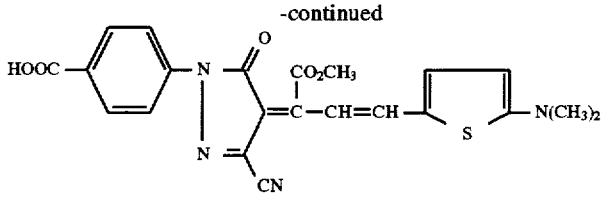
1-26
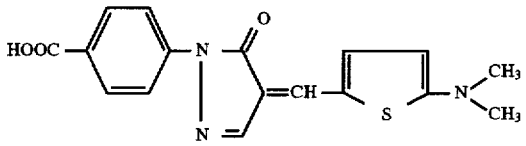
2-1
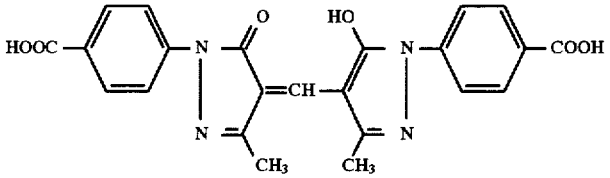
2-2
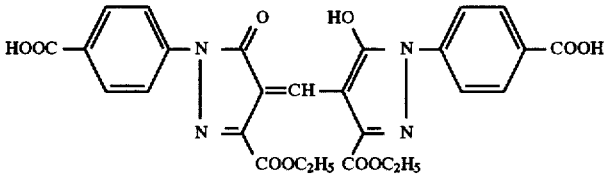
2-3
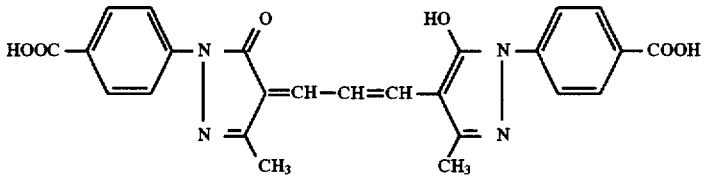
2-4
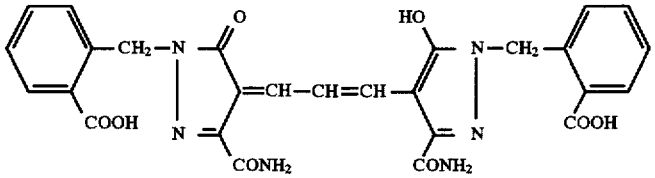
2-5
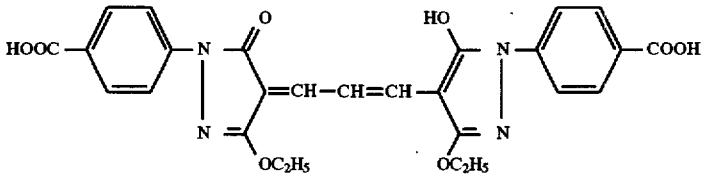
3-1
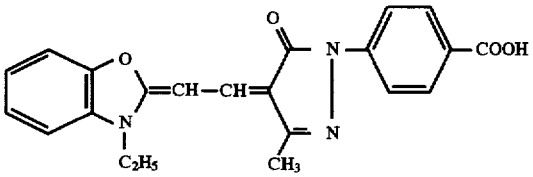
3-2
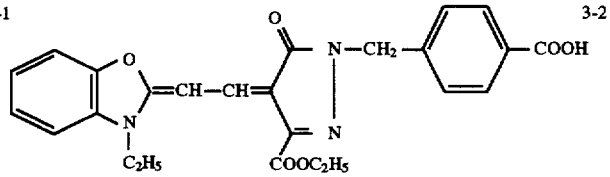
3-3
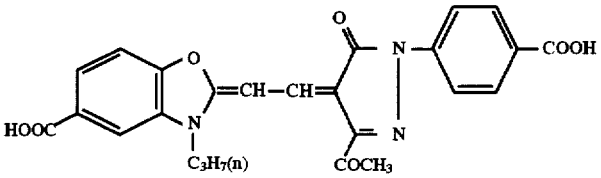

-continued
3-4
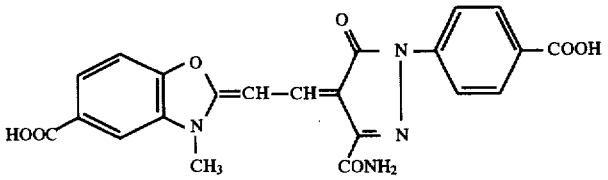
3-5
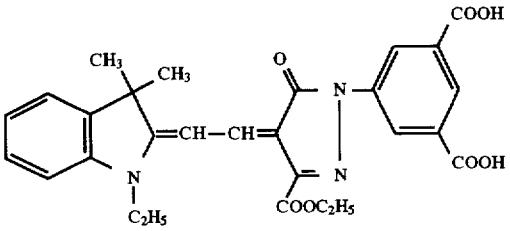
4-1
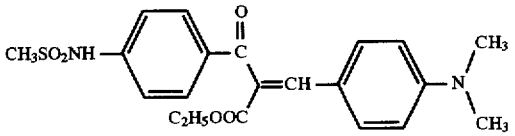
4-2
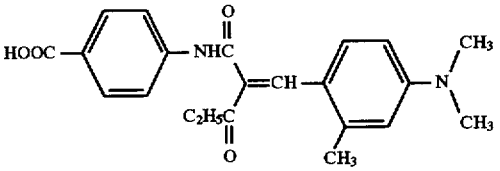
4-3
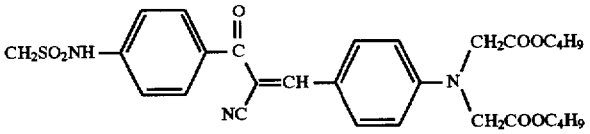
4-4
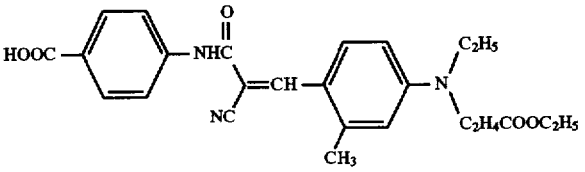
4-5
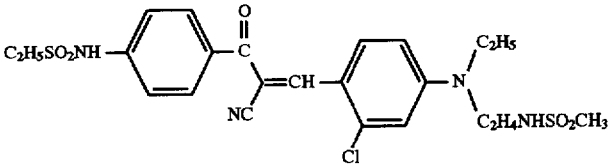
5-1
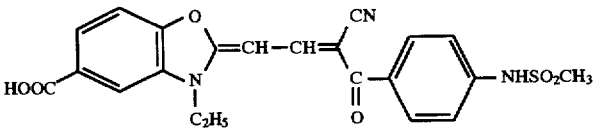
5-2
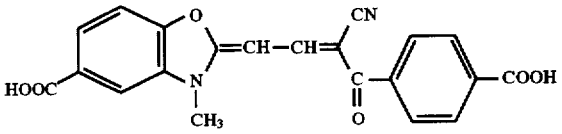
5-3
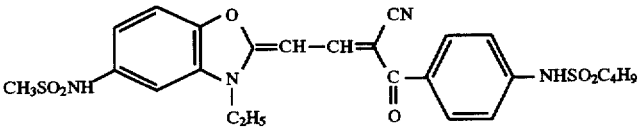

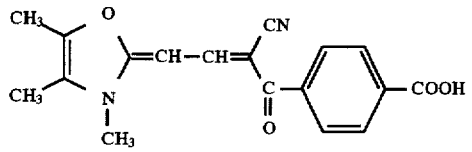

-continued 5-4

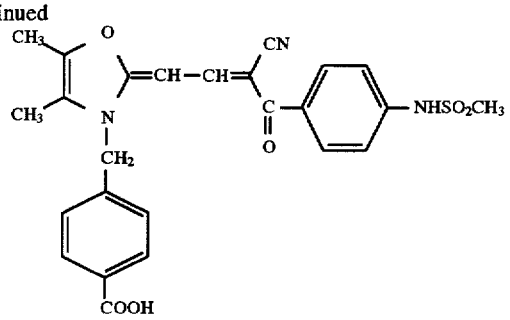

5-5

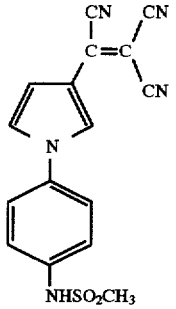

6-1

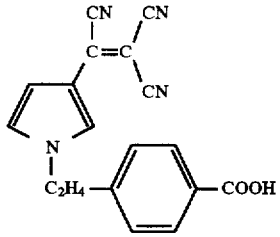

6-2

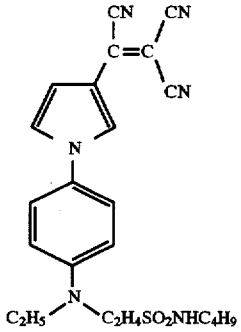

6-3

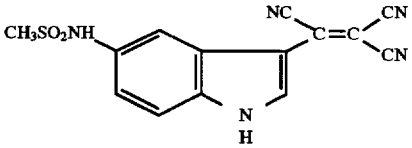

6-4

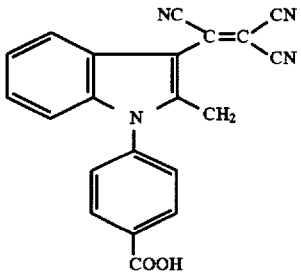

6-5

Other preferable examples of the compounds represented by Formulas (1)–(6) are, for example, those represented by Formulas [I]–[V], Formulas [I']–[V'] and Formula [VI] described on pages 4–28 of Japanese Patent O.P.I. Publication No. 181230/1993. As the compounds which are more concrete, there are given I-1–37, II-1–5, III-1–7, IV-1–6, V-1–5, I'-1–12, II'-1–9, III'-1–9, IV'-1–9, V'-1–6 and VI-1–52 described on pages 6–46 of the specification.

As a method for manufacturing solid fine particle dispersion of a dye related to the invention, it is possible to use the methods described in Japanese Patent O.P.I. Publication Nos. 92716/1977, 155350/1980, 155351/1980, 197943/1988 and 182743/1991 and International Patent WO88/04794. Concretely, it is possible to manufacture by the use of a fine dispersing machine such as a ball mill, a planetary mill, a vibration mill, a sand mill, a roller mill, a jet mill and a disc-impeller mill. When a compound to be subjected to solid fine particle dispersion is water-insoluble at a relatively low pH and is water-soluble at a relatively high pH, it is possible to obtain the dispersion of the compound through the method wherein the compound is dissolved in an alkaline aqueous solution, then pH is lowered to make the solution to be weakly acidic, and thereby solid fine particles are precipitated, or the method wherein a weakly alkaline solution of the compound and an acidic aqueous solution are mixed simultaneously while adjusting pH and thereby solid fine particles are prepared. Solid fine particle dispersion of the invention can be used either singly or in combination of two kinds or more, and they can further be used together with solid fine particle dispersion other than that of the invention. When using in combination of two kinds or more, they can be mixed after being dispersed independently, or they may be dispersed simultaneously.

When manufacturing solid fine particle dispersion used in the invention in the presence of aqueous dispersion medium, it is preferable to made a surfactant present in the course of dispersion or after the dispersion. Such surfactant to be used includes an anionic surfactant, a nonionic surfactant, a cationic surfactant and an amphoteric surfactant, and preferable ones are anionic surfactants such as, for example, alkyl sulfonate, alkylbenzenesulfonate, alkylnaphthalenesulfonate, alkyl sulfonates, sulfosuccinate, sulfoalkylpolyoxyethylenealkylphenyl ethers, and N-acyl-N-alkyltaurine, and nonionic surfactant such as, for example, saponin, alkylene oxide derivative and alkylester of sugar. Aforesaid anionic surfactants are especially preferable. Exemplary examples of the surfactant are represented, for example, by 1–32 compounds described on pages 46–32 of Japanese Patent O.P.I. Publication No. 277011/1993 to which the invention is not limited.

An amount of anionic surfactants and/or nonionic surfactants varies depending on a kind of surfactant or on dispersion conditions of aforesaid dyes, but 0.1 mg–2000 mg per 1 g of dye is normally preferable, 0.5 mg–1000 mg is more preferable, and 1 mg–500 mg is especially preferable.

As concentration used in a dye dispersion, it is preferable to be used so that 0.01–50% by weight may be attained, and 0.1–30% by weight is more preferable. With regard to timing for adding surfactants, it is good to add them before the start of dispersion of dyes, and they can also be added to a dye-dispersed solution after completion of dispersion of the dyes, when it is necessary. These anionic surfactants and/or nonionic surfactants can be used either independently or in combination of two or more kinds, and further, both surfactants may be combined.

With regard to solid fine particle dispersion used in the invention, it is preferable that they are dispersed so that an average particle size of 0.01 μm–5 μm may be attained, and an average particle size of 0.01 μm–1 μm is more preferable and that of 0.01 μm–0.5 μm is especially preferable. With regard to a coefficient of variation of particle size distribution, 50% or less is preferable and 40% is more preferable, and solid fine particle dispersed products whose coefficient of variation is 30% are especially preferable. In this case, the coefficient of variation of particle size distribution is a value represented by the following expression.

(Standard deviation)/(Average particle size)×100

It is possible to add hydrophilic colloid used as a binder for a photographic component layer to solid fine particle dispersed products used in the invention, before the start of dispersion or after completion of dispersion. As the hydrophilic colloid, it is advantageous to use gelatin. In addition to this, however, it is possible to use gelatin derivatives such as phenylcarbamated acylated gelatin or phthalated gelatin, cellulose derivatives such as graft polymer with monomer having an ethylene group capable of being polymerized with gelatin, carboxymethylcellulose, hydroxymethylcellulose and cellulose phosphate, synthesized hydrophilic polymer such as polyvinyl alcohol, partially oxidized polyvinyl acetate, polyacrylicamide, poly-N,N-dimethylacrylicamide, poly-N-vinylpyrrolidone and polymethacrylic acid, agar, acacia, alginic acid, albumin and casein. These can be used in combination of two or more kinds. As an amount of hydrophilic colloid added to solid fine particle dispersed products, it is preferable to add so that a percentage by weight of 0.1%–12% may be attained, and 0.5%–8% is more preferable.

A solid fine particle dispersion used in the invention can be used for any layer provided that the layer is a photographic component layer provided on the silver halide emulsion layer side. Preferably, it is used for a silver halide emulsion layer closest to the support and/or a non-light-sensitive hydrophilic colloidal layer adjoining the support side of the silver halide emulsion layer mentioned above.

Though a preferable amount of a dye in the form of a solid fine particle dispersion to be used varies depending on a kind of a dye and characteristics of a photographic light-sensitive material, an amount of 1 mg–1 g per 1 $m^2$ of a photographic light-sensitive material is preferable and that of 5 mg–800 mg is more preferable, and that of 10 mg–500 mg is especially preferable.

In the invention, a photographic component layer containing dyes dispersed in the form of a solid particle dispersion is provided on the silver halide emulsion layer side. However, other layers, namely, any photographic component layer provided on the side opposite to the emulsion layer on the support can contain the dyes dispersed in the state of solid. Further, any layer can contain water-soluble dyes.

In the invention, dyes having other absorption wavelengths can be used for any layer. It is most effective that a light-sensitive material of the invention is used as a light-sensitive material for output, and typical light sources are Ar laser, He—Ne laser, red laser diode, infraved semiconductor laser and red LED laser. In addition to them, it is possible to use any laser such as blue laser of He—Cd laser. An effect of the invention is not only for an output light-sensitive material for laser use but also for applications of light-sensitive materials for photographing and contact films.

A redox compound related to the invention, which is capable of releasing a development inhibitor agent upon oxidation (DIR compound) will be explained as follows.

The redox compound has a redox group. As examples of the redox group are cited hydroquinone, catechol, naphthohydroquinone, aminophenol, pyrazolidone, hydrazine or reductone.

As a preferred redox compound is cited a compound having a —NHNH— group as a redox group or a compound represented by the following Formula [II].

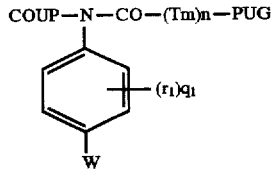

Formula [II]

The compound having a —NHNH— group as a redox group is represented by the following Formula [RE-a] or [RE-b].

T-NHNHCOV-(Tm)-PUG Formula [RE-a]

T-NHNHCOCOV-(Tm)-PUG Formula [RE-b]

In Formulas [RE-a] and [RE-b], T and V represent respectively an aryl group which may be substituted or an alkyl group which may be substituted. Tm and PUG represent groups which are defined identically to Tm and PUG in Formula [II] stated later.

Aryl groups represented by T and V include, for example, a benzen ring and a naphthalene ring, and these rings may be substituted with various substituents. Preferable substituents include a straight chain or branched alkyl group (preferably, a group having 2–20 carbon atoms such as, for example, methyl, ethyl, isopropyl group dodecyl group, etc.), an alkoxy group (preferably, a group having 2–21 carbon atoms such as, for example, methoxy group, ethoxy group, etc.), an aliphatic acylamino group (preferably, a group having 2–21 carbon atoms such as, for example, acetylamino group, heptyl-amino group, etc.), and an aromatic acylamino group. In addition to the foregoing, substituted or unsubstituted aromatic rings which are the same as those mentioned above and are coupled with a coupling group such as —CONH—, —O—, —$SO_2$NH—, —NHCONH— or —$CH_2$CHN— are also included. As a photographic usefulness group, there are given 5-nitroindazole, 4-nitroindazole, 1-phenyltetrazole, 1-(3-sulfophenyl)tetrazole, 5-nitrobenztriazole, 4-nitrobenztriazole, 5-nitroimidazole, and 4-nitroimidazole. These development inhibiting compounds can be connected through a hetero atom such as N or S at a CO part of T—NHNH—CO— directly or through alkylene, phenylene, aralkylene or aryl group and further through a hetero atom such as N or S. In addition, it is also possible to use a hydroquinone compound with a ballast group to which a development inhibiting agent such as triazole, indazole, imidazole, thiazole or thiadiazole is introduced. For example, 2-(dodecylethyleneoxidethiopropionamide)-5-(5-nitroindazole-2-il)hydroquinone, 2-(stearylamido)-5-(1-phenyltetrazole-5-thio)hydroquinone, 2-(2,4-di-t-amylphenoxypropionamide)-5-(5-nitrotriazole-2-il) hydroquinone, and 2-dodecylthio-5-(2-mercaptothiothiadiazole-5-thio)hydroquinone are given. Redox compounds can be synthesized, referring to the description in U.S. Pat. No. 4,269,929. The redox compound can be contained in an emulsion layer, or in a hydrophilic colloidal layer adjoining an emulsion layer, or further in a hydrophilic colloidal layer through an intermediate layer.

The redox compound can be added after they are dissolved in alcohols such as methanol or ethanol, or in glycols such as ethylene glycol, triethylene glycol and propylene glycol, or in esters such as ether, dimethylformamide, dimethylsulfoxide, tetrahydrofuran and ethyl acetate, or in ketones such as acetone and methyl ethyl ketone. In the case of the redox compound which is hardly dissolved in water or in an organic solvent, they can be dispersed through high speed impeller dispersion, sand mill dispersion, ultrasonic dispersion or ball mill dispersion to any level in terms of an average particle size within a range from 0.01 μm to 6 μm. For the dispersion, it is possible to add a surfactant such as anion or nonion, thickening agent or latex. In cases where the redox compound is added to the emulsion layer, a preferable amount of the redox compound to be added is $10^{-6}$ mol–$10^{-1}$ mol per mol of silver halide, and a range of $10^{-4}$ mol–$10^{-2}$ mol is more preferable. In cases where the redox compound is added to the nonlight-sensitive hydrophilic colloidal layer, the amount is preferably $10^{-6}$ to $10^{-1}$, more preferably, $10^{-5}$ to $10^{-2}$ mol per mol of silver halide contained in an emulsion layer provided closest to the nonlight-sensitive hydrophilic colloidal layer.

Among compounds represented by Formula [RE-a] or [RE-b], the compounds which are especial preferable are shown below.

RE-1

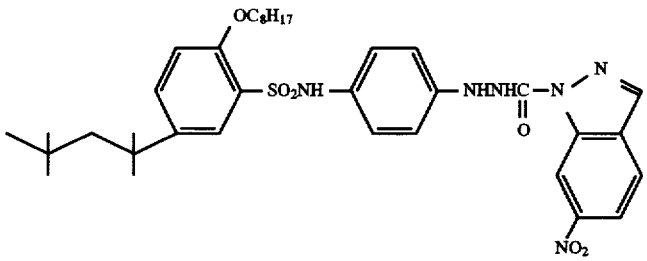

RE-2

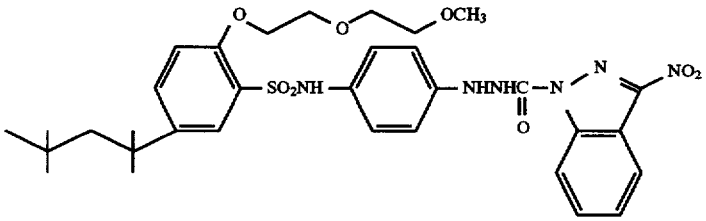

RE-3

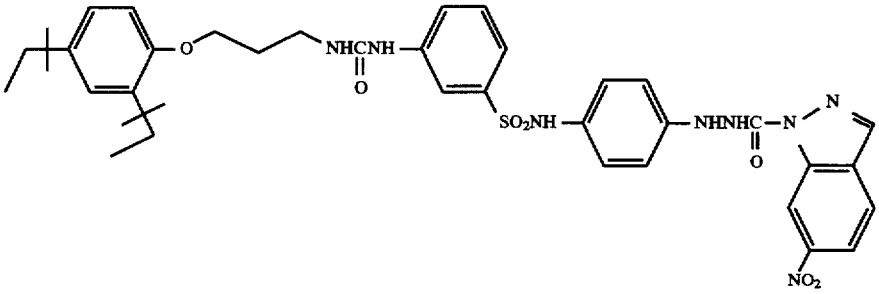

-continued
RE-4
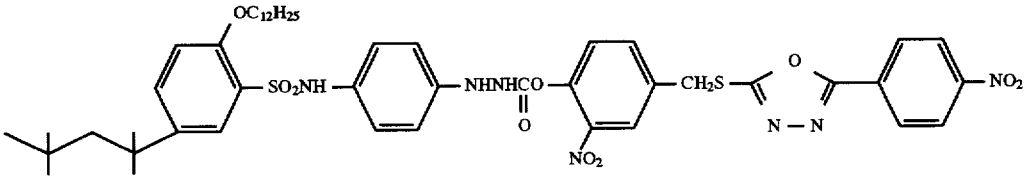
RE-5
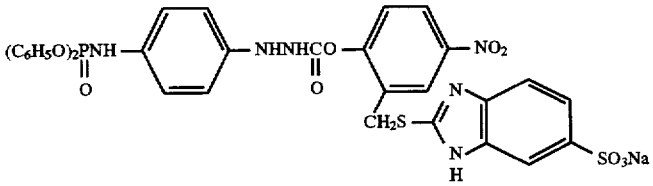
RE-6
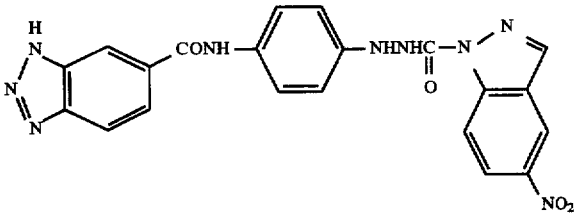
RE-7
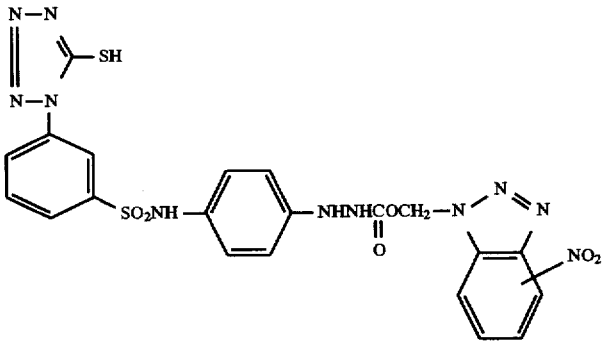
RE-8
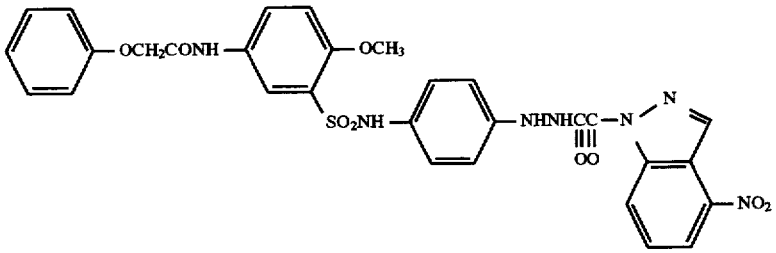
RE-9
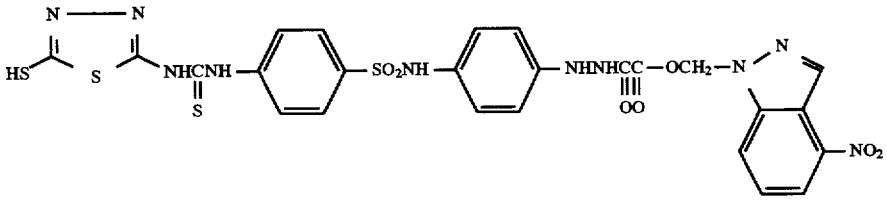
RE-10
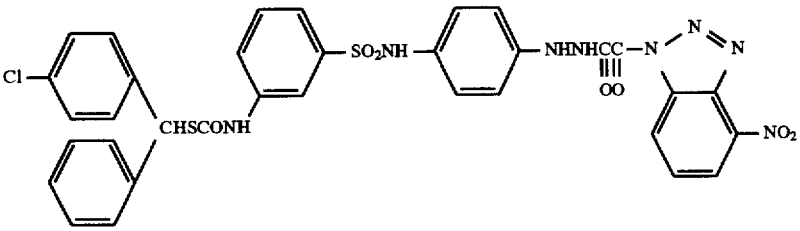

Concrete examples of other preferable redox compounds are represented by R-1–R-50 described in page 236(8)–page 250(22) of Japanese Patent O.P.I. Publication No. 245243/1992.

Redox compounds represented by aforesaid Formula [II] will be explained, next. In Formula [II], COUP represents a coupler residue capable of coupling-reaction with an oxidized product of an aromatic primary amine developing agent. Tm represents a timing group, and n represents 0 or 1. PUG represents a development inhibiting agent. W represents $N(R_{10})R_{11}$ or OH, $R_{10}$ and $R_{11}$ represent a hydrogen atom, an alkyl group, an aryl group or a heterocyclic group, $r_1$ represents a substituent which can be substituted to a benzene ring, and $q_1$ represents integers of 0–4.

In Formula [II], a coupler residue represented by COUP includes the following. A cyan coupler residue includes a phenol coupler and a naphthol coupler. A magenta coupler includes a 5-pyrazolone coupler, a pyrazolone coupler, a cyanoacetyl cumarone coupler, a closed-chain acylacetonitryl coupler and an indazolone. A yellow coupler residue includes a benzoyl-acetoanilide coupler, a pivaloylacetoanilide coupler, and a malondianilide coupler. A colorless coupler residue includes an open-chain or cyclic active methylene compound (e.g., indanone, cyclopentanone, malonic acid diester, imidazolinone, oxazolinone, thiazolinone, etc.). Further, those used preferably in the invention among coupler residues represented by Coup can be represented by Formula (Coup-1)–Formula (Coup-8).

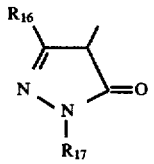

Formula (Coup-1)

In the formula, $R_{16}$ represents an acylamide group, an anilino group or an ureido group, and $R_{17}$ represents one or more halogen atoms, an alkyl group, an alkoxy group or a phenyl group which may be substituted with a cyano group.

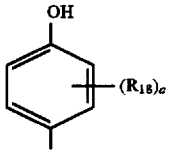

Formula (Coup-2)

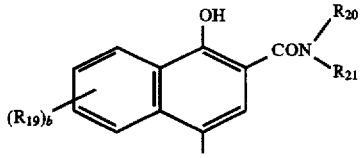

Formula (Coup-3)

In the formulas, $R_{18}$ and $R_9$ represent a halogen atom, an acylamide group, an alkoxycarbonylamide group, a sulfoureido group, an alkoxy group, an alkylthio group, a hydroxy group or an aliphatic group, and each of $R_{20}$ and $R_{21}$ represents an aliphatic group, an aromatic group or a heterocyclic group. Either one of $R_{20}$ and $R_{21}$ may be a hydrogen atom. The symbol a represents integers of 1–4, and b represents integers of 0–5. When each of a and b is plural, $R_{18}$ may be either the same or different, and $R_{19}$ may be either the same or different.

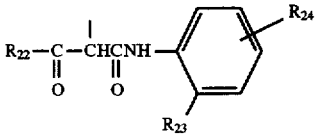

Formula (Coup-4)

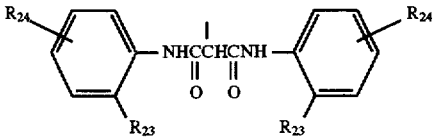

Formula (Coup-5)

In the formulas, $R_{22}$ represents a tertiary alkyl group or an aromatic group, and $R_{23}$ represents a hydrogen atom, a halogen atom or an alkoxy group. $R_{24}$ represents an acylamide group, an aliphatic group, an alkoxycarbonyl group, a sulfamoyl group, a carbamoyl group, an alkoxy group, a halogen atom or a sulfonamide group.

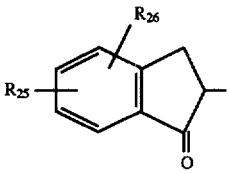

Formula (Coup-6)

In the formula, $R_{25}$ represents an aliphatic group, an alkoxy group, an acylamino group, a sulfonamide group, a sulfamoyl group or a diacylamino group, and $R_{26}$ represents a hydrogen atom, a halogen atom or a nitro group.

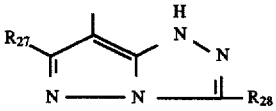

Formula (Coup-7)

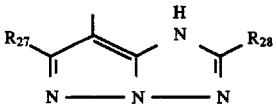

Formula (Coup-8)

$R_{27}$ and $R_{28}$ represent a hydrogen atom, an aliphatic group, an aromatic group or a heterocyclic group.

Preferable timing groups represented by Tm include —$OCH_2$— or other divalent timing groups whose examples are those described in U.S. Pat. Nos. 4,248,962, 4,409,323 and 3,674,478, Research Disclosure 21228 (December issue in 1981), or in Japanese Patent O.P.I. Publication No. 56837/1982 and 438/1992.

A development inhibiting agent preferable as PUG includes those described in U.S. Pat. No. 4,477,563 and Japanese Patent O.P.I. Publication Nos. 218644/1985, 221750/1985, 233650/1985 and 11743/1986.

Concrete examples of compounds represented by Formula [II] which are used in the invention will be show below, but the invention is not limited to them.

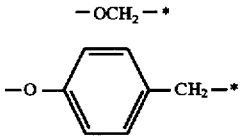

Tm-1

Tm-2

-continued
Tm-3
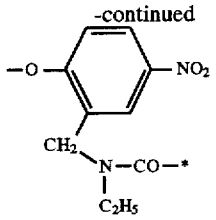
Tm-4
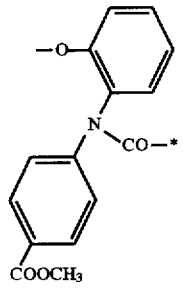
Tm-5
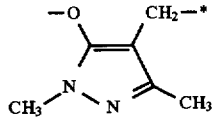
Tm-6
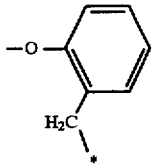
Tm-7
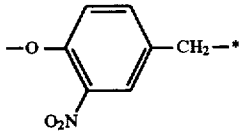
Tm-8
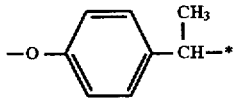
Tm-9
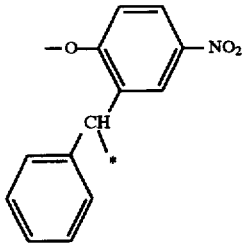
Tm-10
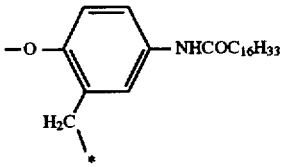
Tm-11
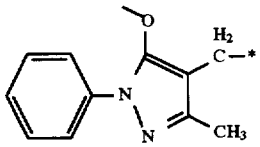
-continued
Tm-12
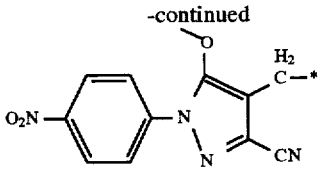
Tm-13
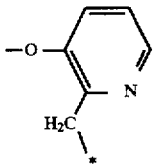
Tm-14
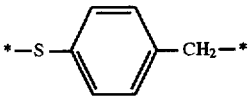
Tm-15
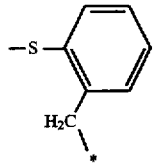
Tm-16
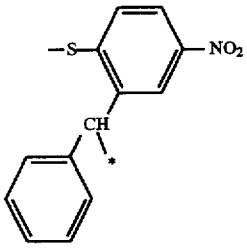
Tm-17
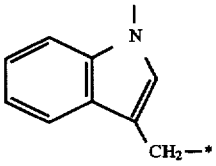
Tm-18
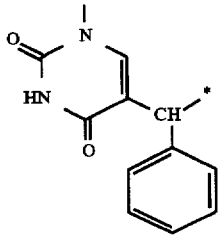
Tm-19
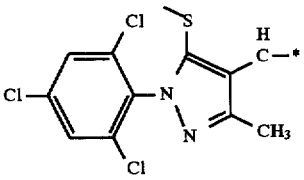
Tm-20
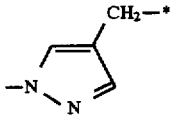
n = O
Tm-21

-continued
— Coup-linking position
*— PUG-linking position
1
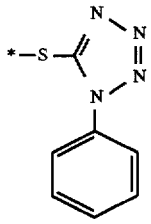
2
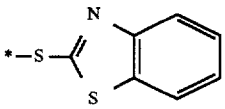
3
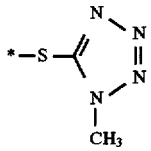
4
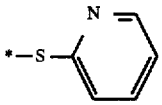
5
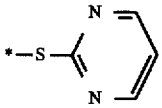
6
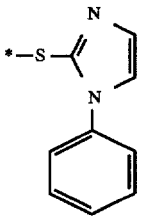
7
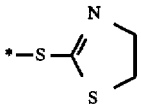
8
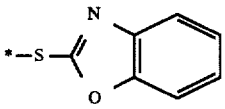
9
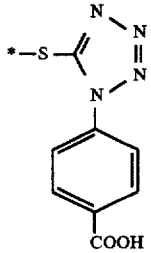
10
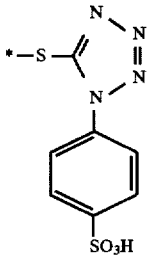
11
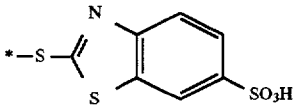
12
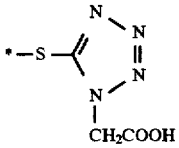
13
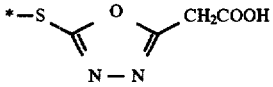
14
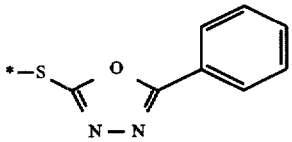
15
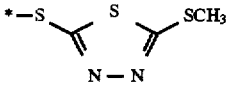
16
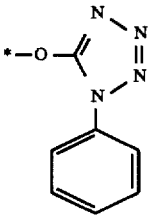
17
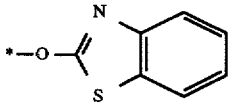
18
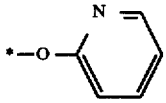
19
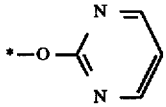
20
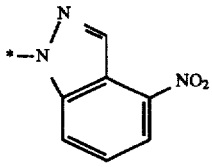

-continued
21
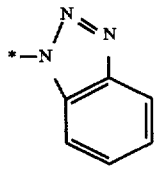
22
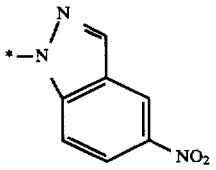
23
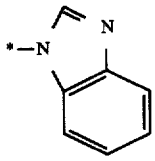
24
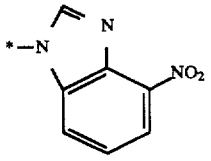
-continued
25
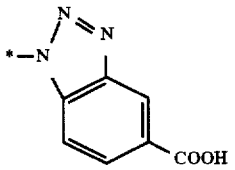
26
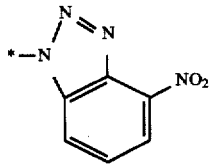
27
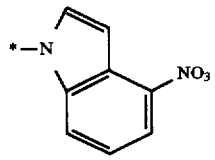
*— Tm-linking position
| Compounds | Tm | PUG |
|---|---|---|
| | 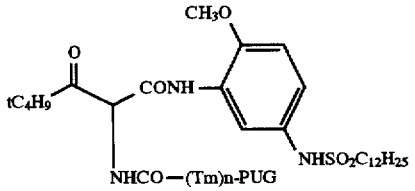 | |
| 1 | 1 | 1 |
| 2 | 2 | 4 |
| 3 | 4 | 14 |
| 4 | 17 | 17 |
| 5 | 21 | 22 |
| | 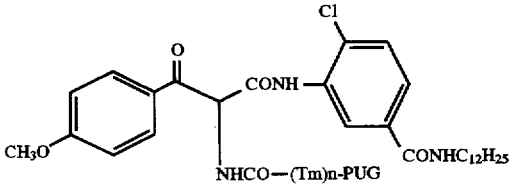 | |
| 6 | 2 | 2 |
| 7 | 3 | 6 |
| 8 | 6 | 10 |
| 9 | 11 | 13 |
| 10 | 20 | 24 |

-continued
| Compounds | Tm | PUG |
|---|---|---|
| | 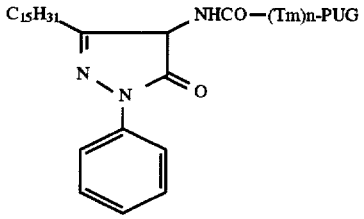 | |
| 11 | 1 | 1 |
| 12 | 2 | 5 |
| 13 | 5 | 2 |
| 14 | 6 | 15 |
| 15 | 17 | 13 |
| | 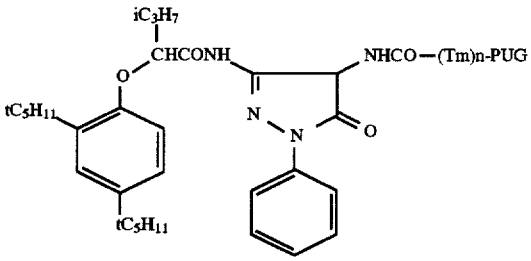 | |
| 16 | 8 | 1 |
| 17 | 2 | 1 |
| 18 | 2 | 4 |
| 19 | 2 | 5 |
| 20 | 6 | 2 |
| 21 | 8 | 5 |
| 22 | 15 | 15 |
| 23 | 18 | 22 |
| 24 | 20 | 2 |
| 25 | 21 | 20 |
| | 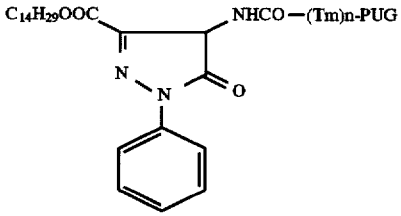 | |
| 26 | 2 | 4 |
| 27 | 4 | 8 |
| 28 | 12 | 9 |
| 29 | 13 | 12 |
| 30 | 16 | 16 |
| | 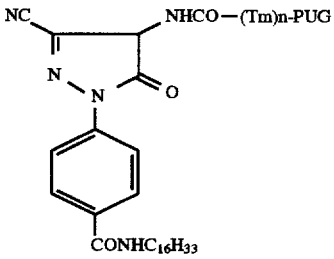 | |
| 31 | 2 | 3 |
| 32 | 7 | 7 |
| 33 | 8 | 11 |
| 34 | 14 | 14 |
| 35 | 19 | 18 |

-continued

| Compounds | Tm | PUG |
|---|---|---|
| 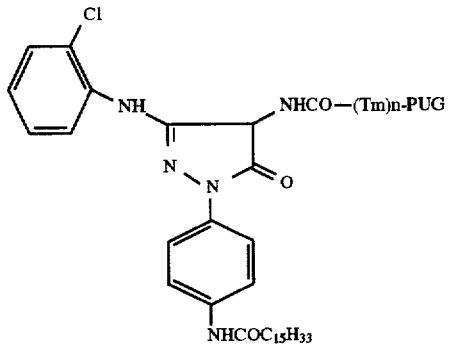 | | |
| 36 | 2 | 2 |
| 37 | 5 | 8 |
| 38 | 9 | 18 |
| 39 | 10 | 21 |
| 40 | 19 | 27 |
| 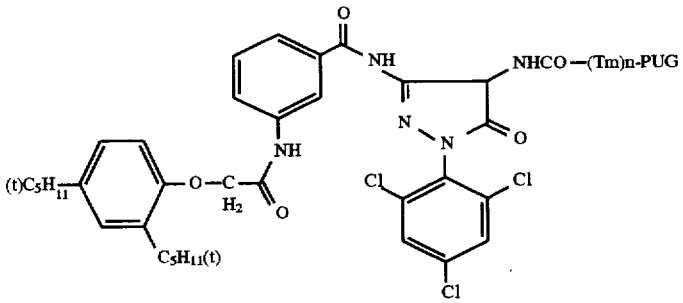 | | |
| 41 | 2 | 4 |
| 42 | 2 | 5 |
| 43 | 5 | 15 |
| 44 | 6 | 6 |
| 45 | 12 | 26 |

The compound represented by Formula [II] which are used in the invention preferably, is preferably contained in an amount of $1\times10^{-6}$ mol–$5\times10^{-2}$ mol, and more preferably, $1\times10^{-4}$ mol to $2\times10^{-2}$ mol per mole of silver halide. In cases where the compound is contained in a nonlight-sensitive hydrophilic colloidal layer, the content thereof is preferably $1\times10^{-6}$ to $5\times10^{-2}$, more preferably, $1\times10^{-4}$ to $2\times10^{-2}$ mol per mol of silver halide contained in a silver halide emulsion layer provided closest to the hydrophilic colloidal layer.

It is possible to used compounds represented by aforesaid Formula [II] by dissolving them in an appropriate water-miscible organic solvent such as, for example, alcohols, ketones, dimethylsulfoxide, dimethylformamide and methylcellosolve. It is further possible to add them as a known emulsification-dispersed product employing oil. It is also possible to use them by dispersing the compound powder in water by the use of a ball mill, a colloid mill, an impeller dispersing machine or ultrasonic waves in a method know as a solid dispersing method.

In the invention, the redox compound can be contained in a silver halide emulsion layer, a layer adjoining the emulsion layer or in other layer through the adjoining layer. The layer especially preferable for containing is an emulsion layer and/or a hydrophilic colloidal layer adjoining the emulsion layer. The most preferable is to provide a hydrophilic colloidal layer between a support and an emulsion layer closest to the support and to add the redox compound to the hydrophilic colloidal layer. Further, the redox compound can be contained in a plurality of different layers.

The silver halide emulsion used in the in the present invention is preferably a negative-working, surface sensitive (i.e., surface latent image forming type) emulsion. In the invention, it is preferable that halogen composition of silver halide in a silver halide emulsion is silver chloride, or silver chlorobromide containing silver chloride of not less than 60 mol % or silver chloroiodobromide containing silver chloride of not less than 60 mol %.

It is preferable that an average grain diameter of silver halide is 0.7 μm or less, and a range of 0.5–0.1 μm is especially preferable. The term, the average grain diameter is commonly used by those skilled in the field of photographic science and it is understood easily. When a grain is spherical or is close to a sphere, a grain diameter means a diameter of the grain. When the grain is a cube, the cube is converted to a sphere and its diameter is regarded as a grain diameter. The details of a method for obtaining an average grain diameter are described on pages 36–43 of the third edition of "The theory of the photographic process" (1966) edited by Mees & T. H. James and published by McMillan Co.

The shape of silver halide grains is not limited, and it can take any shape which is tabular, spherical, cubic, tetradecahedral, octahedral or of other shapes. With regard to grain diameter distribution, the narrower one is more preferable, and so-called monodispersed emulsions wherein 90% or preferably 95% of the total number of grains are within the area of grain diameter ranging in terms of grain diameter from −40% to +40% of an average grain diameter are preferable.

A method for mixing soluble silver halide and soluble halogen salt in the invention may include any of a single-sided mixing method, a double-jet method or a combination thereof.

It is also possible to use a method (so-called reverse precipitation method) in which grains are formed in the presence of excessive silver ions. As a type of the double-jet method, it is possible to use a method to keep constant the pAg in a liquid phase in which silver halides are produced, namely the so-called controlled double jet method. Owing to this method, it is possible to obtain a silver halide emulsion in which crystal shapes are regular and grain diameters are almost uniform.

With regard to silver halide grains used for a silver halide emulsion, it is preferable that complexes including elements in the third—13th groups of the periodic system such as cadmium salt, zinc salt, lead salt, thallium salt, iridium salt, rhodium salt, ruthenium salt, osmium salt, iron salt, platinum salt and palladium salt are added in the course of forming the grains or in at least one course of grain-growing courses. As a ligand for these complexes, it is possible to use a halogen atom, a nitrosyl group, an aquo group, an alkyl group, a pseudo-halogen group, an alkoxy group, an ammonium group, or any combination thereof.

With regard to the surface of a silver halide grain, its halogen composition can be controlled by the use of water-soluble halides or of silver halide fine grains. This method is called conversion and is known widely in the art.

A silver halide grain may either be uniform in terms of structure from its core to surface or be composed of plural layers each being different in halide composition, kind and amount of doping agent and distribution of lattice defect.

As silver halide grains used in the invention, it is possible to use, in combination, plural kinds of grains each being different in grain diameter, sensitivity, crystal habit, sensitive wavelength, halogen composition, monodispersity, amount and kind of dopant, potential, pH, manufacturing conditions such as desalting method, state of surface and chemical sensitization state. In that case, these silver halide grains can be contained either in the same layer or in plural different layers.

A silver halide emulsion and a preparation method thereof are described in detail either on pages 22–23 of No. 176–17643 of Research Disclosure (December issue in 1978) or in its reference document.

In the invention, sulfur sensitization, Se, Te sensitization, reduction sensitization and noble metal sensitization which are known commonly can also be used in combination selectively. It is also possible to skip chemical sensitization.

As a sulfur sensitizing agent, various sulfur compounds such as, for example, thiosulfate, thiourea, rhodanine and polysulfide compounds can be used in addition to sulfur compounds contained in gelatin. As a selenium sensitizing agent, triphenylselenophosphine is preferably used.

As the selenium sensitizing agent, various kinds of selenium compounds can be used. For example, it is possible to use compounds described in U.S. Pat. Nos. 1,574,944, 1,602,592 and 1,623,499, Japanese Patent O.P.I. Publication Nos. 150046/1985, 25832/1992, 109240/1992 and 147250/1992. Useful selenium sensitizing agent includes colloidal selenium metal, isoselenocyanates (e.g., allylisoselenocyanate, etc.), selenoureas (e.g., N,N-dimethylselenourea, N,N,N'-triethylselenourea, N,N,N'-trimethyl-N'-heptafluoroselenourea, N,N,N'-trimethyl-N'-heptafluoropropyl-carbonylselenourea, N,N,N'-trimethyl-N'-4-nitrophenylcarbonylselenourea, etc.), selenoketones (e.g., selenoaceton, selenoacetophenone, etc.), selenoamidos (e.g., selenoacetoamido, N,N-dimethylselenobenzamido, etc.), selenocarboxylic acids and selenoesters (e.g., 2-selenopropionic acid, methyl-3-selenobutyrate, etc.), selenophosphates (e.g., tri-p-triselenophosphate, etc.), and selenides (triphenylphosphineselenide, diethylselenide, diethyldiselenide, etc.). Selenium sensitizing agents especially preferable are selenoureas, selenoamides, selenoketones and selenides.

These selenium sensitizing agents can be used through known methods disclosed in scientific documents.

An amount of selenium sensitizing agents to be used varies depending on a selenium compound to be used, a silver halide grain, and chemical ripening conditions, but the amount is ordinarily $10^{-8}$–$10^{-4}$ mol per mol of silver halide. Temperature of chemical ripening employing selenium sensitizing agents is preferably within a range of 40°–90° C., and a range of 45° C.–80° C. is more preferable. A preferable range of pH is from 4 to 9 and that of pAg is from 6 to 9.5.

With regard to a method of adding sensitizing agents, when the sensitizing agent is water-soluble, it can be added as it is, but when it is hardly soluble to water, various methods are used. For example, there is a method wherein sulfur sensitizing agents and/or selenium sensitizing agent and/or tellurium sensitizing agents are mixed sufficiently with a gelatin solution in advance and then, they are added. Or, there is another method wherein a sensitizing agent is dissolved in a low-boiling organic solvent capable of dissolving the sensitizing agent, and then it is added through the emulsion dispersion conducted in the presence of surfactants. In the case of this method, it is preferable to remove the low-boiling organic solvent after emulsification. Further method is one disclosed in Japanese Patent O.P.I. Publication No. 140739/1992 wherein a sensitizing agent is added in the form of an emulsion of a mixed solution in which the sensitizing agent is mixed with a water-insoluble and organic-solvent-soluble polymer. It is further possible to employ the method wherein a sensitizing agent is dispersed through high speed impeller dispersion, sand mill dispersion, ultrasonic dispersion or ball mill dispersion to any level in terms of an average particle size within a range from 0.01 μm to 6 μm.

Among noble metal sensitizing methods, a typical one is a gold sensitizing method in which gold compounds, mainly gold complexes are used. Noble metals other than gold, such as complexes of platinum, palladium and rhodium for example, may also be used.

As a reduction sensitizing agent, it is possible to use stannous salts, amines, formamidinesulfinic acid and silane compounds.

In the invention, it is possible to use oxidizing agents for silver in the course of manufacturing light-sensitive materials. Oxidizing agents usable in the invention include, as inorganic oxidizing agents, oxiacids such as hydrogen peroxide (water), addition product of hydrogen peroxide (e.g., $NaBO_2 \cdot H_2O_2 \cdot 3H_2O$, $2NaCO_3 \cdot 3H_2O_2$, $Na_4P_2O_7 \cdot 2H_2O_2$, $2Na_2SO_4 \cdot H_2O_2 \cdot 2H_2O$), peroxy acid salt (e.g., $K_2S_2O_8$, $K_2C_2O_8$, $K_4P_2O_8$), peroxy complex compounds (e.g., $K_2[Ti(O_2)C_2O_4] \cdot 3H_2O$, $4K_2SO_4 \cdot Ti(O_2) \cdot OH \cdot SO_4 \cdot 2H_2O$, $Na_2[VO(O_2)(C_2O_4)_2] \cdot 6H_2O$), oxiacids such permanganate (e.g., $KMnO_4$) and chromate (e.g., $K_2CrO$), halogen element such as iodine and bromine, perhaloganates (e.g., potassium periodate), high valence metallic salt (e.g., potassium ferricyanide), and thiosulfonates, for example.

As an organic oxidizing agent, there may be given quinones such as p-quinone, organic peroxides such as peracetic acid and perbenzoic acid, and compounds releasing active halogen (e.g., N-imido bromoacetate, chloramine T and chloramine B).

Oxidizing agents which are especially preferable are ozone, hydrogen peroxide and its addition product, inorganic oxidizing agent of halogen element, quinones and organic oxidizing agent capable of releasing active halogen.

It is preferable that an amount of added oxidizing agent used in the invention is $10^{-7}$–$10^{-1}$ mol per mol of silver halide. More preferable amount is $10^{-6}$–$10^{-2}$ mol and an amount especially preferable is $10^{-5}$–$10^{-3}$ mol per mol of silver halide.

When adding oxidizing agent for silver used in the invention in the course of chemical sensitizing process, a method generally used for adding additives to photographic emulsions can be used. For example, it is possible to use a water-soluble compound in the form of an aqueous solution having appropriate concentration for adding them, and to use a which is water-insoluble or sparingly water-soluble by dissolving in a solvent which does not affect photographic characteristics adversely within an appropriate water-miscible organic solvent such as, for example, alcohols, glycols, ketones, esters and amides.

The oxidizing agent used in the invention can be added at any time in the manufacturing process for silver halide light-sensitive materials, and preferably it is added in a period from the process for preparing silver halide grains to the moment immediately before the start of coating on a support.

A silver halide emulsion of the invention can be spectrally sensitized by sensitizing dyes to the desired wavelength. Sensitizing dyes usable in the invention include cyanine dyes, merocyanine dyes, complex cyanine dyes, complex merocyanine dyes, holopolar cyanine dyes, hemicyanine dyes, styryl dyes and hemioxazol dyes. To these dyes, all nucleuses generally used for cyanine dyes as a basic heterocyclic nucleus can be applied. Namely, applicable nucleuses include pyrolin nucleus, oxazoline nucleus, thiazoline nucleus, pyrrole nucleus, oxazol nucleus, thiazol nucleus, selenazole nucleus, imidazole nucleus, tetrazole nucleus and pyridine nucleus; nucleuses condensed with an alicyclic hydrocarbon ring or aromatic hydrocarbon ring, namely indolenine nucleus, benzindolenine nucleus, indol nucleus, benzoxazol nucleus, naphthoxazole nucleus, benzthiazole nucleus, naphthothiazole nucleus, benzselenazole nucleus, benzimidazole nucleus, and quinolin nucleus. These nucleuses may be substituted on carbon atoms. To merocyanine dyes or to complex merocyanine dyes, it is possible to apply 5–6 membered heterocycles such as pyrazoline-5-one nucleus, thiohydantoin nucleus, 2-thioxazolidine-2, 4-dione nucleus, thiazolidine-2,4-dione nucleus, rhodanine nucleus and thiobarbituric acid nucleus, as a nucleus having a ketomethylene structure. To be concrete, those described on pages 2 and 3 of Volume No. 176-RD-17643 (December, 1978) of Research Disclosure and in U.S. Pat. Nos. 4,425,425 and 4,425,426 can be used. Sensitizing dyes may be dissolved by the use of ultrasonic oscillation described in U.S. Pat. No. 3,485,634. As methods for dissolving the sensitizing dye or for adding it to an emulsion after dispersing it, in addition to the methods mentioned above, those described in U.S. Pat. Nos. 3,482,981, 3,585,195, 3,469,987, 3,425,835 and 3,342,605, British Patent Nos. 1,271,329, 1,038,029 and 1,121,174, and U.S. Pat. Nos. 3,660,101 and 3,658,546 can be used. These sensitizing dyes can be used either independently or in combination thereof, and a combination of sensitizing dyes is used frequently for supersensitization, in particular. Combinations of dyes showing useful supersensitization and materials showing supersensitization are described in Item J of IV on page 23 of Research Disclosure Vol. 176–17643 (December issue in 1978).

The photographic light-sensitive materials used in the invention may contain various compounds for the purpose of preventing fog in the course of manufacturing the light-sensitive materials, or, during storage or photographic processing and stabilizing photographic performances. Namely, it is possible to add many compounds known as antifoggant or stabilizer such as azoles, for example, benzthiazolium salt, nitroindazole, nitrobenzimidazole, chlorobenzimdazole, bromobenzimidazole, mercaptothiazole, mercaptobenzthiazole, mercaptobenzimidazole, mercaptothiadiazole, aminotriazole, benztriazole, nitrobenztriazole, mercaptotetrazole (1-phenyl-5-nercaptotetrazole in particular); mercaptopyrimidine, mercaptotriazine; thioketo compound such as, for example, oxazolinethion; azaindene, for example, triazaindene, tetrazaindene (especially, 4-hydroxy-, substituted-1,3,3a,7-tetrazaindene), pentazaindene; benzenthiosulfonic acid, benzenesulfinic acid, benzenesulfonic acid amide and potassium bromide. Those especially preferable are substituted or unsubstituted heterocylic ring or heterocyclic condensed ring containing at least one of N, O, S and Se, and water-soluble halides.

Photographic emulsions and non-light-sensitive hydrophilic colloid used in the invention can contain inorganic or organic hardening agents. For example, chromium salt (chrome alum and chromium acetate), aldehydes (formaldehyde, glyoxal, glutaraldehyde), N-methylol compound (dimethylol urea and methyloldimethylhydantoin), dioxane derivative (2,3-dihydroxydioxane), active vinyl compound (1,3,5-triacryloyl-hexahydro-s-triazine, bis (vinylsufonyl) methylether, N,N'-methylene bis-[β-(vinylsufonyl) propioneamide]), active halogen compound (2,4-dichloro-6-hydroxy-s-triazine), mucohalogenoacid (mucochloric acid, phenoxymucochloric acid) isoxazoles, dialdehyde starch, 2-chloro-6-hydroxytriazinyl gelatin, isocyanate and carboxyl group active type hardener can be used independently or in combination.

For light-sensitive emulsion layers and/or non-light-sensitive hydrophilic colloidal layers of the invention, various known surfactants can be used for the various purposes of coating aid, antistatic, sliding property improvement, emulsifying-dispersion, anti-adhesion and photographic characteristics improvement.

As a binder or a protective colloid for a photographic emulsion, it is advantageous to use gelatin. In addition to that, hydrophilic colloid other than gelatin can also be used. For example, it is possible to use gelatin derivatives, graft polymer composed of gelatin and other polymer, albumin, protein such as casein; hydroxyethylcellulose, carboxymethylcellulose, cellulose derivative such as cellulose sulfuric acid ester, sodium alginate, sugar derivative such as starch derivative; and various kinds of synthetic hydrophilic polymer substances such as monomer or copolymer represented by polyvinylalcohol, polyvinylallcohol-partial acetal, poly-N-vinylpyrrolidone, polyacrylic acid, polymethacrylic acid, polyacrylamide, polyvinylimidazole, polyvinylpyrazole.

As gelatin, acid-treated gelatin may be used in addition to lime gelatin, and gelatin-hydrolysis product and gelatin-enzyme decomposition product may also be used.

Photographic emulsions of the invention can contain a dispersion of water-insoluble or sparingly water-soluble synthetic polymer for the purpose of improvement in dimensional stability and reduction of silver sludge. For example, alkyl (metha)acrylate, alkoxyacryl (metha)acrylate, glycidyl (metha)acrylate, (metha)acrylamide, vinylester (e.g., vinylacetate), acrylonitrile, olefin and styrene can be used independently or in combination, or polymers whose monomer component is a combination of aforesaid compounds and acrylic acid, methacrylic acid, α,β-unsaturated dicarboxylic acid, hydroxyalkyl (metha)acrylate, sulfoalkyl (metha)acrylate and styrenesulfonic acid can also be used. It is also possible to use monomers each having plural ethylenic unsaturated group as a monomer component. These monomers can contain water-soluble groups such as a hydroxyl group, a sulfon group, a carboxyl group and an amide group, and they can also contain primary to quarternary amino group, a phosphonium group, an aliphatic group, an aromatic group, $—NR^1NR^2—R^3$ ($R^1$, $R^2$ and $R^3$ represent arbitrary groups linked through a halogen atom, an aliphatic group, an aromatic group, a sulfinic acid residue, a carbonyl group, an oxalyl group, a carbamoyl group, an amino group, a sulfonyl group, a sulfoxy group, an iminomethylene group, an alkenyl group, an alkinyl group, an aryl group, an alkoxy group, an alkenyloxy group, an alkinyloxy group and an aryloxy group) and a cation group. As a synthesizing method, in addition to ordinary synthesizing methods, it is possible to employ a method wherein polymerization is conducted in the presence of water-soluble organic matters such as gelatin and polyvinyl alcohol. After completion of synthesization, shelling can be carried out with gelatin or silane coupling agent.

Other various additives are used for light-sensitive materials used in the invention. For example, desensitizer, plasticizer, lubricant, development accelerator, oil and colloidal silica are used.

Additives and aforesaid additives are referred to those described on pages 22–31 of No. 176 of Research Disclosure.

In light-sensitive materials of the invention, photographic component layers are coated on one side or on both sides of a flexible support used generally for light-sensitive materials. A flexible support which is useful includes cellulose acetate, cellulose acetate butyrate, polystyrene, polyethyleneterephthalate, a film composed of synthesized polymer of polyethyleneterenaphthalate (these can contain colored pigment) or a paper support coated with a high polymer such as polyethylene or polyethyleneterephthalate. These supports may be provided with a magnetic recording layer, an antistatic layer and a peeling layer.

As a developing agent usable in the invention, dihydroxybenzene (e.g., hydroquinone, chlorohydroquinone, bromohydroquinone, 2,3-dichlorohydroquinone, methylhydroquinone, isopropylhydroquinone, 2,5-dimethylhydroquinone), 3-pyrazolidone (e.g., 1-phenyl-4,4-dimethyl-3-pyrazolidone, 1-phenyl-4-ethyl-3-pyrazolidone, 1-phenyl-5-methyl-3-pyrazolidone), aminophenol (e.g., o-aminophenol, p-aminophenol, N-methyl-o-aminophenol, N-methyl-p-aminophenol, 2,4-diaminophenol), pyroggallol, ascorbic acid 1-aryl-3-pyrazoline (e.g., 1-(p-hydroxyphenyl)-3-aminopyrazoline, 1-(p-methylaminophenyl)-3-aminopyrazoline, 1-(p-amino-N-methylphenyl)-3-aminopyrazoline) and transition metal complex (these are complex of transition metal such as Ti, V, Cr, Mn, Fe, Co, Ni and Cu, and these are required to have reducing power so that they are used as a developer, and they take a form of complex of $Ti^{3+}$, $V^{2+}$, $Cr^{2+}$ and $Fe^{2+}$, for example, and as a ligand, there are given aminopolycarboxylic acid such as ethylenediaminetetraacetic acid (EDTA) and diethylenetriaminepentaacetic acid (DTPA) and its salt as well as phosphoric acid such as hexametapolyphosphoric acid and tetrapolyphosphoric acid and its salt) can be used independently or in combination. A combination of 3-pyrazolidone and dihydroxybenzene, or a combination of aminophenol and dihydroxybenzene, a combination of 3-pyrazolidone and ascorbic acid, a combination of aminophenol and ascorbic acid, a combination of 3-pyrazolidone and transition metal complex and a combination of aminophenol and transition metal complex are preferable to be used. Developing agents are preferably used usually in an amount of 0.01–1.4 mol/l.

As a silver sludge preventing agent in the invention, those described in Japanese Patent Examined Publication No. 4702/1987 and Japanese Patent O.P.I. Publication Nos. 51844/1991, 26838/1992, 362942/1992 and 319031/1989 are cited.

Further, it is possible to recycle developer effluent by making an electric current to flow through the developer effluent. To be concrete, the cathode (e.g., an electric conductor or semiconductor such as stainless steel wool) is put in the developer effluent and the anode (e.g., insoluble electric conductors such as carbon, gold, platinum and titanium) is put in an electrolytic solution, then a developer effluent tank and an electrolytic solution tank are made to be in contact with each other through an anion exchange membrane, and electricity is applied on both of the cathode and the anode for recycling. It is also possible to process light-sensitive materials of the invention while applying electricity. In that case, various additives to be added to a developer such as, for example, a preserving agent, an alkali agent, a pH buffer agent, a sensitizing agent, an antifoggant and a silver sludge preventing agent can be added additionally. In addition, there is a method for processing light-sensitive materials while an electric current is flowing through a developing solution, and in this case, aforesaid additives capable of being added to a developing solution can be added additionally. When using developer effluent after recycling it, transition metal complex is preferable as a developing agent of a developing solution to be used.

Sulfite and metabisulfite to be used as a preserving agent in the invention include sodium sulfite, potassium sulfite, ammonium sulfite and sodium metabisulfite. An amount of 0.25 mol/l is preferable for sulfite and that of 0.4 mol/l is especially preferable.

In case of need, it is possible to add to a developing solution an alkali agent (sodium hydroxide and potassium hydroxide,), a pH buffer agent (e.g., carbonate, phosphate, borate, acetic acid, citric acid and alkanolamine), a dissolving aid (e.g., polyethyleneglycol and its ester, alkanolamine), a sensitizing agent (e.g., nonionic surfactant including polyoxyethylene and quaternary ammonium compound), a surfactant, anti-foaming agent and antifoggant (e.g., halogenide such as potassium bromide or sodium bromide, nitrobenzindazole, nitrobenzimidazole, benztriazole, benzthiazole, tetrazole and thiazole), a chelating agent (e.g., ethylenediaminetetraacetic acid or its alkali metal salt, nitrilotriacetate and polyphosphate), a development accelerating agent (e.g., compounds described in U.S. Pat. No. 2,304,025 and Japanese Patent Examined Publication No. 45541/1972), a hardening agent (e.g., glutaraldehyde or addition product of its metabisulfite), or an antifoaming agent. It is preferable that pH of a developing solution is adjusted to 8–12, and especially, 9–11.

In a processing method for silver halide photographic light-sensitive materials of the invention, it is possible to use a developing solution which does not contain substantially hydroquinones (e.g., hydroquinone, chlorohydroquinone, bromohydroquinone, methyl hydroquinone and hydroquinonemonosulfonate). The word, "not contain substantially" means that the hydroquinone is not contained or contained in an amount of less than 0.01 mol per liter of a developing solution.

In this case, it is preferable that compounds represented by the following Formula (I) are contained, as a developing agent.

Formula (I)

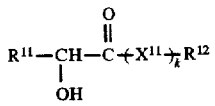

In compounds represented by Formula (I), a compound represented by the following Formula (I-a) wherein $R^{11}$ and $R^{12}$ are combined with each other to form a ring is preferable.

Formula (I-a)

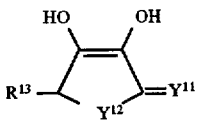

In the formula, $R^{13}$ represents a hydrogen, substituted or unsubstituted alkyl group, substituted or unsubstituted aryl group, substituted or unsubstituted amino group, substituted or unsubstituted alkoxy group, a sulfo group, a carboxyl group, an amido group and a sulfonamido group, $Y^{11}$ represents O or S, and $Y^{12}$ represents O, S or $NR^{14}$, in which $R^{14}$ represents substituted or unsubstituted alkyl group or substituted or unsubstituted aryl group.

As an alkyl group in Formula (I) or Formula (I-a), a lower alkyl group is preferable. For example, it is an alkyl group having 1–5 carbon atoms, and a preferable amino group is one substituted with an unsubstituted amino group or a lower alkyl group. A lower alkoxy group is preferable as an alkoxy group, and a phenyl group or a naphthyl group is preferable as an aryl group. These groups may have a substituent, and as a group capable of being substituted, a hydroxyl group, a halogen atom, an alkoxy group, a sulfo group, a carboxyl group, an amido group and a sulfonamide group are given as a preferable substituent.

Concrete compounds represented by Formula (I) or Formula (I-a) are shown below, and the invention is not limited to them.

Formula (I)

| Compound No. | $X_{11}$ | $R_{11}$ | $R_{12}$ |
|---|---|---|---|
| A-1 | — (k = 0) | $HOCH_2CH(OH)-CH(OH)-$ | —OH |
| A-2 | — (k = 0) | $CH_3CH(OH)-CH(OH)-$ | —OH |
| A-3 | — (k = 0) | $HOCH_2CH(OH)-CH(OH)-$ | $-CH_3$ |
| A-4 | — (k = 0) | $CH_3CH(OH)-CH(OH)-$ | $-CH_3$ |
| A-5 | $-C(=O)-$ (k = 1) | $HOCH_2CH(OH)-CH(OH)-$ | —OH |

-continued

Formula (I)

| Compound No. | $X_{11}$ | $R_{11}$ | $R_{12}$ |
|---|---|---|---|
| A-6 | $-C(=O)-$ (k = 1) | $CH_3CH(OH)-CH(OH)-$ | —OH |
| A-7 | $-C(=S)-$ (k = 1) | $HOCH_2CH(OH)-CH(OH)-$ | —OH |
| A-8 | $-C(=S)-$ (k = 1) | $CH_3CH(OH)-CH(OH)-$ | —OH |
| A-9 | $-C(=O)-$ (k = 1) | $HO-CH_2-$ | —OH |
| A-10 | $-C(=O)-$ (k = 1) | $HO-CH_2-$ | $-CH_3$ |
| A-11 | $-C(=O)-$ (k = 1) | $HO-CH_2-$ | $C_2H_5$ |
| A-12 | $-C(=O)-$ (k = 1) | $HO-CH_2-$ | $-C_2H_4OH$ |

Formula (I-a)

| Compound No. | $Y_{11}$ | $Y_{12}$ | $R_{13}$ |
|---|---|---|---|
| A-13 | O | O | H |
| A-14 | O | O | $CH_3$ |
| A-15 | O | O | $CH_2(OH)$ |
| A-16 | O | O | $CH_3CH(OH)-$ |
| A-17 | O | O | $HOCH_2CH(OH)-$ |
| A-18 | O | O | $ClCH_2CH(OH)-$ |
| A-19 | O | O | $HOOCCH_2CH(OH)-$ |
| A-20 | S | O | H |
| A-21 | S | O | $CH_3CH(OH)-$ |
| A-22 | S | O | $HOCH_2CH(OH)-$ |
| A-23 | O | $NCH_3$ | H |
| A-24 | O | NH | $HOCH_2CH(OH)-$ |
| A-25 | O | S | H |
| A-26 | O | S | $HOCH_2CH(OH)-$ |

-continued

| Formula (I-a) | | | |
|---|---|---|---|
| Compound No. | $Y_{11}$ | $Y_{12}$ | $R_{13}$ |
| A-27 | O | S | $CH_3CH(OH)-$ |
| A-28 | S | S | H |
| A-29 | S | S | $HOCH_2CH(OH)-$ |
| A-30 | S | S | H |

These compounds are typically ascorbic acid or erythorbic acid, or derivatives thereof, and they are commercially available or they can be synthesized easily through known synthesizing methods.

In the invention, a developing agent of transition metal complex can be used in combination with developing agents of 3-pyrazolidone (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, and of aminophenol (e.g., o-aminophenol, p-aminophenol, N-methyl-o-aminophenol, N-methyl-p-aminophenol, and 2,4-diaminophenol). When using in combination, developing agents of 3-pyrazolidone and aminophenol are generally used preferably in an amount of 0.01–1.4 mol per liter of a developing solution.

As a specific type of processing for light-sensitive materials of the invention, developing agents may be used in an activator processing solution wherein the developing agent is contained in a light-sensitive material, for example, in an emulsion layer and the light-sensitive material is processed in an alkali aqueous solution. The processing of this type is employed frequently as a method of rapid processing for light-sensitive materials through combination with stabilization process by use of thiocyanate, and it is possible to apply to such processing solution. The invention shows its great effect in such case of rapid processing.

As a fixing solution, those having commonly-used composition can be used. A fixing solution is an aqueous solution composed generally of a fixing agent and others, and its pH is usually 3.8–5.8. As a fixing agent, it is possible to use organic sulfur compound which can produce soluble and stabilized silver complex and is known as a fixing agent, in addition to thiosulfate such as sodium thiosulfate, potassium thiosulfate and ammonium thiosulfate, and thiocyanate such as sodium thiocyanate, potassium thiocyanate and ammonium thiocyanate.

Water-soluble aluminum salt acting as a hardening agent such as, for example, aluminum chloride, aluminum sulfate and potash alum can be added to a fixing solution.

In case of need, a fixing solution can contain compounds such as a preserving agent (e.g., sulfite and bisulfite), a pH buffer agent (e.g., acetic acid), a pH adjusting agent (e.g., sulfuric acid) and a chelating agent having water-softening power.

Washing with water is conducted after fixing in the processing, and a washing system wherein a washing tank supplies fresh water at a rate of several liters per minute as processing makes progress, a washing system wherein washing water is treated, while it is circulated, by chemicals, filters, ozone and light, to be reused, and a washing system wherein a washing tank is made to be a stabilizing tank provided with stabilizing agents and a small amount of a stabilizing solution is supplied in accordance with an amount of processing, are used. Though this process is at a Ordinary temperature usually, it is possible to warm to 30° C.–50° C. When using a stabilizing tank, it is possible to use the processing without pipe which does not need any connection to a service pipe. Further, a rinse tank can be provided between processing tanks.

As a mother solution or a replenisher for each of a developing solution, a fixing solution and a stabilizing solution, a solution to be used or a solution prepared by diluting a condensed solution immediately before using is usually supplied. With regard to a stock for a mother solution and a replenisher, it may either be in a form of a solution to be used, a form of a condensed solution or a form of a half-degumming viscous solution having high viscosity, or a form wherein a simple substance of solid component or a mixture is dissolved before using. When using a mixture, it is possible to employ a system wherein components which are hard to react on each other are made to adjoin each other and are vacuum-packed in a layer form are unpacked and dissolved before using, and a system for forming a tablet. In particular, the system wherein mixtures formed to be tablets are added to a dissolving tank or added directly to a processing tank is extremely excellent in terms of easy operation, space-saving and preservability, and thereby can be used preferably in particular.

In development processing in the invention, it is also possible to use a developing temperature within an ordinary temperature range of 20°–50° C.

It is preferable that silver halide photographic light-sensitive materials of the invention are processed in an automatic processing machine. In that case, processing is carried out while replenishing a certain amount of a developing solution and a certain amount of a fixing solution each being proportional to an area of light-sensitive materials. An amount of each of developing solution replenisher and fixing solution replenisher is preferably 300 ml or less per 1 $m^2$ to reduce an amount of effluent. More preferable is 75–200 ml per 1 $m^2$.

When processing by the use of an automatic processing machine for a demand for reducing processing time, it is preferable that a total processing time period (Dry to Dry) required for a leading edge of a film to be inserted in the automatic processing machine and to be drawn out of a drying zone after processing is 10–60 seconds. The total processing time mentioned here includes a time period for all steps necessary for processing a black and white light-sensitive material, and it means the time including concretely all time periods for steps of developing, fixing, bleaching, washing, stabilizing and drying, for example, necessary for processing, namely the time of Dry to Dry.

At a drying zone of an automatic processing machine, a method for drying by using warm air is usually used. Further, a method having a drying zone where a heat transfer object of not less than 90° C. (e.g., heat roller at 90° C.–130° C.) or a radiation object of not less than 150° C. (e.g., those wherein infrared rays are emitted through heating radiation made by applying directly an electric current to tungsten, carbon, nichrome, mixture of zirconium oxide/yttrium oxide/thorium oxide, and silicon carbide, or through heating caused by transfer of heat energy from resistance heating element to radiator such as copper, stainless steel and various ceramics) is used for drying, and a method provided with known drying means such as a dehumidifier, a microwave generating unit and a water-absorbing resin are included. Further, a mechanism for controlling the state of drying may be provided.

Effects of the invention will be explained concretely as follows, referring to the examples to which the invention is not limited.

EXAMPLES

Example 1

(Preparation of silver halide emulsion A1)

Employing a double-jet method, silver bromochloride core grains having an average grain diameter of 0.09 μm composed of 70 mol % of silver chloride and silver bromide. When forming core grains, an aqueous solution of silver nitrate and a water-soluble halide solution were mixed simultaneously in the presence of $7\times10^{-8}$ mol of $K_3Rh(NO)_4(H_2O)$ per mol of silver in completion of grain formation and $8\times10^{-6}$ mol of $K_3OsCl_6$ added. While keeping 40° C. pH 3.0 silver potential (EAg) 165 mV. Then, this core grain was covered with a shell through a double-jet method wherein EAg was lowered to 125 mV by sodium chloride. In that case, $3\times10^{-7}$ mol of $K_2IrCl_6$ and $9\times10^{-8}$ mol of $K_3RhCl_6$ respectively per mol of silver were added to the halide solution. Further, silver iodide grains were further added, and an emulsion thus obtained proved to be one which was cube-shaped silver bromochloride (composed of 70 mol % of silver chloride, 0.2 mol % of silver iodide and silver bromide) of a core/shell monodispersed type (variation coefficient of 10%) having an average grain diameter of 0.15 μm. Then, the emulsion was desalted by modified gelatin described in Japanese Patent O.P.I. Publication No. 280139/1990 (e.g., exemplified compound G-8 on page (3) of No. 287 of Japanese Patent O.P.I. Publication No. 280139/1990 wherein an amino group in gelatin is substituted with phenylcarbamyl). EAg observed after the desalting was 190 mV at 50° C.

To the emulsion thus obtained, there were added 1.5 mol of 4-hydroxy-6-methyl-1,3,3a,7-tetrazaindene per mol of silver, $5\times10_{-4}$ mol of potassium bromide and citric acid, and the emulsion was adjusted to a pH of 5.6 and EAg of 123 mV. After $1\times10^{-3}$ mol of sodium p-toluenesulfonylchloroamide trihydrate (chloramine T) was added for reaction thereof, elemental sulfur ($S_8$) compound dispersed in the form of solid particles (Seishin Kigyo Co.: those dispersed to an average size of 0.5 μm by adding saponin by the use of PM-1200) and $1.5\times10^{-5}$ mol of chloroauric acid were added to the emulsion to conduct chemical sensitization until the maximum sensitivity can be obtained at 55° C. After that, 100 mg of sensitizing dye d-1 and 5 mg of trihexylamine were added at 50° C., then, after the temperature was lowered to 40° C., $2\times10^{-3}$ of 4-hydroxy-6-methyl- 1,3,3a,7-tetrazaindene per mol of silver, $3\times10^{-4}$ mol of 1-phenyl--5-mercaptotetrazole and $5\times10^{-3}$ of potassium iodide were added, and the pH was adjusted to 5.1 by citric acid.

(Preparation of silver halide emulsion A2)

Silver halide emulsion A2 was prepared in the same manner as in silver halide emulsion A1, except that the reaction temperature was raised to 50° C., an average grain diameter was made to be 0.19 μm and $6\times10^{-8}$ of $K_3RhCl_6$ was used. When chemical sensitization was similarly applied to the emulsion A2, its sensitivity is higher than that of the emulsion A1 by 40%.

(Preparation of silver halide photographic light-sensitive materials for use in plate-making scanner employing He—Ne laser light source)

On a support was made simultaneous multi-layer coating wherein a gelatin-subbing layer having the following composition 1 was coated so as to have an amount of gelatin of 0.45 g/m², silver halide emulsion layer 1 having composition 2 was coated on the gelatin-subbing layer so as to have an amount of silver of 1.5 g/m² and an amount of gelatin of 0.65 g/m², silver halide emulsion layer 2 having composition 3 was coated on the silver halide emulsion layer 1 so as to have an amount of silver of 1.5 g/m² and an amount of gelatin of 0.65 g/m², and a protective layer coating solution having the following composition 4 was further coated so as to have an amount of gelatin of 0.7 g/m². A subbing layer on the side of the support opposite to aforesaid layer side was subjected to simultaneous multi-layer coating wherein a backing layer having the following composition 5 was coated so as to have an amount of gelatin of 1.5 g/m², and a backing protective layer having the following composition 6 was coated so as to have an amount of gelatin of 0.8 g/m². The emulsion layer side was simultaneously coated through a curtain coating method at a rate of 200 m/min, and then, they were cooled and set. Without intermission, the backing layer side was subjected to simultaneous multi-layer coating and then was cooled and set at −1° C. After that, both sides were dried simultaneously, and thus, a sample was obtained.

| Composition 1 (Gelatin-subbing layer composition) | |
|---|---|
| Gelatin | 0.45 g/m² |
| Saponin | 56.5 mg/m² |
| Sodium polystyrenesulfonate (average molecular weight 500000) | 15 mg/m² |
| Bacteriocide$_z$ | 0.5 mg/m² |
| **Composition 2 (Silver halide emulsion layer 1 composition)** | |
| Silver halide emulsion A1 | Silver amount 1.5 g/m² equivalent |
| Sensitizing dye d-1 | 75 mg/Ag mol |
| Hydrazine derivative in Table 1 | |
| Nucleation accelerator: Exemplified compound Na-21 | 3 mg/m² |
| 2-pyrydinol | 1 mg/m² |
| Polymer latex (grain diameter 0.25 μm) | 0.25 g/m² |
| Hardener h1 | 5 mg/m² |
| S-1 (sodium-iso-amyl-n-decylsulfosuccinate) | 2 mg/m² |
| Sodium naphthalenesulfonate | 8 mg/m² |
| Saponin | 20 mg/m² |
| 2-mercapto-6-hydroxypurine | 2 mg/m² |
| 2-mercaptopyridine | 1 mg/m² |
| Colloindal silica (average grain diameter 0.05 μm) | 150 mg/m² |
| Ascorbic acid | 20 mg/m² |

-continued

| | |
|---|---|
| EDTA | 25 mg/m$^2$ |
| Sodium polystyrenesulfonic acid | 15 mg/m$^2$ |
| Coating solution pH was 5.2. | |
| Composition 3 (Silver halide emulsion layer 2 composition) | |
| Silver halide emulsion A2 | Silver amount 1.5 g/m$^2$ equivalent |
| Sensitizing dye d-2 | 150 mg/Ag mol |
| Hydrazine compound in Table 1 | |
| Nucleation accelerator: Exemplified compound Na-21 | 4 mg/m$^2$ |
| S-1 | 6 mg/m$^2$ |
| 2-mercapto-6-hydroxypurine | 1 mg/m$^2$ |
| Nicotinicacidamide | 1 mg/m$^2$ |
| Gallic acidn-propylester | 50 mg/m$^2$ |
| Mercaptopyrimidine | 1 mg/m$^2$ |
| EDTA | 50 mg/m$^2$ |
| Styrene-maleic acidcopolymer (molecular weight 70000) | 10 mg/m$^2$ |
| Polymer latex L2 (Type Lx-3 Composition (9) in Example 3 of Japanese Patent O.P.I. Publication No. 66512/1993) | 0.25 g/m$^2$ |
| Colloindal silica (average grain size 0.05 μm) | 150 mg/m$^2$ |
| Phthalated gelatin was used as gelatin, and coating solution pH was 4.8. | |
| Composition 4 (Emulsion-protective layer composition) | |
| Gelatin | 0.7 g/m$^2$ |
| S-1 | 12 mg/m$^2$ |
| Matting agent: Spherical polymethylmethacrylate with average grain size of 3.5 μm | 25 mg/m$^2$ |
| Amorphous silica with average grain size of 8 μm | 12.5 mg/m$^2$ |
| Hydroquinone | 50 mg/m$^2$ |
| Lubricant (Silicone oil) | 4 mg/m$^2$ |
| Compound a | 50 mg/m$^2$ |
| Polymer latex L3 (grain size 0.10 μm) | 0.25 g/m$^2$ |
| Colloindal silica (average grain size 0.05 μm) | 150 mg/m$^2$ |
| 1,3-vinylsulfonyl-2-propanol | 40 mg/m$^2$ |
| Hardener h2 | 30 mg/m$^2$ |
| Sodium polystyrenesulfonate | 10 mg/m$^2$ |
| Bactericide z | 0.5 mg/m$^2$ |
| Composition 5 (Backing layer composition) | |
| Gelatin | 0.6 g/m$^2$ |
| S-1 | 5 mg/m$^2$ |
| Polymerlatex L3 | 0.3 g/m$^2$ |
| Colloindal silica (average grain size 0.05 μm) | 100 mg/m$^2$ |
| Sodium polystyrenesulfonate | 10 mg/m$^2$ |
| Dye f1 | 45 mg/m$^2$ |
| Dye f2 | 7 mg/m$^2$ |
| Dye f3 | 65 mg/m$^2$ |
| 1-phenyl-5-mercaptotetrazole | 10 mg/m$^2$ |
| Hardener h3 | 100 mg/m$^2$ |
| Zinc hydroxide | 50 mg/m$^2$ |
| EDTA | 50 mg/m$^2$ |
| Composition 6 (Backing protective layer composition) | |
| Gelatin | 0.4 g/m$^2$ |
| Matting agent: Monodispersed polymethylmethacrylate with average grain size of 5 μm | 50 mg/m$^2$ |
| Amorphous silica with average grain size of 3 μm | 12.5 mg/m$^2$ |
| Sodium-di-(2-ethylhexyl)-sulfosuccinate) | 10 mg/m$^2$ |
| Saponin | 10 mg/m$^2$ |
| Dye f1 | 45 mg/m$^2$ |
| Dye f2 | 7 mg/m$^2$ |
| Dye f3 | 65 mg/m$^2$ |
| Hardener h1 | 80 mg/m$^2$ |
| Sodium polytyrenesulfonate | 10 mg/m$^2$ |

-continued
(Z)
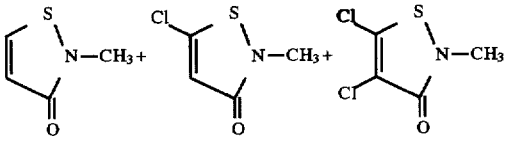
(d-1)
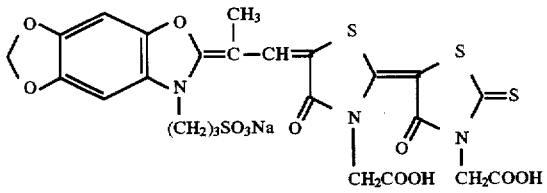
(d-2)
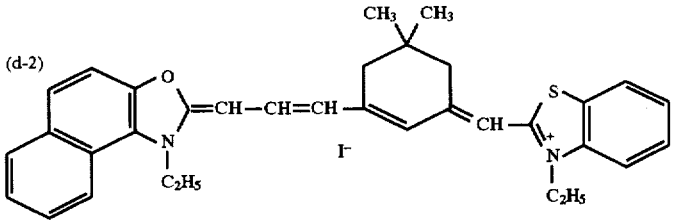
(L1)
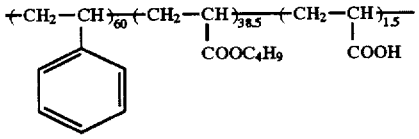
(l2)
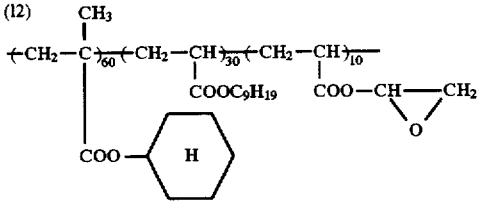
(L3)
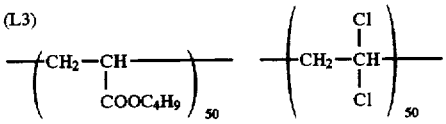
(h1)
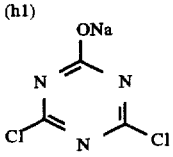
(f1)
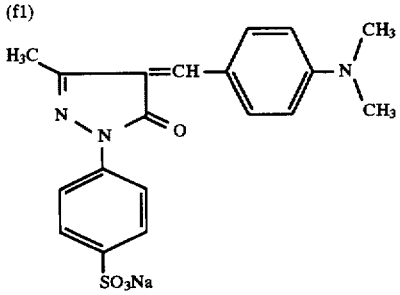

-continued (f2)

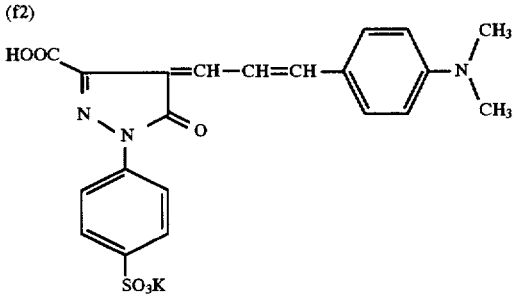

(f3)

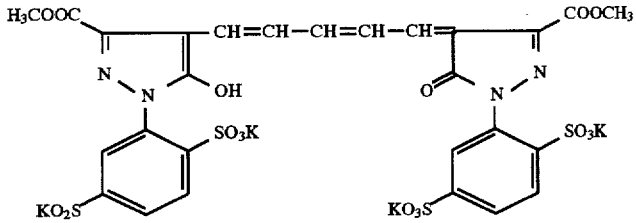

(h2)

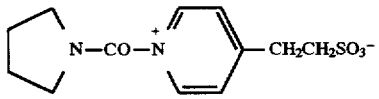

(h3)

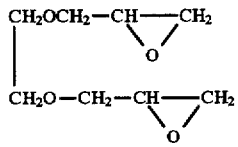

(Compound a)

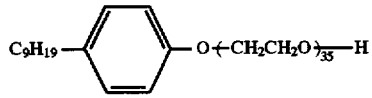

Samples thus obtained were subjected to exposure at exposure time of $1.5\times10^{-7}$ seconds while changing a quantity of light, using a laser sensitometer that employs a He—Ne laser with 633 nm wavelength as a light source, and were processed under the following conditions by the automatic processing machine GR-27 (made by Konica Corp.) in which a developing solution and a fixing solution both having the following compositions were used. Black density of each of the processed samples thus obtained was measured by PDA-65 (Konica digital densitometer).

For evaluating fine halftone dot reproducibility of the samples thus obtained, setting was made on Select Set 5000 made by Agfa Co. under the condition of 3600 dpi/300 lpi so that small-sized dots (dots of 5%), medium-sized dots (dots of 50%), large-sized dots (dots of 95%) and solid-black (dots of 100%) were outputted, and the samples were subjected to exposure while a quantity of light was changed. Then, the samples were processed in the same manner as in the foregoing, and dot percentages of the processed samples were measured by X-Rite 361T. Dot quality of the dots was also evaluated.

| Developing solution (per 1 liter of solution used) | |
|---|---|
| Pentasodiumdiethylenetriaminepentaacetate | 1 g |
| Sodium sulfite | 42.5 g |
| Potassium sulfite | 17.5 g |
| Potassium carbonate | 55 g |
| Hydroquinone | 20 g |
| 1-phenyl-4-methyl-4-hydroxymethyl-3-pyrazolidone | 0.85 g |
| Potassium bromide | 4 g |
| 5-methylbenztriazole | 0.2 g |
| Boric acid | 8 g |
| Diethyleneglycol | 40 g |
| 8-mercaptoadenine | 0.07 g |
| KOH was added to adjust the pH of a solution to 10.4. | |

| Fixing solution (per 1 liter of solution used) | |
|---|---|
| Ammonium thiosufate (70% aqueous solution) | 200 ml |
| Sodium sulfite | 22 g |
| Boric acid | 9.8 g |
| Sodiumacetatetrihydrate | 34 g |
| Acetic acid (90% aqueous solution) | 14.5 g |
| Tartaric acid | 3.0 g |

-continued

| | |
|---|---|
| Aluminum sulfate (27% aqueous solution) | 25 ml |
| Sulfuric acid was used for adjusting the pH to 4.9. | |

Processing conditions

| (Step) | (Temperature) | (Time) |
|---|---|---|
| Developing | 35° C. | 30 seconds |
| Fixing | 35° C. | 20 seconds |
| Washing | Ordinary temperature | 20 seconds |
| Squeezing drying | 50° C. | 30 seconds |
| Total | | 100 seconds |

Evaluation of sensitivity and gamma

Sensitivity of each sample is shown in relative sensitivity in which the sensitivity for density 2.5 of Sample No. 11 is assumed to be 100. A gamma, on the other hand, is represented by a tangent (i.e., slope) of a line connecting the point of density 0.1 and that of density 3.0, and it is shown that ultra-high contrast images are obtained only in cases where the gamma value in the table is 10 or higher.

Evaluation method for small-sized dot reproducibility

A dot percentage for small-sized dots (intended dot percentage of 5%) actually produced on the sample by the exposure which gave a solid density of 5.0 was measured. The closer to 5%, the better, and when it is less than 3%, it is problematic in practical use.

Evaluation method for medium-sized dot reproducibility

A dot percentage for the medium-sized dot (intended dot percentage of 50%) actually produced on the sample by the exposure which gave a solid density of 5.0 was measure. The closer to 50%, the better, and when it exceeds 53%, it is problematic in practical use.

Evaluation method for dot quality

Medium-sized dots (intended dot percentage of 50%) produced by the exposure which gave a solid density of 5.0 were observed under a 100-power magnifier for evaluating dot quality (sharpness). Evaluation was carried out through ranking in which the highest rank was 5 which was followed by 4, 3, 2 and 1 depending on each dot quality. Ranks 1 and 2 represent the levels which are problematic in practical use. The results are shown in Table 1.

sensitive and ultra-high contrast but also are excellent in reproducibility of fine dots and in quality of fine dots.

Example 2

Preparation of silver halide emulsion B1

An aqueous solution of silver nitrate and an aqueous solution of a mixture of NaCl and KBr were mixed through a controlled double-jet method to form silver halide grains containing 70 mol % of silver chloride and 30 mol % of silver bromide. In this case, the conditions including temperature of 36° C., pAg of 7.8 and pH of 3.0 were used for mixing the solutions, and $2\times10^{-7}$ mol % of $Na_2RhCl_6$ per mol of silver was added in the course of grain formation. After that, desalting was conducted by modified gelatin treated by phenylisocyanate, then, ossein was added for dispersing again. The emulsion thus obtained was one composed of cubic grains having an average grain diameter of 0.2 μm and variation coefficient of 10%. To the emulsion thus obtained, 50 mg of 4-mercapto-2,3,5,6-tetrafluorobenzoic acid per mol of silver was added and further, 5 mg of chloroauric acid and 0.5 mg of flower of sulfur both per mol of silver were added to conduct chemical ripening for 80 minutes under the conditions of a pH of 5.8, pAg of 7.0 and temperature of 60° C. After completion of the ripening, 900 mg of 4-methyl-6-hydroxy-1,3,3a,7-tetrazaindene per mol of silver was added, and 300 mg of KI was further added.

Preparation of silver halide emulsion B2

Silver halide emulsion B2 was prepared in the same manner as in silver halide emulsion B1 except that $Na_2RhCl_6$ was added in an amount of $1.1\times10^{-7}$. Chemical sensitization was similarity conducted, and the sensitivity of emulsion B2 was higher than that of emulsion B1 by 25%.

Preparation of silver halide photographic light-sensitive materials for use in plate-making scanner employing Ar laser light source On a support was made simultaneous multi-layer coating wherein a gelatin-subbing layer having composition 7 below was coated so as to have a gelatin amount of 0.6 g/m$^2$, silver halide emulsion layer 1 having composition 8 was coated on the gelatin-subbing layer so as to have a silver amount of 1.5 g/m$^2$ and a gelatin amount of 0.8 g/m$^2$, an intermediate layer having composition 9 was coated on the silver halide emulsion layer 1 so as to have a gelatin amount of 0.4 g/m$^2$, silver halide emulsion layer 2 having composition 10 was coated on the intermediate layer so as to have a silver

TABLE 1

| No. | Hydrazine compound: Emulsion layer 1 (mol/mol of silver) | Hydrazine compound: Emulsion layer 2 (mol/mol of silver) | Sensitivity | Gamma | Small dots (%) | Medium dots (%) | Dot quality | Remarks |
|---|---|---|---|---|---|---|---|---|
| 11 | H-6 (0.5) | — | 100 | 8 | 2.5 | 54.5 | 2 | Comp. |
| 12 | H-6 (0.5) | H-6 (0.5) | 110 | 13 | 2.6 | 53.6 | 2 | Comp. |
| 13 | H-6 (1.0) | H-6 (0.5) | 113 | 13 | 2.8 | 54.4 | 2 | Comp. |
| 14 | H-6 (0.5) | H-6 (1.0) | 130 | 16 | 4.5 | 51.3 | 5 | Inv. |
| 15 | H-6 (0.5) | H-6 (1.3) | 143 | 18 | 4.8 | 50.5 | 5 | Inv. |
| 16 | H-15 (0.5) | H-6 (1.0) | 134 | 17 | 4.7 | 50.8 | 4 | Inv. |

Comp.: Comparative
Inv.: Inventive

It is understood that silver halide photographic light-sensitive materials of the invention for use in a plate-making scanner employing a He—Ne laser are not only highly amount of 1.5 g/m$^2$ and a gelatin amount of 0.8 g/m$^2$, and a protective layer coating solution having composition 11 below was coated so as to have a gelatin amount of 0.6 g/m$^2$. A subbing layer on the side of the support opposite to aforesaid layers side was subjected to simultaneous multi-layer coating wherein a backing layer having the following composition 12 was coated so that an amount of gelatin of 2.0 g/m$^2$ may be attained, and a backing protective layer having the following composition 13 was coated on the backing layer so that an amount of gelatin of 1.0 g/m$^2$ may be attained on the emulsion layer side through a curtain coating system at a rate of 200 m/min, and then, they were cooled and set. Without intermission, the backing layer side was subjected to simultaneous multi-layer coating and then was cooled and set at −1° C. After that, both sides were dried simultaneously, and thus, a sample was obtained.

| Composition 7 (Gelatin-subbing layer composition) | |
|---|---|
| Gelatin | 0.6 g/m$^2$ |
| Saponin | 56.5 mg/m$^2$ |
| Sodium polystyrenesulfonate (average molecular weight 500000) | 15 mg/m$^2$ |
| Bactericide z | 0.5 mg/m$^2$ |
| Hydrazine derivative as shown in Table 2 | |
| **Composition 8 (Silver halide emulsion layer 1 composition)** | |
| Gelatin | 0.8 g/m$^2$ |
| Silver halide emulsion B1 | |
| Amount to achieve silver amount of | 1.5 g/m$^2$ |
| Sensitizing dye d-3 | 6 mg/m$^2$ |
| Sensitizing dye d-4 | 3 mg/m$^2$ |
| Antifoggant: Adenine | 25 mg/m$^2$ |
| Stabilizer: 5-nitroindazole | 10 mg/m$^2$ |
| Hydrazine derivative as shown in Table 2 | |
| Nucleation accelerator: Exemplified compound Na-10 | 15 mg/m$^2$ |
| Latex polymer L1 | 1.0 g/m$^2$ |
| S-1 | 0.7 mg/m$^2$ |
| Compound a | 45 mg/m$^2$ |
| **Composition 9 (Intermediate layer composition)** | |
| Gelatin | 0.4 g/m$^2$ |
| Saponin | 56.5 mg/m$^2$ |
| Sodium polystyrenesulfonate (average molecular weight 500000) | 15 mg/m$^2$ |
| Bactericide z | 0.5 mg/m$^2$ |
| **Composition 10 (Silver halide emulsion layer 2 composition)** | |
| Gelatin | 0.8 g/m$^2$ |
| Silver halide emulsion B2 | |
| Amount to achieve silver amount of | 1.5 g/m$^2$ |
| Sensitizing dye d-3 | 6 mg/m$^2$ |
| Sensitizing dye d-4 | 6 mg/m$^2$ |
| Antifoggant: Adenine | 25 mg/m$^2$ |
| Hydrazine derivative as shown in Table 2 | |
| Nucleation accelerator: Exemplified compound Na-10 | 15 mg/m$^2$ |
| Latex polymer L1 | 1.0 g/m$^2$ |
| S-1 | 0.7 mg/m$^2$ |
| Compound a | 45 mg/m$^2$ |
| **Composition 11 (Emulsion protective layer composition)** | |
| Gelatin | 0.6 g/m$^2$ |
| Matting agent: Silica with average grain size of 3.5 μm | 20 mg/m$^2$ |
| Surfactant b | 2 mg/m$^2$ |
| Accelerator: Hydroquinon | 50 mg/m$^2$ |
| Hardener h2 | 150 mg/m$^2$ |
| **Composition 12 (Backing layer composition)** | |
| Gelatin | 2.0 g/m$^2$ |
| Sodium polystyrenesulfonate | 20 mg/m$^2$ |

-continued

| | |
|---|---|
| Colloidal silica (average grain size 0.05 μm) | 170 mg/m$^2$ |
| Latexpolymer L3 | 0.3 g/m$^2$ |
| **Composition 13 (Backing protective layer composition)** | |
| Gelatin | 1.0 g/m$^2$ |
| Matting agent: Polymethylmethacrylate with average grain size of 4.0 μm | 50 mg/m$^2$ |
| Dye f1 | 65 mg/m$^2$ |
| Dye f2 | 15 mg/m$^2$ |
| Dye f3 | 100 mg/m$^2$ |
| Hardener h1 | 100 mg/m$^2$ |

(d-3)

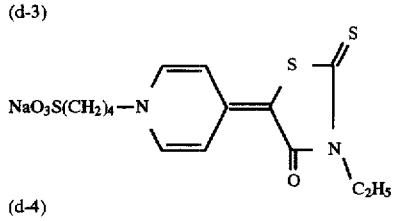

(d-4)

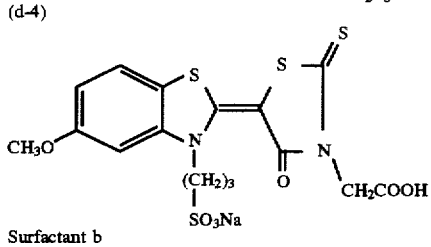

Surfactant b

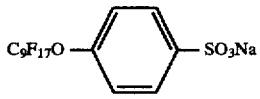

TABLE 2

| No. | Hydrazine compound: Gelatin-subbing layer (mol/mol of silver in emulsion layer 1) | Emulsion layer 1 (mol/mol of silver) | Emulsion layer 2 (mol/mol of silver) |
|---|---|---|---|
| 21 | H-7 (0.6) | — | — |
| 22 | H-7 (1.5) | H-7 (0.5) | H-7 (1.0) |
| 23 | H-7 (1.5) | H-7 (0.25) | H-7 (0.25) |
| 24 | H-7 (0.2) | H-7 (0.5) | H-7 (1.0) |
| 25 | H-7 (0.5) | H-7 (0.3) | H-7 (1.3) |
| 26 | H-7 (0.5) | H-6 (0.4) | H-6 (1.2) |

The samples thus obtained were subjected to exposure by laser sensitometer employing an Ar laser of 488 nm as a light source while changing a quantity of light at $1.5\times10^{-7}$ sec. Then, the samples were subjected to the same processing and evaluation as in Example 1. With regard to sensitivity, it was represented by a relative value, based on the sensitivity of Sample No. 21 being 100.

Further, for evaluating fine halftone dot quality, the samples were subjected to halftoning exposure by SG-757 made by Dainihon Screen Co. wherein 700 lines per inch were used. After that, the same processing and evaluation as in Example 1 were applied to the samples. The results are shown in Table 3.

TABLE 3

| No. | Sensitivity | Gamma | Small-sized dot (%) | Medium-sized dot (%) | Dot quality | Remarks |
|---|---|---|---|---|---|---|
| 21 | 100 | 7 | 2.9 | 55.0 | 2 | Comp. |
| 22 | 120 | 14 | 2.8 | 53.9 | 2 | Comp. |
| 23 | 108 | 12 | 2.3 | 54.2 | 3 | Comp. |
| 24 | 134 | 15 | 4.5 | 50.9 | 5 | Inv. |
| 25 | 141 | 16 | 4.3 | 51.1 | 5 | Inv. |
| 26 | 144 | 17 | 4.7 | 50.7 | 4 | Inv. |

Comp.: Comparative
Inv.: Inventive

It is understood that silver halide photographic light-sensitive materials of the invention for use in a plate-making scanner employing an Ar laser light source have not only high sensitivity and ultra high contrast but also are excellent in reproduction of fine halftone dots and dot quality thereof.

Example 3 preparation of silver halide emulsion C1

An aqueous solution of silver nitrate and an aqueous solution of a mixture of NaCl and KBr were mixed through a controlled double-jet method to form silver halide grains containing 65 mol % of silver chloride and 35 mol % of silver bromide. In this case, the conditions of a temperature of 38° C., pAg of 8.0 and pH of 3.5 were used for mixing the solutions, and $2\times10^{-7}$ mol % of $K_3RhBr_6$ per mol of silver and $3\times10^{-7}$ of $K_3IrCl_6$ per mol of silver were added in the course of grain formation. After that, desalting was conducted by $MgSO_4$ and polynaphthalenesulfonic acid, then, ossein gelatin was added for redispersion. The emulsion thus obtained was comprised of cubic grains having an average grain diameter of 0.2 μm and variation coefficient of 10%. To the emulsion thus obtained, 0.12 g of citric acid and 0.6 g of NaCl were added, and the emulsion was adjusted to a pH of 5.5 and pAg of 7.0. After that, 14.2 mg of chloroauric acid and 8.5 mg of sodium thiosulfate were added to conduct chemical ripening at 60° C. so that the highest sensitivity is obtained. After completion of the ripening, 14 mg of 1-phenyl-5-mercaptotetrazole and 900 mg of 4-methyl-6-hydroxy-1,3,3a,7-tetrazaindene respectively per mol of silver were added.

Preparation of silver halide emulsion C2

Silver halide emulsion C2 was prepared in the same manner as in silver halide emulsion C1 except that an amount of $K_3RhBr_6$ was change to $1.3\times10^{-7}$ mol per mol of silver and an amount of $K_3IrCl_6$ was changed to $2\times10^{-7}$ per mol of silver. Chemical sensitization was similarly conducted, and the sensitivity of emulsion C2 was higher than that of emulsion C1 by 30%.

Preparation of silver halide photographic light-sensitive materials for plate-making scanner employing an infrared semiconductor laser light source On a support was made simultaneous multi-layer coating wherein a gelatin-subbing layer having composition 14 below was coated so as to have a gelatin amount of 0.6 g/m$^2$, silver halide emulsion layer 1 having composition 15 was coated on the gelatin-subbing layer so as to have a silver amount of 1.6 g/m$^2$ and a gelatin amount of 0.85 g/m$^2$, silver halide emulsion layer 2 having composition 16 was coated on the silver halide emulsion layer 1 so as to have a silver amount of 1.6 g/m$^2$ and a gelatin amount of 0.85 g/m$^2$, and a protective layer coating solution having composition 17 below was coated so as to have a gelatin amount of 1.1 g/m$^2$. A subbing layer on the side of the support opposite to aforesaid layers side was subjected to simultaneous multi-layer coating wherein a backing layer having the following composition 18 was coated so that an amount of gelatin of 2.2 g/m$^2$ may be attained, and a backing protective layer having the following composition 19 was coated on the backing layer so that an amount of gelatin of 1.2 g/m$^2$ may be attained on the emulsion layer side through a curtain coating system at a rate of 200 m/min, and then, they were cooled and set. Without intermission, the backing layer side was subjected to simultaneous multi-layer coating and then was cooled and set at −1° C. After that, both sides were dried simultaneously, and thus, a sample was obtained.

| | |
|---|---|
| Composition 14 (Gelatin-subbing layer composition) | |
| Gelatin | 0.6 g/m$^2$ |
| Saponin | 63 mg/m$^2$ |
| Bactericide z | 0.5 mg/m$^2$ |
| Nucleation accelerator: Exemplified compound Na-21 | 6 mg/m$^2$ |
| Dye dispersed in the form of solid particles, as shown in Table 4 | |
| Composition 15 (Silver halide emulsion layer 1 composition) | |
| Gelatin | 0.85 g/m$^2$ |
| Silver halide emulsion C1 | Amount to achieve a silver amount of 1.6 g/m$^2$ |
| Sensitizing dye d-2 | 3 mg/m$^2$ |
| Sensitizing dye d-5 | 2 mg/m$^2$ |
| Hydrazine derivative in Table 4 | |
| Accelerator: Hydroquinone | 50 mg/m2 |
| Latex polymer L1 | 0.5 g/m$^2$ |
| S-1 | 0.7 mg/m$^2$ |
| Compound a | 100 mg/m$^2$ |
| 2-mercapto-6-hydroxypurine | 10 mg/m$^2$ |
| Composition 16 (Silver halide emulsion layer 2 composition) | |
| Gelatin | 0.85 g/m$^2$ |
| Silver halide emulsion C1 | Amount to achieve silver amount of 1.6 g/m$^2$ |
| Sensitizing dye d-2 | 5 mg/m$^2$ |
| Sensitizing dye d-5 | 4 mg/m$^2$ |

-continued

| | |
|---|---|
| Hydrazine derivative as shown in Table 4 | |
| Nucleation accelerator: Exemplified compound Na-23 | 10 mg/m² |
| Latex polymer L1 | 0.5 g/m² |
| S-1 | 0.7 mg/m² |
| Compound a | 100 mg/m² |
| 2-mercapto-6-hydroxypurine | 10 mg/m² |
| Composition 17 (Emulsion protective layer composition) | |
| Gelatin | 1.1 g/m² |
| Accelerator: Hydroquinone | 70 mg/m² |
| Matting agent: Silica with an average size of 0.05 μm | 25 mg/m² |
| Surfactant b | 2 mg/m² |
| Colloidal silica (average grain size 0.05 μm) | 50 mg/m² |
| Hardener h2 | 160 mg/m² |
| Composition 18 (Backing layer composition) | |
| Gelatin | 2.2 g/m² |
| Sodium polystyrenesulfonate | 20 mg/m² |
| Colloidal silica (average grain size 0.05 μm) | 70 mg/m² |
| Latexpolymer L3 | 0.3 g/m² |
| Hardener h3 | 100 mg/m² |
| Composition 19 (Backing protective layer composition) | |
| Gelatin | 1.2 g/m² |
| Matting agent: Polymethylmethacrylate with average grain size of 4.0 μm | 50 mg/m² |
| Surfactant b | 1 mg/m² |
| Latex polymer L3 | 0.3 g/m² |
| Hardener h2 | 158 g/m² |
| Dye f1 | 65 mg/m² |
| Dye f2 | 15 mg/m² |
| Dye f3 | 100 mg/m² |

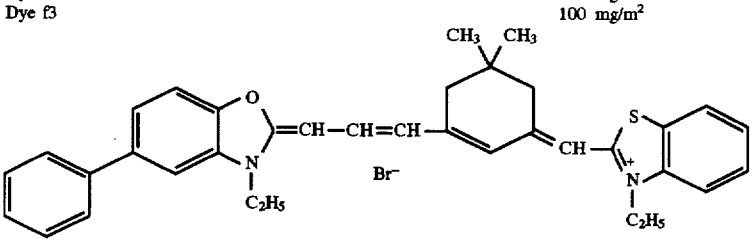

TABLE 4

| No. | Hydrazine compound: Emulsion layer 1 (mol/mol of silver) | Hydrazine compound: Emulsion layer 2 (mol/mol of silver) | Particle-dispersed dye Gelatin-subbing layer (mg/m²) |
|---|---|---|---|
| 31 | H-16 (0.5) | — | Exemplified compound 1–25 (50 mg/m²) |
| 32 | H-16 (0.5) | H-16 (0.5) | 1–25 (50 mg/m²) |
| 33 | H-16 (1.3) | H-16 (0.5) | — |
| 34 | H-16 (0.5) | H-16 (1.3) | 1–25 (50 mg/m²) |
| 35 | H-16 (0.4) | H-16 (1.6) | 1–25 (70 mg/m²) |
| 36 | H-15 (0.5) | H-16 (2.0) | 1–25 (50 mg/m²) |

The samples thus obtained were subjected to exposure by a laser sensitometer employing an infrared semiconductor laser as a light source while changing a quantity of light at $1.5\times10^{-7}$ seconds. Then, the samples were processed under the following conditions by an automatic processing machine GR-27 (made by Konica Corp.). Processed samples were evaluated in the same manner as in Example 1. The sensitivity was represented by relative valve based on the sensitivity of Sample No. 31 being 100.

For evaluating fine halftone dot quality, the samples thus obtained were subjected to halftoning exposure by MTR-1100 made by Dainihon Screen Co. wherein 600 lines per inch were used. After that, the samples were processed in the same manner as in the foregoing and were evaluated in the same manner as in Example 1.

| (Developer composition) | |
|---|---|
| Pure water | 280 g |
| Sodium sulfite | 52 g |
| 1-phenyl-4-methyl-4-hydroxymethyl-3-pyrazolidone | 850 mg |
| Diethyltriaminepentaacetic acid | 1.5 g |
| Boric acid | 8 g |
| Potassium bromide | 10.0 g |
| Potassium carbonate | 50 g |
| Diethyleneglycol | 40 g |
| Benztriazole | 200 mg |
| Hydroquinone | 20 g |
| 1-phenyl-5-mercaptotetrazole | 35 mg |
| Potassium hydroxide | Amount to make pH 10.4 |
| Water was added to make 1 liter, when using. | |

-continued

| (Fixing solution composition) | |
|---|---|
| Ammonium thiosulfate (72.5% w/v aqueous solution) | 200 ml |
| Water | 140 g |
| Disodiumethylenediaminetetraacetate | 100 mg |
| Sodium sulfite | 25 g |
| Boric acid | 10.0 g |
| Acetic acid (90% w/v aqueous solution) | 15.5 ml |
| Sodiumacetatetrihydrate | 36.5 g |
| Tartaric acid (50% w/v aqueous solution) | 6 ml |
| Aluminum sulfate ($Al_2O_3$-converted amount is 8.1% w/v aqueous solution) | 25 ml |
| Sodium hydroxide (50% w/v aqueous solution) | Amount to make pH 4.8 in use |
| Water was added to make 1 liter, when using. | |

(Processing conditions)

| Step | Temperature | Time |
|---|---|---|
| Developing | 35° C. | 30 seconds |
| Fixing | 33° C. | 20 Seconds |
| Washing | Ordinary temperature | 15 seconds |
| Drying | 40° C. | 15 seconds |
| Total | | 80 seconds |

Table 5 shows the results of evaluation.

TABLE 5

| No. | Sensitivity | Gamma | Small dot (%) | Medium dot (%) | Dot quality | Remarks |
|---|---|---|---|---|---|---|
| 31 | 100 | 8 | 2.9 | 54.7 | 2 | Comp. |
| 32 | 108 | 12 | 2.8 | 53.9 | 2 | Comp. |
| 33 | 127 | 15 | 2.5 | 55.6 | 1 | Comp. |
| 34 | 129 | 15 | 4.5 | 50.6 | 5 | Inv. |
| 35 | 133 | 17 | 4.8 | 50.3 | 5 | Inv. |
| 36 | 144 | 17 | 4.7 | 50.7 | 5 | Inv. |

Comp.: Comparative
Inv.: Inventive

It is understood that silver halide photographic light-sensitive materials of the invention for use in a plate-making scanner employing an infrared semiconductor laser light source have not only high sensitivity and ultra high contrast, but also are excellent in reproduction of fine halftone dots and dot quality thereof.

Example 4

Preparation of silver halide emulsion D1

In the course of mixing without controlling pAg through a double-jet method in the acidic atmosphere of nitric acid with pH of 3.2, $8\times10^{-5}$ of rhodiumhexachloride complex per mol of silver was added, and after desalting by means of an ordinary method, an emulsion of silver chloride cubic grains of a monodispersion type (variation coefficient 10%) having an average grain diameter of 0.09 μm was obtained. To the emulsion thus obtained, 63 mg of 4-hydroxy-6-methyl-1,3,3a,7-tetrazaindene per mol of silver was added, then sodium thiosulfate was added, and chemical ripening was conducted at 60° C. until the maximum sensitivity was obtained. After the ripening, 1.5 g of 4-hydroxy-6-methyl-1,3,3a,7-tetrazaindene per mol of silver was added thereto.

Preparation of silver halide emulsion D2

In the course of mixing while keeping pAg constantly at 170 mV through a double-jet method in the acidic atmosphere of nitric acid with pH of 3.2, $7\times10^{-5}$ of rhodium-hexachloride complex per mol of silver was added, and after desalting by means of an ordinary method, an emulsion of silver bromoiodochloride cubic grains (composed of 99 mol % of silver chloride and silver bromide) of a monodispersion type (variation coefficient 10%) having an average grain diameter of 0.16 μm was obtained.

To the emulsion thus obtained, 4-hydroxy-6-methyl-1,3,3a,7-tetrazaindene, potassium bromide and citric acid were added, then $3\times10^{-6}$ of inorganic sulfur per mol of silver was added, and chemical ripening was conducted at 60° C. until the maximum sensitivity was obtained. After the ripening, 4-hydroxy-6-methyl-1,3,3a,7-tetrazaindene, $3\times10^{-4}$ of 1-phenyl-5-mercaptotetrazole and gelatin were added thereto. Preparation of silver halide photographic light-sensitive materials for room light-handlable contact film On a subbing layer on one side of the support was made simultaneous multi-layer coating wherein a gelatin-subbing layer having composition 21 below was coated so as to have a gelatin amount of 0.5 g/m$^2$, silver halide emulsion layer 1 having composition 22 was coated on the gelatin-subbing layer so as to have a silver amount of 1.4 g/m$^2$ and a gelatin amount of 0.9 g/m$^2$, silver halide emulsion layer 2 having composition 23 was coated on the silver halide emulsion layer 1 so as to have a silver amount of 1.4 g/m$^2$ and a gelatin amount of 0.9 g/m$^2$, and a coating solution having composition 24 below was coated on the silver halide emulsion layer 2 as a protective layer so as to have a gelatin amount of 0.8 g/m$^2$. In addition, on a subbing layer on the other side of the support was made simultaneous multi-layer coating wherein a backing layer having composition 25 below was coated so as to achieve a gelatin amount of 2.0 g/m$^2$, a hydrophobic polymer layer having composition 26 below was coated on the backing layer, and a backing protective layer having composition 27 below was coated on the hydrophobic polymer layer so as to have a gelatin amount of 0.8 g/m$^2$. Thus, the samples were obtained.

| Composition 21 (Gelatin-subbing layer composition) | |
|---|---|
| Gelatin | 0.5 g/m$^2$ |
| Dye dispersed in the form of solid particles, as shown in Table 6 | |
| Hydrazine derivative as shown in Table 6 | |
| Nucleation accelerator: Exemplified compound Na-21 | 15 mg/m$^2$ |
| Sodium polystyrenesulfonate | 10 mg/m$^2$ |
| S-1 | 0.4 mg/m$^2$ |
| **Composition 22 (Silver halide emulsion layer 1 composition)** | |
| Gelatin | 0.9 g/m$^2$ |
| Silver halide emulsion D1 | 1.4 g/m$^2$ (silver amount) |
| Dye dispersed in the form of solid particle as shown in Table 6 | |
| Compound m | 6 mg/m$^2$ |
| 1-phenyl-5-mercaptotetrazole | 2.2 mg/m$^2$ |
| Latexpolymer L4 | 0.25 g/m$^2$ |
| S-1 | 0.4 mg/m$^2$ |
| Sodium polystyrenesulfonate | 5 mg/m$^2$ |
| **Composition 23 (Silver halide emulsion layer 2 composition)** | |
| Gelatin | 0.9 g/m$^2$ (silver amount) |
| Compound m | 6 mg/m$^2$ |
| 1-phenyl-5-mercaptotetrazole | 2.2 mg/m$^2$ |
| Latexpolymer L4 | 0.25 g/m$^2$ |
| S-1 | 0.4 mg/m$^2$ |
| Sodium polystyrenesulfonate | 5 mg/m$^2$ |
| Hydrazine derivative in Table 6 | |
| Nucleation accelerator: Exemplified compound Na-21 | 10 mg/m$^2$ |

-continued

| Composition 24 (Emulsion protective layer composition) | |
|---|---|
| Gelatin | 0.8 g/m² |
| Sodium-di-(2-ethyhexyl)-sulfosuccinate | 12 mg/m² |
| Matting agent: Monodispersed silica with an average grain size of 3 μm | 15 mg/m² |
| Matting agent: Monodispersed silica with an average grain size of 8 μm | 20 mg/m² |
| Hydroquinone | 100 mg/m² |
| Colloidal silica (average grain size 0.05 μm) | 120 mg/m² |
| Latexpolymer L4 | 0.3 g/m² |
| Dye f1 | 170 mg/m² |
| Hardener h2 | 150 mg/m² |

| Composition 25 (Backing layer composition) | |
|---|---|
| Gelatin | 2.0 g/m² |
| S-1 | 5 mg/m² |
| Latex polymer L3 | 0.3 g/m² |
| Colloidal silica (average grain size 0.05 μm) | 70 mg/m² |
| Sodium polystyrenesulfonate | 5 mg/m² |

| Composition 26 (Hydrophobic polymer layer composition) | |
|---|---|
| Latex (Styrene: Butadien: Acrylic acid = 30:65:5) | 1.0 g/m² |
| Hardener h2 | 10 mg/m² |

| Composition 27 (Backing protective layer composition) | |
|---|---|
| Gelatin | 0.8 g/m² |
| Matting agent: Monodispersed polymethylmethacrylate with an average grain size of 5 μm | 50 mg/m² |
| Sodium-di-(2-ethylhexyl)-sulfosuccinate | 10 mg/m² |
| Surfactant b | 1 mg/m² |
| Dye f1 | 65 mg/m² |
| Dye f4 | 150 mg/m² |
| Dye f5 | 70 mg/m² |
| Hardener h2 | 120 mg/m² |

(f4)

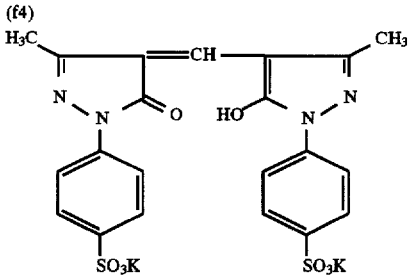

(f5)

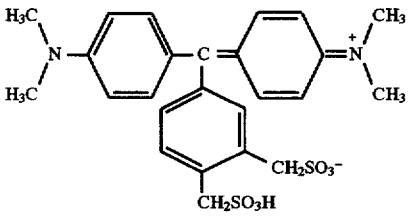

(Compound m)

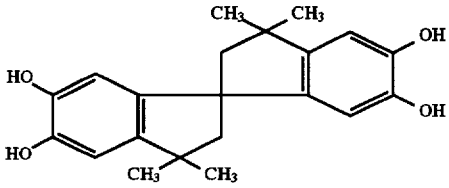

-continued (L4)

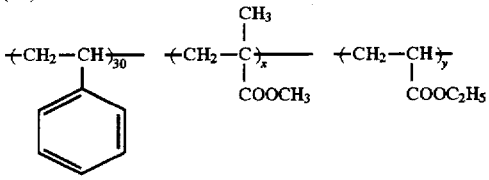

TABLE 6

| No. | Hydrazine compound: Gelatin-subbing layer (mol/mol of silver in Emulsion layer 1) | Hydrazine compound: Emulsion layer 2 (mol/mol of silver) | Particle-dispersed dye: Gelatin-subbing layer (mg/m²) | Particle-dispersed dye: Emulsion layer 1 (mg/m²) |
|---|---|---|---|---|
| 41 | H-15 (0.7) | — | Exemplified compound 1–24 (40) | 1–24 (20) |
| 42 | H-15 (0.7) | H-15 (0.7) | 1–24 (50) | 1–24 (20) |
| 43 | H-15 (1.4) | H-15 (0.7) | — | — |
| 44 | H-15 (0.7) | H-15 (1.4) | 1–24 (30) | 1–24 (20) |
| 45 | H-15 (0.5) | H-15 (2.5) | 1–24 (50) | 1–24 (30) |
| 46 | H-15 (0.7) | H-16 (2.0) | 1–24 (70) | 1–24 (20) |

The samples thus obtained were subjected to exposure in contact with step-wedge (between emulsion surfaces) by the roomlight-handling printer P-627GM (made by Dainihon Screen Co.), and then were processed under the following conditions by the automatic processing machine GR-26SR (made by Konica Corp.) wherein a developer and a fixing solution having respectively the following compositions were used. The processed samples thus obtained were evaluated in the same manner as in Example 1. The sensitivity was shown as a relative sensitivity, based on the sensitivity of No. 41 being 100.

For evaluating dot quality for fine halftone dots, the samples thus obtained were subjected to exposure in contact with (between emulsion surfaces) an original of processed Sample No. 14 prepared in Example 1 by the roomlight-handling printer P-627GM (made by Dainihon Screen Co.), and then were processed in the same manner as in the foregoing. Processed samples thus obtained were subjected to evaluation shown below.

| (Developer composition) | |
|---|---|
| Diethylenetriaminepentaacetic acid | 3.6 g/l |
| Sodium sulfite | 25.0 g/l |
| Potassium sulfite | 38.7 g/l |
| Potassium bromide | 2.5 g/l |
| Potassium carbonate | 40 g/l |
| 8-Mercapto-adenine | 0.07 g/l |
| Diethyleneglycol | 50 g/l |
| 5-Methyl-benztriazole | 0.15 g/l |
| Hydroquinone | 23 g/l |

-continued

| | |
|---|---|
| 4-Methyl-4-hydroxymethyl-1-phenyl-3-hydrazolidone (dimezone S) | 0.8 g/l |
| 1-Phenyl-5-mercaptotetrazole | 0.02 g/l |
| Water and potassium hydroxide were added to make 1 liter with pH of 10.4. | |

(Fixing solution composition)

| | |
|---|---|
| Ammonium thiosulfate (72.5% w/v aqueous solution) | 262 g/l |
| Water | 79 g/l |
| Sodium sulfite (anhydrous) | 22 g/l |
| Boric acid | 9.8 g/l |
| Sodiumacetatetrihydrate | 38.5 g/l |
| Tartaric acid | 7.3 g/l |
| Sodium hydroxide | 0.25 g/l |
| Aluminum sulfate (8.1% in $Al_2O_3$ w/v aqueous solution) | 32.9 g/l |
| Glacial acetic acid and sulfuric acid were added to adjust pH to 4.85, and water was added to make 1 liter. | |

Processing conditions

| Step | Temperature | Time |
|---|---|---|
| Developing | 35° C. | 15 seconds |
| Fixing | 35° C. | 12 Seconds |
| Washing | Ordinary temperature | 12 seconds |
| Drying | 50° C. | 17 seconds |
| Total | | 56 seconds |

Evaluation of reproducibility of fine halftone dots

Dot percentage of a negative image for small-sized dots (5%) produced by the exposure giving 5.0 of a solid density for an original was measured. The value closer to 95% is better, and when it exceeds 98%, it is problematic in practical use.

Method for evaluating dot quality

Images produced on a negative film for small-sized dots (5%) on an original were observed under a 100-power magnifier for evaluating dot quality (definition). For the evaluation, the highest rank was assumed to be 5 which was followed by 4, 3, 2 and 1, depending on the level of dot quality. Ranks 1 and 2 represent a level which is problematic in practical use.

The results are shown in Table 7.

TABLE 7

| No. | Sensitivity | Gamma | Large-sized dot (%) | Dot quality | Remarks |
|---|---|---|---|---|---|
| 41 | 100 | 7 | 98.4 | 2 | Comparative |
| 42 | 114 | 13 | 98.6 | 3 | Comparative |
| 43 | 129 | 15 | 99.5 | 1 | Comparative |
| 44 | 131 | 16 | 96.3 | 5 | Inventive |
| 45 | 138 | 18 | 95.8 | 5 | Inventive |
| 46 | 127 | 16 | 95.4 | 5 | Inventive |

It is understood that silver halide photographic light-sensitive materials of the invention for a roomlight-handling contact film have not only high sensitivity and ultra high contrast but also are excellent in reproduction of fine halftone dots and dot quality thereof.

Example 5

Preparation of silver halide emulsion E1

Silver bromochloride core grains with an average grain diameter of 0.09 μm and containing of 70 mol % chloride were prepared through a double-jet method. A silver nitrate aqueous solution and a water-soluble halide solution were mixed simultaneously, while keeping the temperature of 40° C., pH of 3.0 and silver potential (EAg) of 165 mV, in the presence of $2\times10^{-7}$ of $K_3Rh(NO)_4(H_2O)_2$ per mol of final silver halide. After lowering the EAg to 125 mV by sodium chloride, a double-jet method was applied for forming a shell on the core grain. In that case, $3\times10^{-9}$ mol of $K_3RhCl_6$ was added to a halide solution. Further, instead of KI was added silver iodide fine grains, and the cubic emulsion of silver iodobromochloride (70 mol % of silver chloride and 0.2 mol % of silver iodide) of a core/shell monodispersed type (variation coefficient 10%) having an average grain diameter of 0.15 μm was obtained. After that, 80 mg of sensitizing dye d-3 per mol of silver was added. Then, desalting was conducted by the use of modified gelatin described in Japanese Patent O.P.I. Publication No. 280139/1990 (e.g., Exemplified compound G-8 on page (3) of No. 287 of Japanese Patent O.P.I. Publication No. 280139/1990 wherein an amino group in gelatin is substituted with phenylcarbamyl). EAg after the desalting was 190 mV at 50° C.

To the emulsion thus obtained, $1.5\times10^{-3}$ mol of 4-hydroxy-6-methyl-1,3,3a,7-tetrazaindene per mol of silver and citric acid were added for adjusting pH to 5.8 and EAg to 123 mV. Then, after adding $1\times10^{-3}$ mol of sodium toluenesulfonylchloroamidetrihydrate (chloramine T) for the reaction, solid particle dispersion of sulfur ($S_8$) (Seishin Co.: dispersed to an average particle size of 0.5 μm by adding saponin using PM-1200) and $1.5\times10^{-5}$ mol of chloroauric acid were added, and chemical sensitization was conducted at 60° C. until the highest sensitivity was obtained. Then, 350 mg of sensitizing dye d-6, $2\times10^{-3}$ mol of 4-hydroxy-6-methyl-1,3,3a,7-tetrazaindene, $3\times10^{-4}$ mol of 1-phenyl-5-mercaptotetrazole and $5\times10^{-3}$ mol of potassium iodide, respectively per mol of silver, were added at 40° C., and after that, pH was adjusted to 5.1 by citric acid.

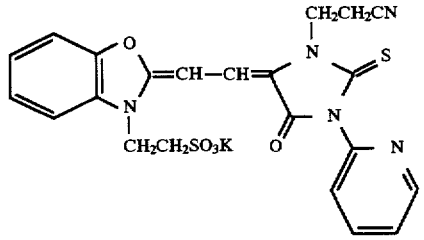

(d-6)

Preparation of silver halide emulsion E2

Silver halide emulsion E2 was prepared in the same manner as in silver halide emulsion El except that reaction temperature was raised to 50° C. to make a grain diameter to be 0.19 μm and $K^3RhCl_6$ added into a shell portion was change to $1\times10^{-7}$ mol/mol Ag. Chemical sensitization was conducted in a manner similar to E1, and as a result, E2 emulsion was higher in sensitivity than E1 emulsion by 35%.

Preparation of silver halide photographic light-sensitive materials for plate-making photographing On a support was made simultaneous multi-layer coating wherein a gelatin-subbing layer having composition 28 below was coated so as to have a gelatin amount of 0.6 g/m², silver halide emulsion layer 1 having composition 29 was coated on the gelatin-subbing layer so as to have a silver amount of 1.5 g/m² and a gelatin amount of 1 g/m², silver halide emulsion layer 2 having composition 30 was coated on the silver halide emulsion layer 1 so as to have a silver amount of 1.5 g/m² and a gelatin amount of 1 g/m², and a protective layer coating solution having composition 31 below was coated so as to have a gelatin amount of 1 g/m². On a subbing layer on the side of the support opposite to aforesaid layers side was made simultaneous multi-layer coating wherein a backing layer having the following composition 32 was coated so as to have an amount of gelatin of 2.0 g/m$^2$, and a backing protective layer having the following composition 33 was coated on the backing layer so as to have an amount of gelatin of 1.0 g/m$^2$ on the emulsion layer side through a curtain coating system at a rate of 200 m/min, and then, they were cooled and set. Subsequently, the backing layer side was subjected to simultaneous multi-layer coating and then was cooled and set at −1° C. After that, both sides were dried simultaneously to obtain a sample.

| Composition 28 (Gelatin subbing-layer composition) | |
|---|---|
| Gelatin | 0.6 g/m$^2$ |
| Saponin | 80 mg/m$^2$ |
| 1-Phenyl-5-mercaptotetrazole | 2.0 mg/m$^2$ |
| DIR compound in Table 8 | |
| Bactericide Z | 0.5 mg/m$^2$ |

| Composition 29 (Silver halide emulsion layer 1 composition) | |
|---|---|
| Silver halide emulsion E1 (silver amount) | 1.5 g/m$^2$ |
| Hydrazine derivative as shown in Table 8 | |
| Nucleation accelerating agent: | |
| Exemplified compound Na-21 | 7 mg/m$^2$ |
| 2-pyridinol | 1 mg/m$^2$ |
| Polymerlatex L1 (grain size 0.25 μm) | 0.25 g/m$^2$ |
| Hardener h1 | 5 mg/m$^2$ |
| S-1 | 3 mg/m$^2$ |
| Saponin | 2 mg/m$^2$ |
| 2-Mercapto-6-hydroxypurine | 2 mg/m$^2$ |
| 2-Mercaptopyridine | 1 mg/m$^2$ |
| Colloidal silica (average grain size 0.05 μm) | 150 mg/m$^2$ |
| Ascorbic acid | 20 mg/m$^2$ |
| EDTA | 25 mg/m$^2$ |
| Sodium polystyrenesulfonate | 15 mg/m$^2$ |
| Coating solution pH was 5.2. | |

| Composition 30 (Silver halide emulsion layer 2 composition) | |
|---|---|
| Silver halide emulsion E2 (silver amount) | 1.5 g/m$^2$ |
| Hydrazine compound in Table 8 | |
| Nucleation accelerating agent: | |
| Exemplified compound Na-21 | 7 mg/m$^2$ |
| S-1 | 5 mg/m$^2$ |
| 2-Mercapto-6-hydroxypurine | 1 mg/m$^2$ |
| Nicotinic-acid amide | 1 mg/m$^2$ |
| Gallic acid n-propyl ester | 50 mg/m$^2$ |
| Mercaptopyrimidine | 1 mg/m$^2$ |
| Polymer latex L1 (grain size 0.25 μm) | 0.25 mg/m$^2$ |
| EDTA | 50 mg/m$^2$ |
| Sodium polystyrenesulfate | 15 mg/m$^2$ |
| Colloidal silica (average grain size 0.05 μm) | 150 mg/m$^2$ |
| Phthalated gelatin was used as gelatin, and pH of a coating solution was 4.8. | |

| Composition 31 (Emulsion protective layer composition) | |
|---|---|
| Gelatin | 1.0 g/m$^2$ |
| S-1 | 12 mg/m$^2$ |
| Matting agent: Spherical polymethlmetacrylate with an average grain size of 3.5 μm | 25 mg/m$^2$ |
| Amorphous silica with an average grain size of 8 μm | 12.5 mg/m$^2$ |
| Surfactant b | 0.6 mg/m$^2$ |
| Polymer latex L2 (grain size 0.10 μm) | 0.25 g/m$^2$ |
| Colloidal silica (average grain size 0.05 μm) | 150 mg/m$^2$ |
| 1,3-vinylsulfonyl-2-propanol | 40 mg/m$^2$ |

-continued

| | |
|---|---|
| Hardener h2 | 160 mg/m$^2$ |
| Sodium polystyrenesulfonate | 20 mg/m$^2$ |
| Bactericide$_z$ | 0.5 mg/m$^2$ |

| Composition 32 (Backing layer composition) | |
|---|---|
| Gelatin | 2.0 g/m$^2$ |
| Polymer latex L3 | 0.3 g/m$^2$ |
| Colloidal silica (average grain size 0.05 μm) | 100 mg/m$^2$ |
| Dye f1 | 40 mg/m$^2$ |
| Dye f2 | 7 mg/m$^2$ |
| Dye f3 | 60 mg/m$^2$ |
| 1-Phenyl-5-mercaptotetrazole | 10 mg/m$^2$ |
| Hardener h3 | 100 mg/m$^2$ |
| EDTA | 50 mg/m$^2$ |

| Composition 33 (Backing protective layer) | |
|---|---|
| Gelatin | 1.0 g/m$^2$ |
| Matting agent: Monodispersed polymethlmetacrylate with an average grain size of 5 μm | 50 mg/m$^2$ |
| Amorphous silica with an average grain size of 3 μm | 12.5 mg/m$^2$ |
| Dye f1 | 40 mg/m$^2$ |
| Dye f2 | 7 mg/m$^2$ |
| Dye f3 | 60 mg/m$^2$ |
| Hardener h1 | 100 mg/m$^2$ |
| S-1 | 6 mg/m$^2$ |
| Sodium polystyrenesulfonate | 10 mg/m$^2$ |

TABLE 8

| | Hydrazine compound | | DIR compound |
|---|---|---|---|
| No. | Emulsion layer 1 (mol/mol of silver) | Emulsion layer 2 (mol/mol of silver) | Gelatin-subbing layer (mg/m$^2$) |
| 51 | H-6 (0.6) | — | 21 (50) |
| 52 | H-6 (0.6) | H-6 (0.6) | 21 (50) |
| 53 | H-6 (1.0) | H-6 (0.6) | — |
| 54 | H-6 (0.6) | H-6 (1.0) | 21 (50) |
| 55 | H-6 (0.7) | H-6 (1.4) | 16 (50) |
| 56 | H-7 (0.7) | H-6 (1.2) | 42 (50) |

The samples thus obtained were brought into close contact with a step wedge to be exposed to tungsten light with 3200° K for 3 seconds, and were processed under the following conditions by an automatic processing machine GR-27 (made by Konica Corp.) in which a developer and a fixing solution having respectively the following compositions were used. The processed samples thus obtained were evaluated in the same manner as in Example 1. The sensitivity was shown as a relative sensitivity, based on the sensitivity of No. 51 being 100.

For evaluating dot quality for fine halftone dots, the sample thus obtained were subjected to exposure through, as an original, processed Sample No. 14 prepared in Example 1 so that a magnification rate for enlargement on fine zoom C-880F made by Dainihon Screen Co. was 120% and a portion of 95% dots of a step wedge of the original became 5% dots. The exposed samples were processed in the same manner as in the foregoing. Processed samples thus obtained were subjected to evaluation shown below.

(Developer composition)

| | |
|---|---|
| Sodium sulfite | 50 g |
| 1-Phenyl-4-methyl,4'-hydroxymethyl-3-Pyrazolidone | 0.85 mg |
| Diethylenetriaminepentaacetic acid | 1.5 g |
| Boric acid | 8 g |
| Potassium bromide | 4 g |
| Potassium carbonate | 55 g |
| 5-Methylbenztriazole | 200 mg |
| Hydroquinone | 20 g |
| Potassium hydroxide | Amount to make pH 10.4 |

When using, water was added to make 1 liter.

(Fixing solution composition)

| | |
|---|---|
| Ammonium thiosulfate (59.5% w/v aqueous solution) | 830 ml |
| Disodiumethylenediaminetetra acetate | 515 mg |
| Sodium sulfite | 63 g |
| Boric acid | 22.5 g |
| Acetic acid (90% w/v aqueous solution) | 82 g |
| Citric acid (50% w/v aqueous solution) | 15.7 g |
| Gluconic acid (50% w/v aqueous solution) | 8.55 g |
| Aluminum sulfate (48% aqueous solution) | 13 ml |
| Glutalaldehyde | 3 g |
| Sulfuric acid | Amount to make pH 4.6 when using |

Water was added to make 1 liter, when using.

(Processing conditions)

| Step | Temperature | Time |
|---|---|---|
| Developing | 35° C. | 30 seconds |
| Fixing | 35° C. | 20 Seconds |
| Washing | Ordinary temperature | 20 seconds |
| Squeezing/drying | 50° C. | 30 seconds |
| Total | | 100 seconds |

Evaluation of enlargement of screen image

Reproducibility of large halftone dots (shadow portion) of the processed sample (i.e., anti-blocking of dots) whose dot % of small dots (highlight portion) was adjusted to 5% was evaluated, being ranked to 5–1 levels wherein 5 is excellent and 1 is poor. The level 3 is a marginal level in practical use. The results are shown in Table 9.

TABLE 9

| No. | Sensitivity | Gamma | Enlargement of screen image | Remarks |
|---|---|---|---|---|
| 51 | 100 | 7 | 2 | Comp. |
| 52 | 114 | 13 | 3 | Comp. |
| 53 | 129 | 15 | 1 | Comp. |
| 54 | 131 | 16 | 5 | Inv. |
| 55 | 138 | 18 | 5 | Inv. |
| 56 | 127 | 16 | 4 | Inv. |

Comp.: Comparative
Inv.: Inventive

It is understood that silver halide photographic light-sensitive materials of the invention have not only high sensitivity and ultra high contrast but also are excellent in dot quality for fine dots.

Example 6

Preparation of silver halide emulsion F1

An aqueous solution of silver nitrate and an aqueous solution of a mixture of NaCl and KBr were mixed through a controlled double-jet method to form silver halide grains containing 80 mol % chloride and 20 mol % bromide. In this case, the conditions including temperature of 36° C., pAg of 7.8 and pH of 3.0 were used for mixing the solutions, and $8\times10^{-8}$ mol of $K_3RuCl_6$ per mol of silver and $3\times10^{-7}$ of $K_2IrCl_6$ per mol of silver were added in the course of grain formation. After that, desalting was conducted with modified gelatin processed with phenylisocyanate, then, ossein gelatin was added for redispersion. The emulsion thus obtained was comprised of cubic grains having an average grain diameter of 0.18 μm and variation coefficient of 10%.

To the emulsion thus obtained, $1\times10^{-3}$ mol of 4-methyl-6-hydroxy-1,3,3a,7-tetrazaindene per mol of silver was added, and further, potassium bromide and citric acid were added The emulsion was adjusted to pH of 5.6 and EAg of 123 mV. After that, $2\times10^{-5}$ of chloroauric acid was added and then $2\times10^{-6}$ of N,N,N'-trimethyl-N'heptafluoroselenourea was added to conduct chemical ripening at 60° C. until the highest sensitivity was obtained. After completion of the ripening, $3\times10^{-3}$ mol of 4-methyl-6-hydroxy-1,3,3a,7-tetrazaindene per mol of silver was added.

Preparation of silver halide emulsion F2

Silver halide emulsion F2 was prepared in the same manner as in silver halide emulsion F1 except that an amount of $K_3RuCl_6$ was varied to $5\times10^{-8}$ mol/ mol Ag. Chemical sensitization was conducted and the sensitivity of emulsion F2 was shown to be higher than that of emulsion F1 by 30%.

Preparation of silver halide photographic light-sensitive materials for use in plate-making scanner employing a He—Ne laser light source On a subbing layer on one side of the support was simultaneously coated multi-layers, wherein a gelatin-subbing layer having composition 34 below was coated to achieve a gelatin amount of 0.6 g/m$^2$, silver halide emulsion layer 1 having composition 35 was coated on the gelatin-subbing layer so as to have a silver amount of 1.5 g/m$^2$ and a gelatin amount of 0.8 g/m$^2$, silver halide emulsion layer 2 having composition 36 was coated on the silver halide emulsion layer 1 so as to have a silver amount of 1.5 g/m$^2$ and a gelatin amount of 0.8 g/m$^2$, protective layer 1 having composition 37 below was coated on the silver halide emulsion layer 2 so as to have a gelatin amount of 0.5 g/m$^2$, and protective layer 2 having composition 38 below was coated on the protective layer 1 so as to have a gelatin amount of 0.5 g/m$^2$. In addition, a subbing layer on the other side of the support was subjected to simultaneous multi-layer coating thereon, wherein a backing layer having composition 39 below was coated so as to have a gelatin amount of 2.0 g/m$^2$, and a backing protective layer having composition 40 below was coated on the backing layer so as to have a gelatin amount of 1.0 g/m$^2$, all simultaneously with coating on the emulsion layer side. Thus, the samples were obtained.

Composition 34

(Gelatin-subbing layer composition)

| | |
|---|---|
| Gelatin | 0.6 g/m$^2$ |
| 1-Phenyl-5-mercaptotetrazole | 1 mg/m$^2$ |
| DIR compound, as shown in Table 10 | |
| Dye in the form of solid particle dispersion, as shown in Table 10 | |
| Sodium polystyrenesulfonate | 10 mg/m$^2$ |
| Saponin | 50 mg/m$^2$ |

Composition 35

(Silver halide emulsion layer composition)

| | |
|---|---|
| Silver halide emulsion F1 | 1.5 g/m$^2$ (silver amount) |
| Sensitizing dye d-1 | 2 mg/m$^2$ |
| Hydrazine derivative in Table 10 | |

-continued

| | |
|---|---|
| Nucleation accelerating agent: Exemplified compound Na-21 | 3 mg/m² |
| DIR compound as shown in Table 10 | |
| Latex polymer L1 | 0.25 g/m² |
| S-1 | 0.7 mg/m² |
| 2-mercapto-6-hydroxypurine | 5 mg/m² |
| Sodium polystyrenesulfonate | 10 mg/m² |
| EDTA | 10 mg/m² |
| Composition 36 | |
| (Silver halide emulsion layer 2 composition) | |
| Silver halide emulsion F2 | 1.5 g/m² (silver amount) |
| Sensitizing dye d-1 | 5 mg/m² |
| Sensitizing dye d-7 | 2 mg/m² |
| Hydrazine derivative as shown in Table 10 | |
| Nucleation accelerating agent: Exemplified compound Na-21 | 6 mg/m² |
| Latex polymer L1 | 0.25 g/m² |
| S-1 | 1.0 mg/m² |
| 2-mercapto-6-hydroxypurine | 5 mg/m² |
| Sodium polystyrenesulfonate | 10 mg/m² |
| EDTA | 10 mg/m² |
| Composition 37 | |
| (Emulsion protective layer 1 composition) | |
| Gelatin | 0.5 g/m² |
| Latex polymer L2 | 0.3 g/m² |
| S-1 | 6 mg/m² |
| Composition 38 | |
| (Emulsion protective layer 2 composition) | |
| Gelatin | 0.5 g/m² |
| S-1 | 10 mg/m² |
| Matting agent: Monodispersed silica with an average grain size of 3.5 μm | 25 mg/m² |
| 1,3-Vinylsulfonyl-2-propanol | 40 mg/m² |
| Surfactant b | 1 mg/m² |
| Colloidal silica (average grain size 0.05 μm) | 300 mg/m² |
| Hardener h2 | 170 mg/m² |
| Composition 39 | |
| (Backing layer composition) | |
| Gelatin | 2.0 g/m² |
| S-1 | 5 mg/m² |
| Polymerlatex L3 | 0.3 g/m² |
| Colloidal silica (average grain size 0.05 μm) | 70 mg/m² |
| Sodium polystyrenesulfonate | 20 mg/m² |
| Hardener h3 | 100 mg/m² |
| Composition 40 | |
| (Backing protective layer) | |
| Gelatin | 1.0 g/m² |
| Matting agent: Monodispersed polymetacrylate with an average grain size of 5 μm | 50 mg/m² |
| Sodium-di-(2-ethylhexyl)-sulfosuccinate | 10 mg/m² |
| Dye f1 | 80 mg/m² |
| Dye f2 | 13 mg/m² |
| Dye f3 | 120 mg/m² |
| Surfactant b | 1 mg/m² |
| Hardener h1 | 70 mg/m² |

The samples thus obtained were subjected to exposure, processing and evaluation in the same manner as in Example 1. The sensitivity was shown as a relative sensitivity, based on the sensitivity of No. 61 being 100. The results are shown in Table 11.

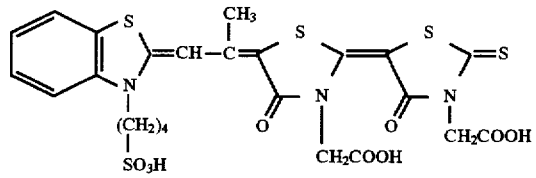

(d-7)

TABLE 10

| No. | Hydrazine compound: Emulsion layer 1 (mol/mol of silver) | Hydrazine compound: Emulsion layer 2 (mol/mol of silver) | Solid-dispersed dye Gelatin-subbing layer (mg/m²) | DIR compound: Gelatin-subbing layer (mg/m²) | DIR compound: Emulsion layer 1 (mg/m²) |
|---|---|---|---|---|---|
| 61 | H-6 (0.6) | — | Exemplified compound 1-25 (70) | 16 (50) | 16 (20) |
| 62 | H-6 (0.6) | H-6 (0.6) | 1-25 (70) | 16 (50) | 16 (20) |
| 63 | H-6 (1.5) | H-6 (0.6) | — | — | — |
| 64 | H-6 (0.6) | H-6 (1.5) | 1-25 (70) | 16 (50) | 16 (20) |
| 65 | H-6 (0.7) | H-6 (2.5) | 1-25 (70) | 21 (40) | 21 (10) |
| 66 | H-7 (0.5) | H-6 (1.2) | 1-25 (70) | 19 (40) | 19 (10) |

TABLE 11

| No. | Sensitivity | Gamma | Small dot (%) | Medium dot (%) | Dot quality | Remarks |
|---|---|---|---|---|---|---|
| 61 | 100 | 8 | 2.7 | 54.3 | 2 | Comp. |
| 62 | 116 | 12 | 2.6 | 53.7 | 2 | Comp. |
| 63 | 133 | 15 | 2.3 | 55.4 | 1 | Comp. |
| 64 | 128 | 15 | 4.9 | 50.3 | 5 | Inv. |
| 65 | 136 | 16 | 4.8 | 50.3 | 5 | Inv. |
| 66 | 126 | 16 | 5.0 | 50.1 | 5 | Inv. |

Comp.: Comparative
Inv.: Inventive

It is understood that silver halide photographic light-sensitive materials of the invention for a plate-making scanner employing a He—Ne laser light source are not only highly sensitive and ultra high contrast but also are excellent in reproduction of fine halftone dots and dot quality thereof.

Preparation of silver halide emulsion G1

Silver bromochloride core grains with an average grain diameter of 0.12 μm and containing 70 mol % chloride were prepared through a double-jet method. Thus, a silver nitrate aqueous solution and a water-soluble halide solution were mixed simultaneously, while keeping the temperature of 45° C., pH of 3.2 and silver potential (EAg) of 170 mV, in the presence of $1\times10^{-7}$ mol of $K_3Rh(NO)_4(H_2O)_2$ per mol of final silver halide and $1\times10^{-5}$ mol of $K_3OsCl_6$ per mol of silver halide. After lowering the EAg to 125 mV by sodium chloride, a double-jet method was applied to form a shell on a core grain. Further, instead of KI was used silver iodide grains, and the cubic emulsion of silver iodobromochloride (70 mol % chloride and 0.2 mol % iodide) of a core/shell monodispersed type (variation coefficient 10%) having an average grain diameter of 0.15 μm was obtained. After that, 80 mg of sensitizing dye d-3 per mol of silver was added. Then, desalting was conducted by the use of modified gelatin processed with phenylisocyanate, and ossein gelatin was added to redisperse the emulsion.

To the emulsion thus obtained, $1.5\times10^{-3}$ of 4-hydroxy-6-methyl-1,3,3a,7-tetrazaindene per mol of silver and citric acid were added for adjusting pH to 5.6 and EAg to 123 mV. Then, after adding $1\times10^{-3}$ mol of sodium toluenesulfonylchloroamidetrihydrate (chloramine T) for the reaction, particle-dispersed sulfur ($S_8$) (Seishin Co.: dispersed to an averageparticle size of 0.5 μm by adding saponin using PM-1200) and $1\times10^{-5}$ mol of chloroauric acid were added, and chemical sensitization was conducted at 57° C. until the highest sensitivity was obtained. After lowering the temperature to 40° C., $2\times10^{-3}$ mol of 4-hydroxy-6-methyl-1,3,3a,7-tetrazaindene, $3\times10^{-4}$ mol of 1-phenyl-5-mercaptotetrazole and $5\times10^{-3}$ mol of potassium iodide, respectively per mol of silver, were added, and after that, pH was adjusted to 5.1 by citric acid.

Preparation of silver halide emulsion G2

Silver halide emulsion G2 was prepared in the same manner as in silver halide emulsion G1 except that reaction temperature was raised to 53° C. to make a grain diameter to be 0.21 μm and $K_3RhCl_6$ in a shell portion was varied to $7\times10^{-8}$ mol. Chemical sensitization was conducted and G2 emulsion was higher in sensitivity than G1 emulsion by 30%.

Preparation of silver halide photographic light-sensitive materials for plate-making photographing On a support was simultaneously coated multi-layers, wherein a gelatin-subbing layer having composition 41 below was coated so as to have a gelatin amount of 0.6 g/m², silver halide emulsion layer 1 having composition 42 was coated on the gelatin-subbing layer so as to have a silver amount of 1.6 g/m² and a gelatin amount of 0.8 g/m², silver halide emulsion layer 2 having composition 43 was coated on the silver halide emulsion layer 1 so as to have a silver amount of 1.6 g/m² and a gelatin amount of 0.8 g/m², a protective layer 1 coating solution having composition 44 below was coated so as to have a gelatin amount of 0.5 g/m², and further a protective layer 2 coating solution having composition 45 below was coated so as to have a gelatin amount of 0.5 g/m². A subbing layer on the side of the support opposite to aforesaid layers side was subjected to simultaneous multi-layer coating, wherein a backing layer having the following composition 46 was coated so as to have an amount of gelatin of 2.0 g/m², and a backing protective layer having the following composition 47 was coated on the backing layer so as to have an amount of gelatin of 1.0 g/m² on the emulsion layer side through a curtain coating system at a rate of 200 m/min, and then, they were cooled and set. Subsequently, the backing layer side was subjected to simultaneous multi-layer coating and then was cooled and set at −1° C. After that, both sides were dried simultaneously, and thus, a sample was obtained.

| Composition 41 (Gelatin subbing-layer composition) | |
|---|---|
| Gelatin | 0.6 g/m² |
| Saponin | 80 mg/m² |
| 1-Phenyl-5-mercaptotetrazole | 2.0 mg/m² |
| DIR compound in Table 12 | |
| Solid-dispersed dye in Table 12 | |
| Bactericide Z | 0.5 mg/m² |
| **Composition 42 (Silver halide emulsion layer 1 composition)** | |
| Silver halide emulsion G1 | 1.6 g/m² (silver amount) |
| Hydrazine derivative as shown in Table 12 | |
| Nucleation accelerating agent: | |
| Exemplified compound Na-21 | 2 mg/m² |

-continued

| | |
|---|---|
| Dye in the form of solid particle dispersion as shown in Table 12 | |
| Sensitizing dye d-8 | 2 mg/m² |
| 2-Pyridinol | 1 mg/m² |
| Polymerlatex L1 (grain size 0.25 μm) | 0.25 g/m² |
| S-1 | 2.5 mg/m² |
| Saponin | 2 mg/m² |
| 2-Mercapto-6-hydroxypurine | 2 mg/m² |
| 2-Mercaptopyridine | 1 mg/m² |
| Colloidal silica (average grain size 0.05 μm) | 150 mg/m² |
| Ascorbic acid | 20 mg/m² |
| EDTA | 25 mg/m² |
| Sodium polystyrenesulfonate | 15 mg/m² |
| A value of pH of the coating solution was 5.2. | |
| **Composition 43 (Silver halide emulsion layer 2 composition)** | |
| Silver halide emulsion G2 | 1.6 g/m² (silver amount) |
| Hydrazine compound in Table 12 | |
| Nucleation accelerating agent: | |
| Exemplified compound Na-21 | 5 mg/m² |
| Sensitizing dye d-8 | 5 mg/m² |
| S-1 | 3 mg/m² |
| 2-Mercapto-6-hydroxypurine | 1 mg/m² |
| Nicotinic acid amide | 1 mg/m² |
| Gallic acid n-propylester | 50 mg/m² |
| Mercaptopyrimidine | 1 mg/m² |
| Polymerlatex L1 (grain diameter 0.25 μm) | 0.25 g/m² |
| EDTA | 50 mg/m² |
| Sodium polystyrenesulfonate | 15 mg/m² |
| Colloidal silica (average grain size 0.05 μm) | 150 mg/m² |
| Phthalated gelatin was used and a pH value of the coating solution was 4.8. | |
| **Composition 44 (Emulsion protective layer 1 composition)** | |
| Gelatin | 0.5 g/m² |
| S-1 | 7 mg/m² |
| Polymerlatex L2 (grain diameter 0.10 μm) | 0.3 g/m² |
| Sodium polystyrenesulfonate | 10 mg/m² |
| Bacteriocide$_z$ | 0.5 mg/m² |
| **Composition 45 (Emulsion protective layer 2 composition)** | |
| Gelatin | 0.5 g/m² |
| S-1 | 12 mg/m² |
| Matting agent: Spherical polymethylmetacrylate with an average grain size of 3.5 μm | 25 mg/m² |
| Amorphous silica with an average grain size of 8 μm | 12.5 mg/m² |
| Surfactant b | 1.0 mg/m² |
| Colloidal silica (average grain size 0.05 μm) | 200 mg/m² |
| 1,3-Vinylsulfonyl-2-propanol | 40 mg/m² |
| Hardener h2 | 160 mg/m² |
| Sodium polystyrenesulfonate | 10 mg/m² |
| Bactericide Z | 0.5 mg/m² |
| **Composition 46 (Backing layer composition)** | |
| Gelatin | 2.0 g/m² |
| Polymerlatex L3 | 0.3 g/m² |
| Colloidal silica (average grain size 0.05 μm) | 100 mg/m² |
| Dye f1 | 40 mg/m² |
| Dye f2 | 7 mg/m² |
| Dye f3 | 60 mg/m² |
| 1-Phenyl-5-mercaptotetrazole | 10 mg/m² |
| Hardener h3 | 100 mg/m² |
| EDTA | 50 mg/m² |
| **Composition 47 (Backing protective layer)** | |
| Gelatin | 1.0 g/m² |
| Matting agent: Monodispersed polymethylmetacrylate with an average grain size of 5 μm | 50 mg/m² |
| Amorphous silica with an average grain size of 3 μm | 12.5 mg/m² |
| Dye f1 | 40 mg/m² |
| Dye f2 | 7 mg/m² |

-continued

| | |
|---|---|
| Dye f3 | 60 mg/m² |
| Hardener hl | 80 mg/m² |
| S-1 | 6 mg/m² |
| Sodium polystyrenesulfonate | 10 mg/m² |

(d-8)

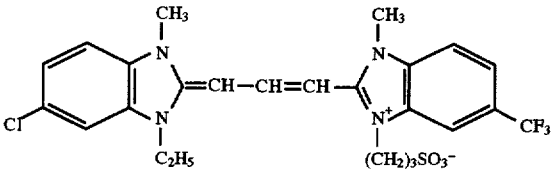

Preparation of Comparative silver halide photographic light-sensitive materials 7A and 7B:

Preparation of silver halide emulsion

An aqueous solution of silver nitrate and an aqueous solution of a mixture of NaCl and KBr were mixed through a controlled double-jet method to form silver halide grains containing 70 mol % chloride and 30 mol % bromide. In this case, the conditions including temperature of 36° C., pAg of 7.8 and pH of 3.0 were used for mixing the solutions, and $2\times10^{-7}$ mol of $Na_3RhCl_6$ per mol of silver was added in the course of grain formation. After completion of mixing, 80 mg of sensitizing dye d-3 per mol of silver was added. After that, desalting was conducted using modified gelatin processed with phenylisocyanate, then, bactericide Z and ossein gelatin was added for redispersion. The emulsion thus obtained was comprised of cubic grains having an average grain diameter of 0.2 μm and variation coefficient of 10%. To the emulsion thus obtained, 60 mg of 4-hydroxy-6-methyl-1,3,3a,7-tetrazaindene was added, and further, 5 mg of chloroauric acid and 0.5 mg of flower of sulfur respectively per mol of silver were added to conduct chemical ripening for 80 minutes under the conditions of a pH of 5.8, pAg of 6.5 and temperature of 60° C. After completion of the ripening, 900 mg of 4-hydroxy-6-methyl-1,3,3a,7-tetrazaindene per mol of silver was added, and 300 mg of KI and 250 mg of sensitizing dye d-8 were further added.

Preparation of silver halide photographic light-sensitive materials

The following compositions 48–50 were simultaneously coated on the support in this order from the support. On the opposite side of the support, a backing layer was coated in accordance with the following composition 51 so that a gelatin amount of 2.0 g/m² may be achieved, and further thereon, there was coated a protective layer having the following composition 52 so that a gelatin amount of 1.0 g/m² may be achieved to obtain samples.

| | |
|---|---|
| Composition 48 | |
| (Gelatin-subbing layer composition) | |
| Gelatin | 0.6 g/m² |
| 1-Phenyl-5-mercaptotetrazole | 1 mg/m² |
| DIR compound in Table 12 | |
| Soild-dispersed dye in Table 12 | |
| Sodium polystyrenesulfonate | 10 mg/m² |
| Saponin | 50 mg/m² |
| Composition 49 | |
| (Silver halide emulsion layer composition) | |
| Silyer halide einulsion | |
| An amount to make a silver amount of 3.2 g/m² | |
| Hydrazine compound in Table 12 | |
| Nucleation accelerating agent: | 7 mg/m² |
| Exemplified compound Na-21 | |

-continued

| | |
|---|---|
| S-1 | 3 mg/m² |
| 2-mercapto-6-hydroxypurine | 2 mg/m² |
| Nicotinic acid amide | 2 mg/m² |
| Gallic acid n-propylester | 100 mg/m² |
| Mercaptopyrimidine | 2 mg/m² |
| Polymerlatex L1 (grain diameter 0.25 μm) | 0.5 g/m² |
| EDTA | 110 mg/m² |
| Sodium polystyrenesulfonate | 30 mg/m² |
| Colloidal silica (average grain size of 0.05 μm) | 150 mg/m² |
| Phthalated gelatin was used, and the pH of a coating solution was 4.8. | |
| Composition 50 | |
| (Emulsion protective layer composition) | |
| Gelatin | 1.0 g/m² |
| S-1 | 12 mg/m² |
| Surfactant b | 1.0 mg/m² |
| Polymerlatex L2 (grain diameter 0.10 μm) | 0.3 g/m² |
| Colloidal silica (average grain diameter 0.05 μm) | 150 mg/m² |
| 1,3-vinylsulfonyl-2-propanol | 40 mg/m² |
| Hardener h2 | 160 mg/m² |
| Sodium polystyrenesulfonate | 20 mg/m² |
| Bactericide z | 1.0 mg/m² |
| Composition 51 | |
| (Backing layer composition) | |
| Gelatin | 2.0 g/m² |
| Polymer latex L3 | 0.3 g/m² |
| Colloidal silica (average grain size 0.05 μm) | 100 mg/m² |
| Dye f1 | 40 mg/m² |
| Dye f2 | 7 mg/m² |
| Dye f3 | 60 mg/m² |
| 1-Phenyl-5-mercaptotetrazole | 10 mg/m² |
| Hardener h3 | 100 mg/m² |
| EDTA | 50 mg/m² |
| Composition 52 | |
| (Backing protective layer) | |
| Gelatin | 1.0 g/m² |
| Matting agent: Monodispersed polymethylmetacrylate with an average grain size of 5 μm | 50 mg/m² |
| Amorphous silica with an average grain size of 3 μm | 12.5 mg/m² |
| Dye f1 | 40 mg/m² |
| Dye f2 | 7 mg/m² |
| Dye f3 | 60 mg/m² |
| Hardener h1 | 80 mg/m² |
| S-1 | 6 mg/m² |
| Sodium polystyrenesulfonate | 10 mg/m² |

TABLE 12

| | Hydrazine compound | | DIR compound | Solid dispersion | |
|---|---|---|---|---|---|
| No. | Emulsion layer 1 (mol/mol of silver) | Emulsion layer 2 (mol/mol of silver) | Gelatin-subbing layer (mg/m²) | Gelatin-subbing layer (mg/m²) | Emulsion layer 1 (mg/m²) |
| 7A | Emulsion layer H-6 (0.6) | | 16 (70) | Exemplified compound 1-26 (60) | — |
| 7B | Emulsion layer H-6 (0.6) | | 16 (70) | 1-24 (60) | — |
| 71 | H-6 (0.6) | — | 16 (70) | 1-26 (50) | 1-26 (20) |
| 72 | H-6 (0.6) | H-6 (0.6) | 16 (70) | 1-26 (50) | 1-26 (20) |
| 73 | H-6 (0.6) | H-6 (1.2) | 16 (70) | 1-24 (50) | 1-24 (20) |
| 74 | H-6 (0.6) | H-6 (1.0) | 16 (70) | 1-26 (40) | 1-26 (20) |

TABLE 12-continued

| No. | Hydrazine compound Emulsion layer 1 (mol/mol of silver) | Hydrazine compound Emulsion layer 2 (mol/mol of silver) | DIR compound Gelatin-subbing layer (mg/m²) | Solid dispersion Gelatin-subbing layer (mg/m²) | Solid dispersion Emulsion layer 1 (mg/m²) |
|---|---|---|---|---|---|
| 75 | H-7 (0.5) | H-6 (1.5) | 21 (60) | 1-24 (50) | 1-24 (20) |
| 76 | H-15 (0.6) | H-6 (2.0) | 21 (60) | 1-26 (40) | 1-26 (20) |

The samples thus obtained were subjected to exposure, processing and evaluation in the same manner as in Example 5 except that developers a and b having respectively the following compositions were used. The sensitivity was shown as a relative sensitivity, based on the sensitivity of No. 7A being 100.

(Developer composition-a)
Concentrated developer composition A (amount per 1 liter)

| | |
|---|---|
| Potassium sulfite | 0.7 mol/l |
| n-Butyldiethanolamine | 15.0 g/l |
| Hydroquinone | 50 g/l |
| 2-Mercaptobenzimidazole-5-sulfonic acid | 0.3 g/l |
| 5-Sulfosalicylic acid | 55.0 g/l |
| Potassium bromide | 10 g/l |
| EDTA | 1.0 g/l |
| Boric acid | 35 g/l |
| Sodium toluenesulfonate | 8.0 g/l |

KOH was added in an amount necessary ti make the pH of a working solution 11.8. To two parts of the above concentrated developer was added one part of water to prepare a working solution. The working solution was used as a developer tank solution as a replenisher.

(Developer composition-b)
Concentrated developer composition A (amount per 1 liter)

| | |
|---|---|
| Pentasodiumdiethylenepenta acetate | 9 g/l |
| Sodium sulfite | 0.45 mol/l |
| Hydroquinone | 18 g/l |
| 1-Phenyl-4-methyl-4-hydroxymethyl-3-pyrazolidone | 7 g/l |
| Potassium carbonate | 2.4 mol/l |
| 5-Methylbenstriazole | 0.75 g/l |
| Potassium bromide | 22 g/l |
| Boric acid | 6 g/l |
| Diethylineglycol | 80 g/l |

KOH was added in an amount necessary to make the pH of a working solution 10.0. To two parts of the above concentrated developer was added one part of water to prepare a working solution. The working solution was used as a developer tank solution as a replenisher.

When using, a solution to be used was prepared by adding 2 parts of water to one part of aforesaid over-concentrated developer A. This solution to be used was also used as a mother developer and as a developer replenisher. The results evaluation are shown in Table 13.

TABLE 13

| No. | Developer | Sensitivity a | Sensitivity b | Gamma a | Gamma b | Enlargement a | Enlargement b | Remarks |
|---|---|---|---|---|---|---|---|---|
| 7A | | 100 | 92 | 14 | 13 | 2 | 2 | Comp. |
| 7B | | 108 | 97 | 13 | 13 | 2 | 2 | Comp. |
| 71 | | 110 | 108 | 17 | 15 | 4 | 1 | Comp. |
| 72 | | 143 | 134 | 17 | 16 | 5 | 2 | Comp. |
| 73 | | 139 | 138 | 18 | 17 | 4 | 5 | Inv. |
| 74 | | 135 | 127 | 19 | 17 | 5 | 5 | Inv. |
| 75 | | 148 | 145 | 19 | 16 | 5 | 5 | Inv. |
| 76 | | 142 | 141 | 20 | 18 | 4 | 5 | Inv. |

It is understood that silver halide photographic light-sensitive materials of the invention are not only highly sensitive and ultra high contrast but also are excellent in dot quality for fine halftone dots, regardless of pH values of developing solutions.

What is claimed is:

1. A silver halide black-and-white photographic light sensitive material comprising a support and photographic component layers provided on one side of said support, said component layers comprising a first silver halide emulsion layer, a second silver halide emulsion layer and optionally a non light-sensitive hydrophilic colloidal layer, the first emulsion layer being provided closer to the support than the second emulsion layer, wherein:

said first emulsion layer and second emulsion layer, each contains a hydrazine compound and a molar ratio of a hydrazine content of the first emulsion layer to that of the second emulsion layer is 0.2 to 0.8.

2. The silver halide photographic material of claim 1, wherein at least one of the component layers contains a redox compound capable of releasing a development inhibitor upon oxidation.

3. The silver halide photographic material of claim 2, wherein said redox compound is contained in a nonlight-sensitive hydrophilic colloid layer which is adjacent to the first emulsion layer and closer to the support than the first emulsion layer.

4. The silver halide photographic material of claim 1, wherein at least one of the component layers contains a dye in the form of a solid particle dispersion.

5. The silver halide photographic material of claim 4, wherein said dye is contained in said first emulsion layer or a nonlight-sensitive hydrophilic colloid layer which is adjacent to the first emulsion layer and closer to the support than the first emulsion layer.

* * * * *